US008840277B1

(12) United States Patent
Shatz et al.

(10) Patent No.: US 8,840,277 B1
(45) Date of Patent: Sep. 23, 2014

(54) LIGHT ASSEMBLY FOR FLASHLIGHTS

(75) Inventors: Narkis E. Shatz, San Diego, CA (US); John C. Bortz, Spokane, WA (US)

(73) Assignee: Surefire, LLC, Fountain Valley, CA (US)

( * ) Notice: Subject to any disclaimer, the term of this patent is extended or adjusted under 35 U.S.C. 154(b) by 391 days.

(21) Appl. No.: 13/374,800

(22) Filed: Jan. 13, 2012

Related U.S. Application Data

(63) Continuation-in-part of application No. 13/373,320, filed on Nov. 10, 2011, now Pat. No. 8,714,782, and a continuation-in-part of application No. 13/135,508, filed on Jul. 7, 2011, now Pat. No. 8,727,576, which is a continuation-in-part of application No. 12/004,664, filed on Dec. 20, 2007, now Pat. No. 8,007,156, said application No. 13/373,320 is a continuation-in-part of application No. 13/135,508.

(60) Provisional application No. 60/879,948, filed on Jan. 9, 2007.

(51) Int. Cl.
*F21V 3/00* (2006.01)
*F21V 5/00* (2006.01)

(52) U.S. Cl.
USPC ..... 362/296.1; 362/311.02; 362/311.12; 362/327; 362/335

(58) Field of Classification Search
USPC ..... 362/296.1, 311.02, 311.12, 317, 335
See application file for complete search history.

(56) References Cited

U.S. PATENT DOCUMENTS

| | | | |
|---|---|---|---|
| 4,770,514 | A | 9/1988 | Silverglate |
| 5,485,317 | A | 1/1996 | Perissinotto et al. |
| 5,577,493 | A | 11/1996 | Parkyn, Jr. et al. |
| 5,757,557 | A | 5/1998 | Medvedev et al. |
| 5,813,743 | A | 9/1998 | Naka |
| 5,926,658 | A | 7/1999 | Tenmyo |
| 6,078,752 | A | 6/2000 | Tenmyo |
| 6,400,905 | B1 | 6/2002 | Tenmyo |
| 6,478,453 | B2 | 11/2002 | Lammers et al. |
| 6,547,423 | B2 | 4/2003 | Marshall et al. |
| 6,575,582 | B2 | 6/2003 | Tenmyo |
| 6,632,004 | B2 | 10/2003 | Sugawara et al. |
| 6,712,485 | B2 | 3/2004 | Matthews |
| 6,807,369 | B1 | 10/2004 | Tenmyo |
| 6,819,506 | B1 | 11/2004 | Taylor et al. |

(Continued)

FOREIGN PATENT DOCUMENTS

| | | |
|---|---|---|
| JP | 4138439 | 5/1992 |
| JP | 8262538 | 10/1996 |
| WO | WO2006072885 A1 | 7/2006 |

OTHER PUBLICATIONS

N. Shatz and J. Bortz, "An inverse engineering perspective on nonimaging optical design", Proc. SPIE, v. 2358, pp. 136-156 (1995).

(Continued)

*Primary Examiner* — Joseph L Williams
(74) *Attorney, Agent, or Firm* — David Weiss

(57) ABSTRACT

A nonimaging light assembly for flashlights, including a light source and a lens symmetrical about an optical axis for receiving light from the light source and producing therefrom a light beam having concentrated and divergent components resulting in a high intensity core beam surrounded by a smoothly transitioning lower intensity surround beam. In a preferred embodiment utilizing a light emitting diode as the light source, the combined light beam produced by the light assembly has a substantially circular cross section.

48 Claims, 43 Drawing Sheets

(56) References Cited

U.S. PATENT DOCUMENTS

| | | | |
|---|---|---|---|
| 6,994,449 | B2 | 2/2006 | Kim |
| 7,086,297 | B2 | 8/2006 | Blakesley et al. |
| 7,117,624 | B2 | 10/2006 | Kim |
| 7,246,931 | B2 | 7/2007 | Hsieh et al. |
| 7,273,292 | B2 | 9/2007 | Kim |
| 7,722,205 | B2 | 5/2010 | Kim |
| 8,033,690 | B1 | 10/2011 | Shatz et al. |
| 8,152,327 | B2 | 4/2012 | Brands et al. |
| 2004/0105171 | A1 | 6/2004 | Minano et al. |
| 2005/0122711 | A1 | 6/2005 | Matthews et al. |
| 2005/0201100 | A1 | 9/2005 | Cassarly et al. |

OTHER PUBLICATIONS

N. Shatz, J. Bortz and D. Pitou, "Optimal design of a nonimaging projection lens for use with an LED source and a rectangular target", Proc. SPIE, v.4092, pp. 130-138 (2000).

N. Shatz and J. Bortz, "Optimal design of a nonimaging lens for use with an RF source and a rectangular target", Proc. SPIE, v. 4446, pp. 171-184 (2001).

H. Ries, N. Shatz, J. Bortz, and W.Spirkl, "Consequences of skewness conservation for rotationally symmetric nonimaging devices", Proc. SPIE, v. 3139, pp. 47-58 (1997).

N. Shatz, J. Bortz, H.Ries, and R. Winston, "Nonrotationally symmetric nonimaging systems that overcome the flux-transfer performance limit imposed by skewness conservation", Proc. SPIE, v.3139, pp. 76-85 (1997).

| X | Y | X | Y | X | Y |
|---|---|---|---|---|---|
| -14.4043 | 0.0000 | -16.7663 | 4.2608 | -11.7741 | 6.7821 |
| -14.4043 | 0.0671 | -16.6837 | 4.3172 | -11.6817 | 6.8204 |
| -14.4043 | 0.1671 | -16.6004 | 4.3725 | -11.5892 | 6.8584 |
| -14.4043 | 0.2671 | -16.5164 | 4.4267 | -11.4966 | 6.8962 |
| -14.4043 | 0.3671 | -16.4318 | 4.4801 | -11.4040 | 6.9338 |
| -14.4043 | 0.4671 | -16.3467 | 4.5326 | -11.3112 | 6.9713 |
| -14.4043 | 0.5671 | -16.2612 | 4.5844 | -11.2185 | 7.0086 |
| -14.4043 | 0.6671 | -16.1753 | 4.6356 | -11.1256 | 7.0457 |
| -14.4043 | 0.7671 | -16.0890 | 4.6862 | -11.0327 | 7.0827 |
| -14.4043 | 0.8671 | -16.0024 | 4.7362 | -10.9397 | 7.1195 |
| -14.4043 | 0.9671 | -15.9156 | 4.7857 | -10.8467 | 7.1563 |
| -14.4043 | 1.0671 | -15.8284 | 4.8348 | -10.7536 | 7.1928 |
| -14.4043 | 1.1671 | -15.7411 | 4.8835 | -10.6605 | 7.2293 |
| -14.4043 | 1.2671 | -15.6535 | 4.9317 | -10.5674 | 7.2656 |
| -14.4043 | 1.3671 | -15.5657 | 4.9796 | -10.4741 | 7.3018 |
| -14.4043 | 1.4671 | -15.4777 | 5.0272 | -10.3809 | 7.3379 |
| -14.4043 | 1.5671 | -15.3896 | 5.0744 | -10.2876 | 7.3739 |
| -14.4043 | 1.6671 | -15.3013 | 5.1214 | -10.1942 | 7.4098 |
| -14.4043 | 1.7671 | -15.2128 | 5.1680 | -10.1009 | 7.4456 |
| -14.4043 | 1.8671 | -15.1242 | 5.2144 | -10.0075 | 7.4813 |
| -14.4043 | 1.9671 | -15.0355 | 5.2605 | -9.9140 | 7.5169 |
| -14.4819 | 2.0041 | -14.9466 | 5.3064 | -9.8205 | 7.5524 |
| -14.5711 | 2.0493 | -14.8577 | 5.3520 | -9.7270 | 7.5878 |
| -14.6593 | 2.0965 | -14.7686 | 5.3975 | -9.6335 | 7.6232 |
| -14.7468 | 2.1449 | -14.6794 | 5.4427 | -9.5399 | 7.6584 |
| -14.8334 | 2.1949 | -14.5901 | 5.4877 | -9.4463 | 7.6936 |
| -14.9185 | 2.2473 | -14.5007 | 5.5326 | -9.3527 | 7.7287 |
| -15.0015 | 2.3031 | -14.4113 | 5.5772 | -9.2590 | 7.7638 |
| -15.0823 | 2.3620 | -14.3217 | 5.6217 | -9.1653 | 7.7988 |
| -15.1616 | 2.4230 | -14.2321 | 5.6660 | -9.0716 | 7.8337 |
| -15.2405 | 2.4844 | -14.1423 | 5.7102 | -8.9779 | 7.8685 |
| -15.3200 | 2.5451 | -14.0525 | 5.7541 | -8.8841 | 7.9033 |
| -15.4006 | 2.6043 | -13.9626 | 5.7979 | -8.7904 | 7.9380 |
| -15.4826 | 2.6614 | -13.8726 | 5.8415 | -8.6965 | 7.9727 |
| -15.5665 | 2.7158 | -13.7825 | 5.8848 | -8.6027 | 8.0072 |
| -15.6523 | 2.7672 | -13.6923 | 5.9280 | -8.5088 | 8.0417 |
| -15.7399 | 2.8154 | -13.6019 | 5.9709 | -8.4150 | 8.0762 |
| -15.8294 | 2.8600 | -13.5115 | 6.0136 | -8.3210 | 8.1105 |
| -15.9203 | 2.9016 | -13.4210 | 6.0561 | -8.2271 | 8.1447 |
| -16.0121 | 2.9413 | -13.3304 | 6.0984 | -8.1331 | 8.1789 |
| -16.1042 | 2.9804 | -13.2397 | 6.1404 | -8.0391 | 8.2130 |
| -16.1959 | 3.0201 | -13.1488 | 6.1823 | -7.9451 | 8.2470 |
| -16.2867 | 3.0621 | -13.0579 | 6.2239 | -7.8510 | 8.2809 |
| -16.3757 | 3.1076 | -12.9668 | 6.2652 | -7.7569 | 8.3148 |
| -16.4623 | 3.1577 | -12.8757 | 6.3063 | -7.6627 | 8.3485 |
| -16.5463 | 3.2119 | -12.7844 | 6.3472 | -7.5686 | 8.3822 |
| -16.6290 | 3.2681 | -12.6931 | 6.3879 | -7.4744 | 8.4157 |
| -16.7114 | 3.3248 | -12.6016 | 6.4284 | -7.3801 | 8.4492 |
| -16.7945 | 3.3804 | -12.5101 | 6.4686 | -7.2859 | 8.4825 |
| -16.8788 | 3.4342 | -12.4184 | 6.5085 | -7.1916 | 8.5158 |
| -16.9643 | 3.4860 | -12.3266 | 6.5483 | -7.0972 | 8.5490 |
| -17.0509 | 3.5360 | -12.2348 | 6.5878 | -7.0028 | 8.5820 |
| -17.0538 | 4.0443 | -12.1428 | 6.6271 | -6.9084 | 8.6150 |
| -17.0073 | 4.0822 | -12.0508 | 6.6662 | -6.8140 | 8.6479 |
| -16.9283 | 4.1435 | -11.9586 | 6.7051 | -6.7195 | 8.6806 |
| -16.8479 | 4.2030 | -11.8664 | 6.7437 | -6.6250 | 8.7133 |

FIG. 8a

| X | Y | X | Y | X | Y |
|---|---|---|---|---|---|
| -6.5304 | 8.7458 | 0.0000 | 8.7000 | 0.0000 | 3.0000 |
| -6.4358 | 8.7783 | 0.0000 | 8.6000 | 0.0000 | 2.9000 |
| -6.3412 | 8.8106 | 0.0000 | 8.5000 | 0.0000 | 2.8000 |
| -6.2465 | 8.8428 | 0.0000 | 8.4000 | 0.0000 | 2.7000 |
| -6.1518 | 8.8749 | 0.0000 | 8.3000 | 0.0000 | 2.6000 |
| -6.0571 | 8.9069 | 0.0000 | 8.2000 | 0.0000 | 2.5000 |
| -5.9623 | 8.9388 | 0.0000 | 8.1000 | 0.0000 | 2.4000 |
| -5.8675 | 8.9705 | 0.0000 | 8.0000 | 0.0000 | 2.3000 |
| -5.7726 | 9.0021 | 0.0000 | 7.9000 | 0.0000 | 2.2000 |
| -5.6777 | 9.0336 | 0.0000 | 7.8000 | 0.0000 | 2.1000 |
| -5.5828 | 9.0650 | 0.0000 | 7.7000 | 0.0000 | 2.0000 |
| -5.4878 | 9.0963 | 0.0000 | 7.6000 | 0.0000 | 1.9000 |
| -5.3927 | 9.1274 | 0.0000 | 7.5000 | 0.0000 | 1.8000 |
| -5.2976 | 9.1584 | 0.0000 | 7.4000 | 0.0000 | 1.7000 |
| -5.2025 | 9.1892 | 0.0000 | 7.3000 | 0.0000 | 1.6000 |
| -5.1074 | 9.2199 | 0.0000 | 7.2000 | 0.0000 | 1.5000 |
| -5.0121 | 9.2505 | 0.0000 | 7.1000 | 0.0000 | 1.4000 |
| -4.9169 | 9.2809 | 0.0000 | 7.0000 | 0.0000 | 1.3000 |
| -4.8216 | 9.3112 | 0.0000 | 6.9000 | 0.0000 | 1.2000 |
| -4.7262 | 9.3413 | 0.0000 | 6.8000 | 0.0000 | 1.1000 |
| -4.6308 | 9.3712 | 0.0000 | 6.7000 | 0.0000 | 1.0000 |
| -4.5353 | 9.4010 | 0.0000 | 6.6000 | 0.0000 | 0.9000 |
| -4.4398 | 9.4307 | 0.0000 | 6.5000 | 0.0000 | 0.8000 |
| -4.3443 | 9.4601 | 0.0000 | 6.4000 | 0.0000 | 0.7000 |
| -4.2487 | 9.4894 | 0.0000 | 6.3000 | 0.0000 | 0.6000 |
| -4.1530 | 9.5186 | 0.0000 | 6.2000 | 0.0000 | 0.5000 |
| -4.0573 | 9.5475 | 0.0000 | 6.1000 | 0.0000 | 0.4000 |
| -3.9615 | 9.5764 | 0.0000 | 6.0000 | 0.0000 | 0.3000 |
| -3.8657 | 9.6050 | 0.0000 | 5.9000 | 0.0000 | 0.2000 |
| -3.7699 | 9.6336 | 0.0000 | 5.8000 | 0.0000 | 0.1000 |
| -3.6740 | 9.6620 | 0.0000 | 5.7000 | 0.0000 | 0.0000 |
| -3.5781 | 9.6902 | 0.0000 | 5.6000 | | |
| -3.4821 | 9.7184 | 0.0000 | 5.5000 | | |
| -3.3861 | 9.7464 | 0.0000 | 5.4000 | | |
| -3.2901 | 9.7743 | 0.0000 | 5.3000 | | |
| -3.1940 | 9.8021 | 0.0000 | 5.2000 | | |
| -3.0980 | 9.8298 | 0.0000 | 5.1000 | | |
| -3.0018 | 9.8574 | 0.0000 | 5.0000 | | |
| -2.9057 | 9.8849 | 0.0000 | 4.9000 | | |
| -2.8095 | 9.9123 | 0.0000 | 4.8000 | | |
| -2.7133 | 9.9396 | 0.0000 | 4.7000 | | |
| -2.6171 | 9.9669 | 0.0000 | 4.6000 | | |
| -2.5209 | 9.9941 | 0.0000 | 4.5000 | | |
| -2.5000 | 10.0000 | 0.0000 | 4.4000 | | |
| 0.0000 | 10.0000 | 0.0000 | 4.3000 | | |
| 0.0000 | 9.9000 | 0.0000 | 4.2000 | | |
| 0.0000 | 9.8000 | 0.0000 | 4.1000 | | |
| 0.0000 | 9.7000 | 0.0000 | 4.0000 | | |
| 0.0000 | 9.6000 | 0.0000 | 3.9000 | | |
| 0.0000 | 9.5000 | 0.0000 | 3.8000 | | |
| 0.0000 | 9.4000 | 0.0000 | 3.7000 | | |
| 0.0000 | 9.3000 | 0.0000 | 3.6000 | | |
| 0.0000 | 9.2000 | 0.0000 | 3.5000 | | |
| 0.0000 | 9.1000 | 0.0000 | 3.4000 | | |
| 0.0000 | 9.0000 | 0.0000 | 3.3000 | | |
| 0.0000 | 8.9000 | 0.0000 | 3.2000 | | |
| 0.0000 | 8.8000 | 0.0000 | 3.1000 | | |

FIG. 8b

| X | Y | SLOPE |
|---|---|---|
| -14.4043 | 1.9671 | 155.2445 |
| -14.4819 | 2.0041 | 153.8273 |
| -14.5711 | 2.0493 | 152.4034 |
| -14.6593 | 2.0965 | 151.4255 |
| -14.7468 | 2.1449 | 150.6116 |
| -14.8334 | 2.1949 | 149.2838 |
| -14.9185 | 2.2473 | 147.3554 |
| -15.0015 | 2.3031 | 144.8738 |
| -15.0823 | 2.3620 | 142.9905 |
| -15.1616 | 2.4230 | 142.0976 |
| -15.2405 | 2.4844 | 142.2649 |
| -15.3200 | 2.5451 | 143.1095 |
| -15.4006 | 2.6043 | 144.3681 |
| -15.4826 | 2.6614 | 146.0408 |
| -15.5665 | 2.7158 | 148.0279 |
| -15.6523 | 2.7672 | 150.1232 |
| -15.7399 | 2.8154 | 152.3250 |
| -15.8294 | 2.8600 | 154.5602 |
| -15.9203 | 2.9016 | 156.1529 |
| -16.0121 | 2.9413 | 156.9432 |
| -16.1042 | 2.9804 | 156.9323 |
| -16.1959 | 3.0201 | 156.0330 |
| -16.2867 | 3.0621 | 154.1905 |
| -16.3757 | 3.1076 | 151.5325 |
| -16.4623 | 3.1577 | 148.3773 |
| -16.5463 | 3.2119 | 146.2738 |
| -16.6290 | 3.2681 | 145.4457 |
| -16.7114 | 3.3248 | 145.6847 |
| -16.7945 | 3.3804 | 146.8178 |
| -16.8788 | 3.4342 | 148.1611 |
| -16.9643 | 3.4860 | 149.3819 |
| -17.0509 | 3.5360 | 150.5204 |

FIG. 9

| X | Y | SLOPE | X | Y | SLOPE | X | Y | SLOPE |
|---|---|---|---|---|---|---|---|---|
| -17.0538 | 4.0443 | 39.7930 | -12.3266 | 6.5483 | 23.3547 | -7.3801 | 8.4492 | 19.5199 |
| -17.0073 | 4.0822 | 38.6606 | -12.2348 | 6.5878 | 23.2142 | -7.2859 | 8.4825 | 19.4611 |
| -16.9283 | 4.1435 | 37.1045 | -12.1428 | 6.6271 | 23.0746 | -7.1916 | 8.5158 | 19.4014 |
| -16.8479 | 4.2030 | 35.8498 | -12.0508 | 6.6662 | 22.9364 | -7.0972 | 8.5490 | 19.3409 |
| -16.7663 | 4.2608 | 34.8116 | -11.9586 | 6.7051 | 22.7993 | -7.0028 | 8.5820 | 19.2796 |
| -16.6837 | 4.3172 | 33.9357 | -11.8664 | 6.7437 | 22.6632 | -6.9084 | 8.6150 | 19.2174 |
| -16.6004 | 4.3725 | 33.1837 | -11.7741 | 6.7821 | 22.5291 | -6.8140 | 8.6479 | 19.1544 |
| -16.5164 | 4.4267 | 32.5296 | -11.6817 | 6.8204 | 22.4010 | -6.7195 | 8.6806 | 19.0906 |
| -16.4318 | 4.4801 | 31.9541 | -11.5892 | 6.8584 | 22.2791 | -6.6250 | 8.7133 | 19.0260 |
| -16.3467 | 4.5326 | 31.4430 | -11.4966 | 6.8962 | 22.1635 | -6.5304 | 8.7458 | 18.9606 |
| -16.2612 | 4.5844 | 30.9852 | -11.4040 | 6.9338 | 22.0538 | -6.4358 | 8.7783 | 18.8943 |
| -16.1753 | 4.6356 | 30.5722 | -11.3112 | 6.9713 | 21.9492 | -6.3412 | 8.8106 | 18.8270 |
| -16.0890 | 4.6862 | 30.1973 | -11.2185 | 7.0086 | 21.8495 | -6.2465 | 8.8428 | 18.7588 |
| -16.0024 | 4.7362 | 29.8550 | -11.1256 | 7.0457 | 21.7544 | -6.1518 | 8.8749 | 18.6894 |
| -15.9156 | 4.7857 | 29.5410 | -11.0327 | 7.0827 | 21.6635 | -6.0571 | 8.9069 | 18.6190 |
| -15.8284 | 4.8348 | 29.2516 | -10.9397 | 7.1195 | 21.5767 | -5.9623 | 8.9388 | 18.5474 |
| -15.7411 | 4.8835 | 28.9838 | -10.8467 | 7.1563 | 21.4936 | -5.8675 | 8.9705 | 18.4746 |
| -15.6535 | 4.9317 | 28.7352 | -10.7536 | 7.1928 | 21.4140 | -5.7726 | 9.0021 | 18.4005 |
| -15.5657 | 4.9796 | 28.5037 | -10.6605 | 7.2293 | 21.3378 | -5.6777 | 9.0336 | 18.3250 |
| -15.4777 | 5.0272 | 28.2873 | -10.5674 | 7.2656 | 21.2647 | -5.5828 | 9.0650 | 18.2481 |
| -15.3896 | 5.0744 | 28.0846 | -10.4741 | 7.3018 | 21.1946 | -5.4878 | 9.0963 | 18.1697 |
| -15.3013 | 5.1214 | 27.8941 | -10.3809 | 7.3379 | 21.1273 | -5.3927 | 9.1274 | 18.0898 |
| -15.2128 | 5.1680 | 27.7149 | -10.2876 | 7.3739 | 21.0626 | -5.2976 | 9.1584 | 18.0081 |
| -15.1242 | 5.2144 | 27.5457 | -10.1942 | 7.4098 | 21.0005 | -5.2025 | 9.1892 | 17.9248 |
| -15.0355 | 5.2605 | 27.3859 | -10.1009 | 7.4456 | 20.9408 | -5.1074 | 9.2199 | 17.8396 |
| -14.9466 | 5.3064 | 27.2345 | -10.0075 | 7.4813 | 20.8835 | -5.0121 | 9.2505 | 17.7524 |
| -14.8577 | 5.3520 | 27.0909 | -9.9140 | 7.5169 | 20.8283 | -4.9169 | 9.2809 | 17.6632 |
| -14.7686 | 5.3975 | 26.9545 | -9.8205 | 7.5524 | 20.7752 | -4.8216 | 9.3112 | 17.5720 |
| -14.6794 | 5.4427 | 26.8246 | -9.7270 | 7.5878 | 20.7242 | -4.7262 | 9.3413 | 17.4786 |
| -14.5901 | 5.4877 | 26.7010 | -9.6335 | 7.6232 | 20.6751 | -4.6308 | 9.3712 | 17.3824 |
| -14.5007 | 5.5326 | 26.5827 | -9.5399 | 7.6584 | 20.6279 | -4.5353 | 9.4010 | 17.2835 |
| -14.4113 | 5.5772 | 26.4705 | -9.4463 | 7.6936 | 20.5824 | -4.4398 | 9.4307 | 17.1838 |
| -14.3217 | 5.6217 | 26.3618 | -9.3527 | 7.7287 | 20.5387 | -4.3443 | 9.4601 | 17.0841 |
| -14.2321 | 5.6660 | 26.2522 | -9.2590 | 7.7638 | 20.4970 | -4.2487 | 9.4894 | 16.9867 |
| -14.1423 | 5.7102 | 26.1368 | -9.1653 | 7.7988 | 20.4564 | -4.1530 | 9.5186 | 16.8920 |
| -14.0525 | 5.7541 | 26.0162 | -9.0716 | 7.8337 | 20.4161 | -4.0573 | 9.5475 | 16.8000 |
| -13.9626 | 5.7979 | 25.8914 | -8.9779 | 7.8685 | 20.3754 | -3.9615 | 9.5764 | 16.7106 |
| -13.8726 | 5.8415 | 25.7627 | -8.8841 | 7.9033 | 20.3332 | -3.8657 | 9.6050 | 16.6239 |
| -13.7825 | 5.8848 | 25.6307 | -8.7904 | 7.9380 | 20.2899 | -3.7699 | 9.6336 | 16.5402 |
| -13.6923 | 5.9280 | 25.4958 | -8.6965 | 7.9727 | 20.2455 | -3.6740 | 9.6620 | 16.4595 |
| -13.6019 | 5.9709 | 25.3585 | -8.6027 | 8.0072 | 20.2002 | -3.5781 | 9.6902 | 16.3820 |
| -13.5115 | 6.0136 | 25.2192 | -8.5088 | 8.0417 | 20.1538 | -3.4821 | 9.7184 | 16.3078 |
| -13.4210 | 6.0561 | 25.0783 | -8.4150 | 8.0762 | 20.1063 | -3.3861 | 9.7464 | 16.2369 |
| -13.3304 | 6.0984 | 24.9359 | -8.3210 | 8.1105 | 20.0578 | -3.2901 | 9.7743 | 16.1695 |
| -13.2397 | 6.1404 | 24.7926 | -8.2271 | 8.1447 | 20.0084 | -3.1940 | 9.8021 | 16.1056 |
| -13.1488 | 6.1823 | 24.6486 | -8.1331 | 8.1789 | 19.9579 | -3.0980 | 9.8298 | 16.0453 |
| -13.0579 | 6.2239 | 24.5040 | -8.0391 | 8.2130 | 19.9064 | -3.0018 | 9.8574 | 15.9888 |
| -12.9668 | 6.2652 | 24.3593 | -7.9451 | 8.2470 | 19.8540 | -2.9057 | 9.8849 | 15.9361 |
| -12.8757 | 6.3063 | 24.2145 | -7.8510 | 8.2809 | 19.8006 | -2.8095 | 9.9123 | 15.8872 |
| -12.7844 | 6.3472 | 24.0698 | -7.7569 | 8.3148 | 19.7463 | -2.7133 | 9.9396 | 15.8422 |
| -12.6931 | 6.3879 | 23.9256 | -7.6627 | 8.3485 | 19.6911 | -2.6171 | 9.9669 | 15.8012 |
| -12.6016 | 6.4284 | 23.7818 | -7.5686 | 8.3822 | 19.6349 | -2.5209 | 9.9941 | 15.7642 |
| -12.5101 | 6.4686 | 23.6386 | -7.4744 | 8.4157 | 19.5779 | -2.5000 | 10.0000 | 15.7567 |
| -12.4184 | 6.5085 | 23.4962 | | | | | | |

FIG. 10

| X | Y | X | Y | X | Y | X | Y |
|---|---|---|---|---|---|---|---|
| -15.585 | 0.000 | -18.039 | 3.365 | -14.407 | 6.005 | -10.392 | 8.031 |
| -15.585 | 0.100 | -17.966 | 3.433 | -14.321 | 6.055 | -10.301 | 8.072 |
| -15.585 | 0.200 | -17.893 | 3.501 | -14.234 | 6.105 | -10.209 | 8.113 |
| -15.585 | 0.300 | -17.819 | 3.569 | -14.148 | 6.155 | -10.118 | 8.153 |
| -15.585 | 0.400 | -17.745 | 3.636 | -14.061 | 6.205 | -10.026 | 8.194 |
| -15.585 | 0.500 | -17.670 | 3.702 | -13.974 | 6.254 | -9.935 | 8.234 |
| -15.585 | 0.600 | -17.595 | 3.768 | -13.886 | 6.303 | -9.843 | 8.274 |
| -15.585 | 0.700 | -17.519 | 3.833 | -13.799 | 6.351 | -9.751 | 8.314 |
| -15.585 | 0.800 | -17.443 | 3.898 | -13.711 | 6.400 | -9.660 | 8.354 |
| -15.585 | 0.900 | -17.367 | 3.963 | -13.624 | 6.448 | -9.568 | 8.393 |
| -15.585 | 1.000 | -17.290 | 4.027 | -13.536 | 6.496 | -9.476 | 8.433 |
| -15.585 | 1.100 | -17.213 | 4.090 | -13.448 | 6.543 | -9.384 | 8.472 |
| -15.585 | 1.200 | -17.135 | 4.153 | -13.360 | 6.590 | -9.292 | 8.512 |
| -15.585 | 1.215 | -17.057 | 4.216 | -13.272 | 6.637 | -9.200 | 8.551 |
| | | -16.978 | 4.278 | -13.183 | 6.684 | -9.108 | 8.590 |
| -15.607 | 1.226 | -16.900 | 4.339 | -13.095 | 6.731 | -9.016 | 8.629 |
| -15.696 | 1.271 | -16.821 | 4.400 | -13.006 | 6.777 | -8.924 | 8.668 |
| -15.785 | 1.316 | -16.741 | 4.461 | -12.917 | 6.823 | -8.832 | 8.706 |
| -15.874 | 1.363 | -16.661 | 4.521 | -12.829 | 6.869 | -8.739 | 8.745 |
| -15.959 | 1.414 | -16.581 | 4.581 | -12.740 | 6.915 | -8.647 | 8.783 |
| -16.040 | 1.474 | -16.501 | 4.641 | -12.650 | 6.960 | -8.555 | 8.822 |
| -16.114 | 1.541 | -16.420 | 4.700 | -12.561 | 7.005 | -8.462 | 8.860 |
| -16.188 | 1.608 | -16.339 | 4.758 | -12.472 | 7.050 | -8.370 | 8.898 |
| -16.267 | 1.670 | -16.258 | 4.817 | -12.382 | 7.095 | -8.277 | 8.936 |
| -16.349 | 1.726 | -16.176 | 4.874 | -12.293 | 7.140 | -8.185 | 8.973 |
| -16.433 | 1.780 | -16.094 | 4.932 | -12.203 | 7.184 | -8.092 | 9.011 |
| -16.517 | 1.835 | -16.012 | 4.989 | -12.114 | 7.228 | -7.999 | 9.048 |
| -16.601 | 1.889 | -15.930 | 5.045 | -12.024 | 7.272 | -7.906 | 9.086 |
| -16.687 | 1.941 | -15.847 | 5.102 | -11.934 | 7.316 | -7.814 | 9.123 |
| -16.775 | 1.988 | -15.764 | 5.158 | -11.844 | 7.359 | -7.721 | 9.160 |
| -16.864 | 2.033 | -15.681 | 5.213 | -11.753 | 7.402 | -7.628 | 9.197 |
| -16.955 | 2.075 | -15.597 | 5.268 | -11.663 | 7.445 | -7.535 | 9.233 |
| -17.045 | 2.118 | -15.514 | 5.323 | -11.573 | 7.488 | -7.441 | 9.270 |
| -17.135 | 2.162 | -15.430 | 5.377 | -11.483 | 7.531 | -7.348 | 9.306 |
| -17.225 | 2.206 | -15.346 | 5.432 | -11.392 | 7.574 | -7.255 | 9.342 |
| -17.315 | 2.249 | -15.262 | 5.485 | -11.301 | 7.616 | -7.162 | 9.378 |
| -17.407 | 2.288 | -15.177 | 5.539 | -11.211 | 7.658 | -7.068 | 9.414 |
| -17.500 | 2.325 | -15.092 | 5.592 | -11.120 | 7.700 | -6.975 | 9.450 |
| -17.593 | 2.362 | -15.007 | 5.645 | -11.029 | 7.742 | -6.882 | 9.485 |
| -17.685 | 2.401 | -14.922 | 5.697 | -10.938 | 7.784 | -6.788 | 9.521 |
| -17.775 | 2.445 | -14.837 | 5.749 | -10.848 | 7.826 | -6.694 | 9.556 |
| -17.864 | 2.491 | -14.751 | 5.801 | -10.757 | 7.867 | -6.601 | 9.591 |
| -17.952 | 2.539 | -14.666 | 5.852 | -10.665 | 7.908 | -6.507 | 9.626 |
| -18.039 | 2.587 | -14.580 | 5.904 | -10.574 | 7.950 | -6.413 | 9.660 |
| | | -14.494 | 5.954 | -10.483 | 7.991 | -6.319 | 9.695 |

FIG. 17a

| X | Y | X | Y | X | Y | X | Y |
|---|---|---|---|---|---|---|---|
| -6.226 | 9.730 | 0.000 | 10.600 | 0.000 | 6.100 | 0.000 | 1.600 |
| -6.132 | 9.764 | 0.000 | 10.500 | 0.000 | 6.000 | 0.000 | 1.500 |
| -6.038 | 9.798 | 0.000 | 10.400 | 0.000 | 5.900 | 0.000 | 1.400 |
| -5.944 | 9.832 | 0.000 | 10.300 | 0.000 | 5.800 | 0.000 | 1.300 |
| -5.850 | 9.866 | 0.000 | 10.200 | 0.000 | 5.700 | 0.000 | 1.200 |
| -5.756 | 9.900 | 0.000 | 10.100 | 0.000 | 5.600 | 0.000 | 1.100 |
| -5.661 | 9.934 | 0.000 | 10.000 | 0.000 | 5.500 | 0.000 | 1.000 |
| -5.567 | 9.968 | 0.000 | 9.900 | 0.000 | 5.400 | 0.000 | 0.900 |
| -5.473 | 10.001 | 0.000 | 9.800 | 0.000 | 5.300 | 0.000 | 0.800 |
| -5.379 | 10.035 | 0.000 | 9.700 | 0.000 | 5.200 | 0.000 | 0.700 |
| -5.285 | 10.068 | 0.000 | 9.600 | 0.000 | 5.100 | 0.000 | 0.600 |
| -5.190 | 10.101 | 0.000 | 9.500 | 0.000 | 5.000 | 0.000 | 0.500 |
| -5.096 | 10.134 | 0.000 | 9.400 | 0.000 | 4.900 | 0.000 | 0.400 |
| -5.002 | 10.168 | 0.000 | 9.300 | 0.000 | 4.800 | 0.000 | 0.300 |
| -4.907 | 10.201 | 0.000 | 9.200 | 0.000 | 4.700 | 0.000 | 0.200 |
| -4.813 | 10.234 | 0.000 | 9.100 | 0.000 | 4.600 | 0.000 | 0.100 |
| -4.718 | 10.266 | 0.000 | 9.000 | 0.000 | 4.500 | 0.000 | 0.000 |
| -4.624 | 10.299 | 0.000 | 8.900 | 0.000 | 4.400 | | |
| -4.529 | 10.332 | 0.000 | 8.800 | 0.000 | 4.300 | | |
| -4.435 | 10.364 | 0.000 | 8.700 | 0.000 | 4.200 | | |
| -4.340 | 10.397 | 0.000 | 8.600 | 0.000 | 4.100 | | |
| -4.245 | 10.429 | 0.000 | 8.500 | 0.000 | 4.000 | | |
| -4.151 | 10.461 | 0.000 | 8.400 | 0.000 | 3.900 | | |
| -4.056 | 10.493 | 0.000 | 8.300 | 0.000 | 3.800 | | |
| -3.961 | 10.525 | 0.000 | 8.200 | 0.000 | 3.700 | | |
| -3.866 | 10.557 | 0.000 | 8.100 | 0.000 | 3.600 | | |
| -3.772 | 10.589 | 0.000 | 8.000 | 0.000 | 3.500 | | |
| -3.677 | 10.620 | 0.000 | 7.900 | 0.000 | 3.400 | | |
| -3.582 | 10.651 | 0.000 | 7.800 | 0.000 | 3.300 | | |
| -3.487 | 10.683 | 0.000 | 7.700 | 0.000 | 3.200 | | |
| -3.392 | 10.714 | 0.000 | 7.600 | 0.000 | 3.100 | | |
| -3.297 | 10.745 | 0.000 | 7.500 | 0.000 | 3.000 | | |
| -3.202 | 10.776 | 0.000 | 7.400 | 0.000 | 2.900 | | |
| -3.106 | 10.807 | 0.000 | 7.300 | 0.000 | 2.800 | | |
| -3.011 | 10.837 | 0.000 | 7.200 | 0.000 | 2.700 | | |
| -2.916 | 10.868 | 0.000 | 7.100 | 0.000 | 2.600 | | |
| -2.821 | 10.898 | 0.000 | 7.000 | 0.000 | 2.500 | | |
| -2.726 | 10.929 | 0.000 | 6.900 | 0.000 | 2.400 | | |
| -2.630 | 10.959 | 0.000 | 6.800 | 0.000 | 2.300 | | |
| -2.535 | 10.989 | 0.000 | 6.700 | 0.000 | 2.200 | | |
| -2.500 | 11.000 | 0.000 | 6.600 | 0.000 | 2.100 | | |
| 0.000 | 11.000 | 0.000 | 6.500 | 0.000 | 2.000 | | |
| 0.000 | 10.900 | 0.000 | 6.400 | 0.000 | 1.900 | | |
| 0.000 | 10.800 | 0.000 | 6.300 | 0.000 | 1.800 | | |
| 0.000 | 10.700 | 0.000 | 6.200 | 0.000 | 1.700 | | |

FIG. 17b

| X | Y |
|---|---|
| -15.585 | 1.215 |
| -15.607 | 1.226 |
| -15.696 | 1.271 |
| -15.785 | 1.316 |
| -15.874 | 1.363 |
| -15.959 | 1.414 |
| -16.040 | 1.474 |
| -16.114 | 1.541 |
| -16.188 | 1.608 |
| -16.267 | 1.670 |
| -16.349 | 1.726 |
| -16.433 | 1.780 |
| -16.517 | 1.835 |
| -16.601 | 1.889 |
| -16.687 | 1.941 |
| -16.775 | 1.988 |
| -16.864 | 2.033 |
| -16.955 | 2.075 |
| -17.045 | 2.118 |
| -17.135 | 2.162 |
| -17.225 | 2.206 |
| -17.315 | 2.249 |
| -17.407 | 2.288 |
| -17.500 | 2.325 |
| -17.593 | 2.362 |
| -17.685 | 2.401 |
| -17.775 | 2.445 |
| -17.864 | 2.491 |
| -17.952 | 2.539 |
| -18.039 | 2.587 |

FIG. 18

| X | Y | X | Y | X | Y | X | Y |
|---|---|---|---|---|---|---|---|
| -18.039 | 3.365 | -14.407 | 6.005 | -10.392 | 8.031 | -6.226 | 9.730 |
| -17.966 | 3.433 | -14.321 | 6.055 | -10.301 | 8.072 | -6.132 | 9.764 |
| -17.893 | 3.501 | -14.234 | 6.105 | -10.209 | 8.113 | -6.038 | 9.798 |
| -17.819 | 3.569 | -14.148 | 6.155 | -10.118 | 8.153 | -5.944 | 9.832 |
| -17.745 | 3.636 | -14.061 | 6.205 | -10.026 | 8.194 | -5.850 | 9.866 |
| -17.670 | 3.702 | -13.974 | 6.254 | -9.935 | 8.234 | -5.756 | 9.900 |
| -17.595 | 3.768 | -13.886 | 6.303 | -9.843 | 8.274 | -5.661 | 9.934 |
| -17.519 | 3.833 | -13.799 | 6.351 | -9.751 | 8.314 | -5.567 | 9.968 |
| -17.443 | 3.898 | -13.711 | 6.400 | -9.660 | 8.354 | -5.473 | 10.001 |
| -17.367 | 3.963 | -13.624 | 6.448 | -9.568 | 8.393 | -5.379 | 10.035 |
| -17.290 | 4.027 | -13.536 | 6.496 | -9.476 | 8.433 | -5.285 | 10.068 |
| -17.213 | 4.090 | -13.448 | 6.543 | -9.384 | 8.472 | -5.190 | 10.101 |
| -17.135 | 4.153 | -13.360 | 6.590 | -9.292 | 8.512 | -5.096 | 10.134 |
| -17.057 | 4.216 | -13.272 | 6.637 | -9.200 | 8.551 | -5.002 | 10.168 |
| -16.978 | 4.278 | -13.183 | 6.684 | -9.108 | 8.590 | -4.907 | 10.201 |
| -16.900 | 4.339 | -13.095 | 6.731 | -9.016 | 8.629 | -4.813 | 10.234 |
| -16.821 | 4.400 | -13.006 | 6.777 | -8.924 | 8.668 | -4.718 | 10.266 |
| -16.741 | 4.461 | -12.917 | 6.823 | -8.832 | 8.706 | -4.624 | 10.299 |
| -16.661 | 4.521 | -12.829 | 6.869 | -8.739 | 8.745 | -4.529 | 10.332 |
| -16.581 | 4.581 | -12.740 | 6.915 | -8.647 | 8.783 | -4.435 | 10.364 |
| -16.501 | 4.641 | -12.650 | 6.960 | -8.555 | 8.822 | -4.340 | 10.397 |
| -16.420 | 4.700 | -12.561 | 7.005 | -8.462 | 8.860 | -4.245 | 10.429 |
| -16.339 | 4.758 | -12.472 | 7.050 | -8.370 | 8.898 | -4.151 | 10.461 |
| -16.258 | 4.817 | -12.382 | 7.095 | -8.277 | 8.936 | -4.056 | 10.493 |
| -16.176 | 4.874 | -12.293 | 7.140 | -8.185 | 8.973 | -3.961 | 10.525 |
| -16.094 | 4.932 | -12.203 | 7.184 | -8.092 | 9.011 | -3.866 | 10.557 |
| -16.012 | 4.989 | -12.114 | 7.228 | -7.999 | 9.048 | -3.772 | 10.589 |
| -15.930 | 5.045 | -12.024 | 7.272 | -7.906 | 9.086 | -3.677 | 10.620 |
| -15.847 | 5.102 | -11.934 | 7.316 | -7.814 | 9.123 | -3.582 | 10.651 |
| -15.764 | 5.158 | -11.844 | 7.359 | -7.721 | 9.160 | -3.487 | 10.683 |
| -15.681 | 5.213 | -11.753 | 7.402 | -7.628 | 9.197 | -3.392 | 10.714 |
| -15.597 | 5.268 | -11.663 | 7.445 | -7.535 | 9.233 | -3.297 | 10.745 |
| -15.514 | 5.323 | -11.573 | 7.488 | -7.441 | 9.270 | -3.202 | 10.776 |
| -15.430 | 5.377 | -11.483 | 7.531 | -7.348 | 9.306 | -3.106 | 10.807 |
| -15.346 | 5.432 | -11.392 | 7.574 | -7.255 | 9.342 | -3.011 | 10.837 |
| -15.262 | 5.485 | -11.301 | 7.616 | -7.162 | 9.378 | -2.916 | 10.868 |
| -15.177 | 5.539 | -11.211 | 7.658 | -7.068 | 9.414 | -2.821 | 10.898 |
| -15.092 | 5.592 | -11.120 | 7.700 | -6.975 | 9.450 | -2.726 | 10.929 |
| -15.007 | 5.645 | -11.029 | 7.742 | -6.882 | 9.485 | -2.630 | 10.959 |
| -14.922 | 5.697 | -10.938 | 7.784 | -6.788 | 9.521 | -2.535 | 10.989 |
| -14.837 | 5.749 | -10.848 | 7.826 | -6.694 | 9.556 | -2.500 | 11.000 |
| -14.751 | 5.801 | -10.757 | 7.867 | -6.601 | 9.591 | | |
| -14.666 | 5.852 | -10.665 | 7.908 | -6.507 | 9.626 | | |
| -14.580 | 5.904 | -10.574 | 7.950 | -6.413 | 9.660 | | |
| -14.494 | 5.954 | -10.483 | 7.991 | -6.319 | 9.695 | | |

FIG. 19

| X | Y |
|---|---|
| -25.808 | 0.000 |
| -25.808 | 0.100 |
| -25.808 | 0.200 |
| -25.808 | 0.300 |
| -25.808 | 0.400 |
| -25.808 | 0.500 |
| -25.808 | 0.600 |
| -25.808 | 0.700 |
| -25.808 | 0.800 |
| -25.808 | 0.900 |
| -25.808 | 1.000 |
| -25.808 | 1.100 |
| -25.808 | 1.200 |
| -25.808 | 1.300 |
| -25.808 | 1.400 |
| -25.808 | 1.500 |
| -25.808 | 1.600 |
| -25.808 | 1.663 |
| -25.810 | 1.665 |
| -25.886 | 1.729 |
| -25.964 | 1.793 |
| -26.040 | 1.858 |
| -26.113 | 1.926 |
| -26.182 | 1.998 |
| -26.248 | 2.073 |
| -26.314 | 2.148 |
| -26.383 | 2.220 |
| -26.457 | 2.288 |
| -26.535 | 2.351 |
| -26.617 | 2.408 |
| -26.703 | 2.459 |
| -26.792 | 2.503 |
| -26.885 | 2.542 |
| -26.978 | 2.577 |
| -27.072 | 2.610 |
| -27.167 | 2.643 |
| -27.261 | 2.677 |
| -27.356 | 2.709 |
| -27.452 | 2.738 |
| -27.549 | 2.761 |
| -27.647 | 2.778 |
| -27.747 | 2.789 |
| -27.846 | 2.796 |
| -27.946 | 2.802 |

| X | Y |
|---|---|
| -28.046 | 2.809 |
| -28.146 | 2.818 |
| -28.245 | 2.829 |
| -28.344 | 2.840 |
| -28.444 | 2.851 |
| -28.543 | 2.861 |
| -28.601 | 2.866 |
| -28.601 | 4.683 |
| -28.556 | 4.731 |
| -28.487 | 4.804 |
| -28.417 | 4.875 |
| -28.347 | 4.947 |
| -28.276 | 5.017 |
| -28.205 | 5.088 |
| -28.133 | 5.157 |
| -28.061 | 5.226 |
| -27.988 | 5.295 |
| -27.915 | 5.363 |
| -27.841 | 5.430 |
| -27.767 | 5.497 |
| -27.692 | 5.564 |
| -27.617 | 5.630 |
| -27.541 | 5.695 |
| -27.465 | 5.760 |
| -27.389 | 5.825 |
| -27.312 | 5.889 |
| -27.235 | 5.953 |
| -27.158 | 6.016 |
| -27.080 | 6.079 |
| -27.002 | 6.141 |
| -26.923 | 6.203 |
| -26.845 | 6.265 |
| -26.765 | 6.326 |
| -26.686 | 6.387 |
| -26.606 | 6.447 |
| -26.526 | 6.507 |
| -26.446 | 6.567 |
| -26.366 | 6.626 |
| -26.285 | 6.685 |
| -26.204 | 6.744 |
| -26.123 | 6.802 |
| -26.041 | 6.860 |
| -25.960 | 6.918 |
| -25.878 | 6.975 |

| X | Y |
|---|---|
| -25.795 | 7.032 |
| -25.713 | 7.089 |
| -25.630 | 7.145 |
| -25.548 | 7.201 |
| -25.465 | 7.257 |
| -25.381 | 7.312 |
| -25.298 | 7.368 |
| -25.214 | 7.422 |
| -25.131 | 7.477 |
| -25.047 | 7.531 |
| -24.962 | 7.585 |
| -24.878 | 7.639 |
| -24.794 | 7.693 |
| -24.709 | 7.746 |
| -24.624 | 7.799 |
| -24.539 | 7.852 |
| -24.454 | 7.904 |
| -24.369 | 7.956 |
| -24.283 | 8.008 |
| -24.198 | 8.060 |
| -24.112 | 8.111 |
| -24.026 | 8.163 |
| -23.940 | 8.214 |
| -23.854 | 8.264 |
| -23.768 | 8.315 |
| -23.681 | 8.365 |
| -23.595 | 8.415 |
| -23.508 | 8.465 |
| -23.421 | 8.515 |
| -23.334 | 8.565 |
| -23.247 | 8.614 |
| -23.160 | 8.663 |
| -23.073 | 8.712 |
| -22.986 | 8.760 |
| -22.898 | 8.809 |
| -22.811 | 8.857 |
| -22.723 | 8.905 |
| -22.635 | 8.953 |
| -22.547 | 9.001 |
| -22.459 | 9.048 |
| -22.371 | 9.095 |
| -22.283 | 9.142 |
| -22.194 | 9.189 |
| -22.106 | 9.236 |

FIG. 27a

| X | Y |
|---|---|
| -22.018 | 9.283 |
| -21.929 | 9.329 |
| -21.840 | 9.375 |
| -21.751 | 9.421 |
| -21.663 | 9.467 |
| -21.574 | 9.513 |
| -21.485 | 9.558 |
| -21.395 | 9.603 |
| -21.306 | 9.649 |
| -21.217 | 9.694 |
| -21.128 | 9.739 |
| -21.038 | 9.783 |
| -20.949 | 9.828 |
| -20.859 | 9.872 |
| -20.769 | 9.916 |
| -20.680 | 9.960 |
| -20.590 | 10.004 |
| -20.500 | 10.048 |
| -20.410 | 10.092 |
| -20.320 | 10.135 |
| -20.230 | 10.179 |
| -20.139 | 10.222 |
| -20.049 | 10.265 |
| -19.959 | 10.308 |
| -19.868 | 10.350 |
| -19.778 | 10.393 |
| -19.687 | 10.435 |
| -19.597 | 10.478 |
| -19.506 | 10.520 |
| -19.415 | 10.562 |
| -19.325 | 10.604 |
| -19.234 | 10.646 |
| -19.143 | 10.687 |
| -19.052 | 10.729 |
| -18.961 | 10.770 |
| -18.870 | 10.812 |
| -18.779 | 10.853 |
| -18.687 | 10.894 |
| -18.596 | 10.935 |
| -18.505 | 10.975 |
| -18.413 | 11.016 |
| -18.322 | 11.057 |
| -18.231 | 11.097 |
| -18.139 | 11.137 |

| X | Y |
|---|---|
| -18.047 | 11.177 |
| -17.956 | 11.217 |
| -17.864 | 11.257 |
| -17.772 | 11.297 |
| -17.681 | 11.337 |
| -17.589 | 11.376 |
| -17.497 | 11.416 |
| -17.405 | 11.455 |
| -17.313 | 11.494 |
| -17.221 | 11.534 |
| -17.129 | 11.573 |
| -17.037 | 11.611 |
| -16.945 | 11.650 |
| -16.852 | 11.689 |
| -16.760 | 11.727 |
| -16.668 | 11.766 |
| -16.575 | 11.804 |
| -16.483 | 11.843 |
| -16.391 | 11.881 |
| -16.298 | 11.919 |
| -16.206 | 11.957 |
| -16.113 | 11.995 |
| -16.020 | 12.032 |
| -15.928 | 12.070 |
| -15.835 | 12.107 |
| -15.742 | 12.145 |
| -15.650 | 12.182 |
| -15.557 | 12.219 |
| -15.464 | 12.257 |
| -15.371 | 12.294 |
| -15.278 | 12.331 |
| -15.185 | 12.367 |
| -15.092 | 12.404 |
| -14.999 | 12.441 |
| -14.906 | 12.477 |
| -14.813 | 12.514 |
| -14.720 | 12.550 |
| -14.627 | 12.587 |
| -14.533 | 12.623 |
| -14.440 | 12.659 |
| -14.347 | 12.695 |
| -14.254 | 12.731 |
| -14.160 | 12.767 |
| -14.067 | 12.802 |

| X | Y |
|---|---|
| -13.973 | 12.838 |
| -13.880 | 12.874 |
| -13.786 | 12.909 |
| -13.693 | 12.945 |
| -13.599 | 12.980 |
| -13.506 | 13.015 |
| -13.412 | 13.050 |
| -13.318 | 13.085 |
| -13.225 | 13.120 |
| -13.131 | 13.155 |
| -13.037 | 13.190 |
| -12.944 | 13.225 |
| -12.850 | 13.259 |
| -12.756 | 13.294 |
| -12.662 | 13.328 |
| -12.568 | 13.363 |
| -12.474 | 13.397 |
| -12.380 | 13.431 |
| -12.286 | 13.465 |
| -12.192 | 13.499 |
| -12.098 | 13.533 |
| -12.004 | 13.567 |
| -11.910 | 13.601 |
| -11.816 | 13.634 |
| -11.721 | 13.668 |
| -11.627 | 13.701 |
| -11.533 | 13.735 |
| -11.439 | 13.768 |
| -11.344 | 13.801 |
| -11.250 | 13.835 |
| -11.156 | 13.868 |
| -11.061 | 13.901 |
| -10.967 | 13.934 |
| -10.872 | 13.966 |
| -10.778 | 13.999 |
| -10.683 | 14.032 |
| -10.589 | 14.064 |
| -10.494 | 14.097 |
| -10.400 | 14.129 |
| -10.305 | 14.161 |
| -10.210 | 14.194 |
| -10.116 | 14.226 |
| -10.021 | 14.258 |
| -9.926 | 14.290 |

FIG. 27b

| X | Y |
|---|---|
| -9.831 | 14.322 |
| -9.736 | 14.353 |
| -9.642 | 14.385 |
| -9.547 | 14.417 |
| -9.452 | 14.448 |
| -9.357 | 14.480 |
| -9.262 | 14.511 |
| -9.167 | 14.542 |
| -9.072 | 14.574 |
| -8.977 | 14.605 |
| -8.882 | 14.636 |
| -8.787 | 14.667 |
| -8.692 | 14.698 |
| -8.597 | 14.729 |
| -8.502 | 14.759 |
| -8.406 | 14.790 |
| -8.311 | 14.821 |
| -8.216 | 14.851 |
| -8.121 | 14.882 |
| -8.025 | 14.912 |
| -7.930 | 14.943 |
| -7.835 | 14.973 |
| -7.740 | 15.003 |
| -7.644 | 15.033 |
| -7.549 | 15.063 |
| -7.453 | 15.093 |
| -7.358 | 15.123 |
| -7.263 | 15.153 |
| -7.167 | 15.183 |
| -7.072 | 15.213 |
| -6.976 | 15.243 |
| -6.881 | 15.273 |
| -6.785 | 15.303 |
| -6.690 | 15.332 |
| -6.594 | 15.362 |
| -6.499 | 15.392 |
| -6.404 | 15.421 |
| -6.308 | 15.451 |
| -6.212 | 15.481 |
| -6.117 | 15.510 |
| -6.021 | 15.540 |
| -5.926 | 15.569 |
| -5.830 | 15.599 |
| -5.735 | 15.629 |

| X | Y |
|---|---|
| -5.639 | 15.658 |
| -5.544 | 15.688 |
| -5.448 | 15.717 |
| -5.353 | 15.747 |
| -5.257 | 15.776 |
| -5.162 | 15.806 |
| -5.066 | 15.835 |
| -4.971 | 15.865 |
| -4.875 | 15.894 |
| -4.779 | 15.924 |
| -4.684 | 15.953 |
| -4.588 | 15.983 |
| -4.493 | 16.012 |
| -4.397 | 16.041 |
| -4.301 | 16.070 |
| -4.206 | 16.099 |
| -4.110 | 16.128 |
| -4.014 | 16.156 |
| -3.918 | 16.183 |
| -3.821 | 16.210 |
| -3.725 | 16.237 |
| -3.628 | 16.263 |
| -3.532 | 16.288 |
| -3.435 | 16.313 |
| -3.338 | 16.337 |
| -3.240 | 16.360 |
| -3.143 | 16.382 |
| -3.045 | 16.403 |
| -2.947 | 16.424 |
| -2.849 | 16.443 |
| -2.751 | 16.461 |
| -2.652 | 16.479 |
| -2.554 | 16.495 |
| -2.518 | 16.500 |
| 0.000 | 16.500 |
| 0.000 | 16.400 |
| 0.000 | 16.300 |
| 0.000 | 16.200 |
| 0.000 | 16.100 |
| 0.000 | 16.000 |
| 0.000 | 15.900 |
| 0.000 | 15.800 |
| 0.000 | 15.700 |
| 0.000 | 15.600 |

| X | Y |
|---|---|
| 0.000 | 15.500 |
| 0.000 | 15.400 |
| 0.000 | 15.300 |
| 0.000 | 15.200 |
| 0.000 | 15.100 |
| 0.000 | 15.000 |
| 0.000 | 14.900 |
| 0.000 | 14.800 |
| 0.000 | 14.700 |
| 0.000 | 14.600 |
| 0.000 | 14.500 |
| 0.000 | 14.400 |
| 0.000 | 14.300 |
| 0.000 | 14.200 |
| 0.000 | 14.100 |
| 0.000 | 14.000 |
| 0.000 | 13.900 |
| 0.000 | 13.800 |
| 0.000 | 13.700 |
| 0.000 | 13.600 |
| 0.000 | 13.500 |
| 0.000 | 13.400 |
| 0.000 | 13.300 |
| 0.000 | 13.200 |
| 0.000 | 13.100 |
| 0.000 | 13.000 |
| 0.000 | 12.900 |
| 0.000 | 12.800 |
| 0.000 | 12.700 |
| 0.000 | 12.600 |
| 0.000 | 12.500 |
| 0.000 | 12.400 |
| 0.000 | 12.300 |
| 0.000 | 12.200 |
| 0.000 | 12.100 |
| 0.000 | 12.000 |
| 0.000 | 11.900 |
| 0.000 | 11.800 |
| 0.000 | 11.700 |
| 0.000 | 11.600 |
| 0.000 | 11.500 |
| 0.000 | 11.400 |
| 0.000 | 11.300 |
| 0.000 | 11.200 |

FIG. 27c

| X | Y |
|---|---|
| 0.000 | 11.100 |
| 0.000 | 11.000 |
| 0.000 | 10.900 |
| 0.000 | 10.800 |
| 0.000 | 10.700 |
| 0.000 | 10.600 |
| 0.000 | 10.500 |
| 0.000 | 10.400 |
| 0.000 | 10.300 |
| 0.000 | 10.200 |
| 0.000 | 10.100 |
| 0.000 | 10.000 |
| 0.000 | 9.900 |
| 0.000 | 9.800 |
| 0.000 | 9.700 |
| 0.000 | 9.600 |
| 0.000 | 9.500 |
| 0.000 | 9.400 |
| 0.000 | 9.300 |
| 0.000 | 9.200 |
| 0.000 | 9.100 |
| 0.000 | 9.000 |
| 0.000 | 8.900 |
| 0.000 | 8.800 |
| 0.000 | 8.700 |
| 0.000 | 8.600 |
| 0.000 | 8.500 |
| 0.000 | 8.400 |
| 0.000 | 8.300 |
| 0.000 | 8.200 |
| 0.000 | 8.100 |
| 0.000 | 8.000 |
| 0.000 | 7.900 |
| 0.000 | 7.800 |
| 0.000 | 7.700 |
| 0.000 | 7.600 |
| 0.000 | 7.500 |
| 0.000 | 7.400 |
| 0.000 | 7.300 |
| 0.000 | 7.200 |
| 0.000 | 7.100 |
| 0.000 | 7.000 |
| 0.000 | 6.900 |
| 0.000 | 6.800 |

| X | Y |
|---|---|
| 0.000 | 6.700 |
| 0.000 | 6.600 |
| 0.000 | 6.500 |
| 0.000 | 6.400 |
| 0.000 | 6.300 |
| 0.000 | 6.200 |
| 0.000 | 6.100 |
| 0.000 | 6.000 |
| 0.000 | 5.900 |
| 0.000 | 5.800 |
| 0.000 | 5.700 |
| 0.000 | 5.600 |
| 0.000 | 5.500 |
| 0.000 | 5.400 |
| 0.000 | 5.300 |
| 0.000 | 5.200 |
| 0.000 | 5.100 |
| 0.000 | 5.000 |
| 0.000 | 4.900 |
| 0.000 | 4.800 |
| 0.000 | 4.700 |
| 0.000 | 4.600 |
| 0.000 | 4.500 |
| 0.000 | 4.400 |
| 0.000 | 4.300 |
| 0.000 | 4.200 |
| 0.000 | 4.100 |
| 0.000 | 4.000 |
| 0.000 | 3.900 |
| 0.000 | 3.800 |
| 0.000 | 3.700 |
| 0.000 | 3.600 |
| 0.000 | 3.500 |
| 0.000 | 3.400 |
| 0.000 | 3.300 |
| 0.000 | 3.200 |
| 0.000 | 3.100 |
| 0.000 | 3.000 |
| 0.000 | 2.900 |
| 0.000 | 2.800 |
| 0.000 | 2.700 |
| 0.000 | 2.600 |
| 0.000 | 2.500 |
| 0.000 | 2.400 |

| X | Y |
|---|---|
| 0.000 | 2.300 |
| 0.000 | 2.200 |
| 0.000 | 2.100 |
| 0.000 | 2.000 |
| 0.000 | 1.900 |
| 0.000 | 1.800 |
| 0.000 | 1.700 |
| 0.000 | 1.600 |
| 0.000 | 1.500 |
| 0.000 | 1.400 |
| 0.000 | 1.300 |
| 0.000 | 1.200 |
| 0.000 | 1.100 |
| 0.000 | 1.000 |
| 0.000 | 0.900 |
| 0.000 | 0.800 |
| 0.000 | 0.700 |
| 0.000 | 0.600 |
| 0.000 | 0.500 |
| 0.000 | 0.400 |
| 0.000 | 0.300 |
| 0.000 | 0.200 |
| 0.000 | 0.100 |
| 0.000 | 0.000 |

FIG. 27d

| x | y |
|---|---|
| 0.000 | 0.000 |
| 0.000 | 0.100 |
| 0.000 | 0.200 |
| 0.000 | 0.300 |
| 0.000 | 0.400 |
| 0.000 | 0.500 |
| 0.000 | 0.600 |
| 0.000 | 0.700 |
| 0.000 | 0.800 |
| 0.000 | 0.900 |
| 0.000 | 1.000 |
| 0.000 | 1.100 |
| 0.000 | 1.200 |
| 0.000 | 1.300 |
| 0.000 | 1.400 |
| 0.000 | 1.500 |
| 0.000 | 1.600 |
| 0.000 | 1.663 |
| -0.002 | 1.665 |
| -0.078 | 1.729 |
| -0.156 | 1.793 |
| -0.232 | 1.858 |
| -0.305 | 1.926 |
| -0.374 | 1.998 |
| -0.440 | 2.073 |
| -0.506 | 2.148 |
| -0.575 | 2.220 |
| -0.649 | 2.288 |
| -0.727 | 2.351 |
| -0.809 | 2.408 |
| -0.895 | 2.459 |
| -0.984 | 2.503 |
| -1.077 | 2.542 |
| -1.170 | 2.577 |
| -1.264 | 2.610 |
| -1.359 | 2.643 |
| -1.453 | 2.677 |
| -1.548 | 2.709 |
| -1.644 | 2.738 |
| -1.741 | 2.761 |
| -1.839 | 2.778 |
| -1.939 | 2.789 |
| -2.038 | 2.796 |
| -2.138 | 2.802 |

| x | y |
|---|---|
| -2.238 | 2.809 |
| -2.338 | 2.818 |
| -2.437 | 2.829 |
| -2.536 | 2.840 |
| -2.636 | 2.851 |
| -2.735 | 2.861 |
| -2.793 | 2.866 |
| -2.793 | 4.683 |
| -2.748 | 4.731 |
| -2.679 | 4.804 |
| -2.609 | 4.875 |
| -2.539 | 4.947 |
| -2.468 | 5.017 |
| -2.397 | 5.088 |
| -2.325 | 5.157 |
| -2.253 | 5.226 |
| -2.180 | 5.295 |
| -2.107 | 5.363 |
| -2.033 | 5.430 |
| -1.959 | 5.497 |
| -1.884 | 5.564 |
| -1.809 | 5.630 |
| -1.733 | 5.695 |
| -1.657 | 5.760 |
| -1.581 | 5.825 |
| -1.504 | 5.889 |
| -1.427 | 5.953 |
| -1.350 | 6.016 |
| -1.272 | 6.079 |
| -1.194 | 6.141 |
| -1.115 | 6.203 |
| -1.037 | 6.265 |
| -0.957 | 6.326 |
| -0.878 | 6.387 |
| -0.798 | 6.447 |
| -0.718 | 6.507 |
| -0.638 | 6.567 |
| -0.558 | 6.626 |
| -0.477 | 6.685 |
| -0.396 | 6.744 |
| -0.315 | 6.802 |
| -0.233 | 6.860 |
| -0.152 | 6.918 |
| -0.070 | 6.975 |

| x | y |
|---|---|
| 0.013 | 7.032 |
| 0.095 | 7.089 |
| 0.178 | 7.145 |
| 0.260 | 7.201 |
| 0.343 | 7.257 |
| 0.427 | 7.312 |
| 0.510 | 7.368 |
| 0.594 | 7.422 |
| 0.677 | 7.477 |
| 0.761 | 7.531 |
| 0.846 | 7.585 |
| 0.930 | 7.639 |
| 1.014 | 7.693 |
| 1.099 | 7.746 |
| 1.184 | 7.799 |
| 1.269 | 7.852 |
| 1.354 | 7.904 |
| 1.439 | 7.956 |
| 1.525 | 8.008 |
| 1.610 | 8.060 |
| 1.696 | 8.111 |
| 1.782 | 8.163 |
| 1.868 | 8.214 |
| 1.954 | 8.264 |
| 2.040 | 8.315 |
| 2.127 | 8.365 |
| 2.213 | 8.415 |
| 2.300 | 8.465 |
| 2.387 | 8.515 |
| 2.474 | 8.565 |
| 2.561 | 8.614 |
| 2.648 | 8.663 |
| 2.735 | 8.712 |
| 2.822 | 8.760 |
| 2.910 | 8.809 |
| 2.997 | 8.857 |
| 3.085 | 8.905 |
| 3.173 | 8.953 |
| 3.261 | 9.001 |
| 3.349 | 9.048 |
| 3.437 | 9.095 |
| 3.525 | 9.142 |
| 3.614 | 9.189 |
| 3.702 | 9.236 |

FIG. 28a

| x | y | x | y | x | y |
|---|---|---|---|---|---|
| 3.790 | 9.283 | 7.761 | 11.177 | 11.835 | 12.838 |
| 3.879 | 9.329 | 7.852 | 11.217 | 11.928 | 12.874 |
| 3.968 | 9.375 | 7.944 | 11.257 | 12.022 | 12.909 |
| 4.057 | 9.421 | 8.036 | 11.297 | 12.115 | 12.945 |
| 4.145 | 9.467 | 8.127 | 11.337 | 12.209 | 12.980 |
| 4.234 | 9.513 | 8.219 | 11.376 | 12.302 | 13.015 |
| 4.323 | 9.558 | 8.311 | 11.416 | 12.396 | 13.050 |
| 4.413 | 9.603 | 8.403 | 11.455 | 12.490 | 13.085 |
| 4.502 | 9.649 | 8.495 | 11.494 | 12.583 | 13.120 |
| 4.591 | 9.694 | 8.587 | 11.534 | 12.677 | 13.155 |
| 4.680 | 9.739 | 8.679 | 11.573 | 12.771 | 13.190 |
| 4.770 | 9.783 | 8.771 | 11.611 | 12.864 | 13.225 |
| 4.859 | 9.828 | 8.863 | 11.650 | 12.958 | 13.259 |
| 4.949 | 9.872 | 8.956 | 11.689 | 13.052 | 13.294 |
| 5.039 | 9.916 | 9.048 | 11.727 | 13.146 | 13.328 |
| 5.128 | 9.960 | 9.140 | 11.766 | 13.240 | 13.363 |
| 5.218 | 10.004 | 9.233 | 11.804 | 13.334 | 13.397 |
| 5.308 | 10.048 | 9.325 | 11.843 | 13.428 | 13.431 |
| 5.398 | 10.092 | 9.417 | 11.881 | 13.522 | 13.465 |
| 5.488 | 10.135 | 9.510 | 11.919 | 13.616 | 13.499 |
| 5.578 | 10.179 | 9.602 | 11.957 | 13.710 | 13.533 |
| 5.669 | 10.222 | 9.695 | 11.995 | 13.804 | 13.567 |
| 5.759 | 10.265 | 9.788 | 12.032 | 13.898 | 13.601 |
| 5.849 | 10.308 | 9.880 | 12.070 | 13.992 | 13.634 |
| 5.940 | 10.350 | 9.973 | 12.107 | 14.087 | 13.668 |
| 6.030 | 10.393 | 10.066 | 12.145 | 14.181 | 13.701 |
| 6.121 | 10.435 | 10.158 | 12.182 | 14.275 | 13.735 |
| 6.211 | 10.478 | 10.251 | 12.219 | 14.369 | 13.768 |
| 6.302 | 10.520 | 10.344 | 12.257 | 14.464 | 13.801 |
| 6.393 | 10.562 | 10.437 | 12.294 | 14.558 | 13.835 |
| 6.483 | 10.604 | 10.530 | 12.331 | 14.652 | 13.868 |
| 6.574 | 10.646 | 10.623 | 12.367 | 14.747 | 13.901 |
| 6.665 | 10.687 | 10.716 | 12.404 | 14.841 | 13.934 |
| 6.756 | 10.729 | 10.809 | 12.441 | 14.936 | 13.966 |
| 6.847 | 10.770 | 10.902 | 12.477 | 15.030 | 13.999 |
| 6.938 | 10.812 | 10.995 | 12.514 | 15.125 | 14.032 |
| 7.029 | 10.853 | 11.088 | 12.550 | 15.219 | 14.064 |
| 7.121 | 10.894 | 11.181 | 12.587 | 15.314 | 14.097 |
| 7.212 | 10.935 | 11.275 | 12.623 | 15.408 | 14.129 |
| 7.303 | 10.975 | 11.368 | 12.659 | 15.503 | 14.161 |
| 7.395 | 11.016 | 11.461 | 12.695 | 15.598 | 14.194 |
| 7.486 | 11.057 | 11.554 | 12.731 | 15.692 | 14.226 |
| 7.577 | 11.097 | 11.648 | 12.767 | 15.787 | 14.258 |
| 7.669 | 11.137 | 11.741 | 12.802 | 15.882 | 14.290 |

FIG. 28b

| X | y |
|---|---|
| 15.977 | 14.322 |
| 16.072 | 14.353 |
| 16.166 | 14.385 |
| 16.261 | 14.417 |
| 16.356 | 14.448 |
| 16.451 | 14.480 |
| 16.546 | 14.511 |
| 16.641 | 14.542 |
| 16.736 | 14.574 |
| 16.831 | 14.605 |
| 16.926 | 14.636 |
| 17.021 | 14.667 |
| 17.116 | 14.698 |
| 17.211 | 14.729 |
| 17.306 | 14.759 |
| 17.402 | 14.790 |
| 17.497 | 14.821 |
| 17.592 | 14.851 |
| 17.687 | 14.882 |
| 17.783 | 14.912 |
| 17.878 | 14.943 |
| 17.973 | 14.973 |
| 18.068 | 15.003 |
| 18.164 | 15.033 |
| 18.259 | 15.063 |
| 18.355 | 15.093 |
| 18.450 | 15.123 |
| 18.545 | 15.153 |
| 18.641 | 15.183 |
| 18.736 | 15.213 |
| 18.832 | 15.243 |
| 18.927 | 15.273 |
| 19.023 | 15.303 |
| 19.118 | 15.332 |
| 19.214 | 15.362 |
| 19.309 | 15.392 |
| 19.404 | 15.421 |
| 19.500 | 15.451 |
| 19.596 | 15.481 |
| 19.691 | 15.510 |
| 19.787 | 15.540 |
| 19.882 | 15.569 |
| 19.978 | 15.599 |
| 20.073 | 15.629 |

| X | y |
|---|---|
| 20.169 | 15.658 |
| 20.264 | 15.688 |
| 20.360 | 15.717 |
| 20.455 | 15.747 |
| 20.551 | 15.776 |
| 20.646 | 15.806 |
| 20.742 | 15.835 |
| 20.837 | 15.865 |
| 20.933 | 15.894 |
| 21.029 | 15.924 |
| 21.124 | 15.953 |
| 21.220 | 15.983 |
| 21.315 | 16.012 |
| 21.411 | 16.041 |
| 21.507 | 16.070 |
| 21.602 | 16.099 |
| 21.698 | 16.128 |
| 21.794 | 16.156 |
| 21.890 | 16.183 |
| 21.987 | 16.210 |
| 22.083 | 16.237 |
| 22.180 | 16.263 |
| 22.276 | 16.288 |
| 22.373 | 16.313 |
| 22.470 | 16.337 |
| 22.568 | 16.360 |
| 22.665 | 16.382 |
| 22.763 | 16.403 |
| 22.861 | 16.424 |
| 22.959 | 16.443 |
| 23.057 | 16.461 |
| 23.156 | 16.479 |
| 23.254 | 16.495 |
| 23.290 | 16.500 |

FIG. 28c

| X | y |
|---|---|
| 0.000 | 1.663 |
| -0.002 | 1.665 |
| -0.078 | 1.729 |
| -0.156 | 1.793 |
| -0.232 | 1.858 |
| -0.305 | 1.926 |
| -0.374 | 1.998 |
| -0.440 | 2.073 |
| -0.506 | 2.148 |
| -0.575 | 2.220 |
| -0.649 | 2.288 |
| -0.727 | 2.351 |
| -0.809 | 2.408 |
| -0.895 | 2.459 |
| -0.984 | 2.503 |
| -1.077 | 2.542 |
| -1.170 | 2.577 |
| -1.264 | 2.610 |
| -1.359 | 2.643 |
| -1.453 | 2.677 |
| -1.548 | 2.709 |
| -1.644 | 2.738 |
| -1.741 | 2.761 |
| -1.839 | 2.778 |
| -1.939 | 2.789 |
| -2.038 | 2.796 |
| -2.138 | 2.802 |
| -2.238 | 2.809 |
| -2.338 | 2.818 |
| -2.437 | 2.829 |
| -2.536 | 2.840 |
| -2.636 | 2.851 |
| -2.735 | 2.861 |
| -2.793 | 2.866 |

FIG. 29

| X | y |
|---|---|
| -2.793 | 4.683 |
| -2.748 | 4.731 |
| -2.679 | 4.804 |
| -2.609 | 4.875 |
| -2.539 | 4.947 |
| -2.468 | 5.017 |
| -2.397 | 5.088 |
| -2.325 | 5.157 |
| -2.253 | 5.226 |
| -2.180 | 5.295 |
| -2.107 | 5.363 |
| -2.033 | 5.430 |
| -1.959 | 5.497 |
| -1.884 | 5.564 |
| -1.809 | 5.630 |
| -1.733 | 5.695 |
| -1.657 | 5.760 |
| -1.581 | 5.825 |
| -1.504 | 5.889 |
| -1.427 | 5.953 |
| -1.350 | 6.016 |
| -1.272 | 6.079 |
| -1.194 | 6.141 |
| -1.115 | 6.203 |
| -1.037 | 6.265 |
| -0.957 | 6.326 |
| -0.878 | 6.387 |
| -0.798 | 6.447 |
| -0.718 | 6.507 |
| -0.638 | 6.567 |
| -0.558 | 6.626 |
| -0.477 | 6.685 |
| -0.396 | 6.744 |
| -0.315 | 6.802 |
| -0.233 | 6.860 |
| -0.152 | 6.918 |
| -0.070 | 6.975 |

| X | y |
|---|---|
| 0.013 | 7.032 |
| 0.095 | 7.089 |
| 0.178 | 7.145 |
| 0.260 | 7.201 |
| 0.343 | 7.257 |
| 0.427 | 7.312 |
| 0.510 | 7.368 |
| 0.594 | 7.422 |
| 0.677 | 7.477 |
| 0.761 | 7.531 |
| 0.846 | 7.585 |
| 0.930 | 7.639 |
| 1.014 | 7.693 |
| 1.099 | 7.746 |
| 1.184 | 7.799 |
| 1.269 | 7.852 |
| 1.354 | 7.904 |
| 1.439 | 7.956 |
| 1.525 | 8.008 |
| 1.610 | 8.060 |
| 1.696 | 8.111 |
| 1.782 | 8.163 |
| 1.868 | 8.214 |
| 1.954 | 8.264 |
| 2.040 | 8.315 |
| 2.127 | 8.365 |
| 2.213 | 8.415 |
| 2.300 | 8.465 |
| 2.387 | 8.515 |
| 2.474 | 8.565 |
| 2.561 | 8.614 |
| 2.648 | 8.663 |
| 2.735 | 8.712 |
| 2.822 | 8.760 |
| 2.910 | 8.809 |
| 2.997 | 8.857 |
| 3.085 | 8.905 |
| 3.173 | 8.953 |
| 3.261 | 9.001 |
| 3.349 | 9.048 |
| 3.437 | 9.095 |
| 3.525 | 9.142 |
| 3.614 | 9.189 |
| 3.702 | 9.236 |

| X | y |
|---|---|
| 3.790 | 9.283 |
| 3.879 | 9.329 |
| 3.968 | 9.375 |
| 4.057 | 9.421 |
| 4.145 | 9.467 |
| 4.234 | 9.513 |
| 4.323 | 9.558 |
| 4.413 | 9.603 |
| 4.502 | 9.649 |
| 4.591 | 9.694 |
| 4.680 | 9.739 |
| 4.770 | 9.783 |
| 4.859 | 9.828 |
| 4.949 | 9.872 |
| 5.039 | 9.916 |
| 5.128 | 9.960 |
| 5.218 | 10.004 |
| 5.308 | 10.048 |
| 5.398 | 10.092 |
| 5.488 | 10.135 |
| 5.578 | 10.179 |
| 5.669 | 10.222 |
| 5.759 | 10.265 |
| 5.849 | 10.308 |
| 5.940 | 10.350 |
| 6.030 | 10.393 |
| 6.121 | 10.435 |
| 6.211 | 10.478 |
| 6.302 | 10.520 |
| 6.393 | 10.562 |
| 6.483 | 10.604 |
| 6.574 | 10.646 |
| 6.665 | 10.687 |
| 6.756 | 10.729 |
| 6.847 | 10.770 |
| 6.938 | 10.812 |
| 7.029 | 10.853 |
| 7.121 | 10.894 |
| 7.212 | 10.935 |
| 7.303 | 10.975 |
| 7.395 | 11.016 |
| 7.486 | 11.057 |
| 7.577 | 11.097 |
| 7.669 | 11.137 |

| X | y |
|---|---|
| 7.761 | 11.177 |
| 7.852 | 11.217 |
| 7.944 | 11.257 |
| 8.036 | 11.297 |
| 8.127 | 11.337 |
| 8.219 | 11.376 |
| 8.311 | 11.416 |
| 8.403 | 11.455 |
| 8.495 | 11.494 |
| 8.587 | 11.534 |
| 8.679 | 11.573 |
| 8.771 | 11.611 |
| 8.863 | 11.650 |
| 8.956 | 11.689 |
| 9.048 | 11.727 |
| 9.140 | 11.766 |
| 9.233 | 11.804 |
| 9.325 | 11.843 |
| 9.417 | 11.881 |
| 9.510 | 11.919 |
| 9.602 | 11.957 |
| 9.695 | 11.995 |
| 9.788 | 12.032 |
| 9.880 | 12.070 |
| 9.973 | 12.107 |
| 10.066 | 12.145 |
| 10.158 | 12.182 |
| 10.251 | 12.219 |
| 10.344 | 12.257 |
| 10.437 | 12.294 |
| 10.530 | 12.331 |
| 10.623 | 12.367 |
| 10.716 | 12.404 |
| 10.809 | 12.441 |
| 10.902 | 12.477 |
| 10.995 | 12.514 |
| 11.088 | 12.550 |
| 11.181 | 12.587 |
| 11.275 | 12.623 |
| 11.368 | 12.659 |
| 11.461 | 12.695 |
| 11.554 | 12.731 |
| 11.648 | 12.767 |
| 11.741 | 12.802 |

FIG. 30a

| x | y |
|---|---|
| 11.835 | 12.838 |
| 11.928 | 12.874 |
| 12.022 | 12.909 |
| 12.115 | 12.945 |
| 12.209 | 12.980 |
| 12.302 | 13.015 |
| 12.396 | 13.050 |
| 12.490 | 13.085 |
| 12.583 | 13.120 |
| 12.677 | 13.155 |
| 12.771 | 13.190 |
| 12.864 | 13.225 |
| 12.958 | 13.259 |
| 13.052 | 13.294 |
| 13.146 | 13.328 |
| 13.240 | 13.363 |
| 13.334 | 13.397 |
| 13.428 | 13.431 |
| 13.522 | 13.465 |
| 13.616 | 13.499 |
| 13.710 | 13.533 |
| 13.804 | 13.567 |
| 13.898 | 13.601 |
| 13.992 | 13.634 |
| 14.087 | 13.668 |
| 14.181 | 13.701 |
| 14.275 | 13.735 |
| 14.369 | 13.768 |
| 14.464 | 13.801 |
| 14.558 | 13.835 |
| 14.652 | 13.868 |
| 14.747 | 13.901 |
| 14.841 | 13.934 |
| 14.936 | 13.966 |
| 15.030 | 13.999 |
| 15.125 | 14.032 |
| 15.219 | 14.064 |
| 15.314 | 14.097 |
| 15.408 | 14.129 |
| 15.503 | 14.161 |
| 15.598 | 14.194 |
| 15.692 | 14.226 |
| 15.787 | 14.258 |
| 15.882 | 14.290 |

| x | y |
|---|---|
| 15.977 | 14.322 |
| 16.072 | 14.353 |
| 16.166 | 14.385 |
| 16.261 | 14.417 |
| 16.356 | 14.448 |
| 16.451 | 14.480 |
| 16.546 | 14.511 |
| 16.641 | 14.542 |
| 16.736 | 14.574 |
| 16.831 | 14.605 |
| 16.926 | 14.636 |
| 17.021 | 14.667 |
| 17.116 | 14.698 |
| 17.211 | 14.729 |
| 17.306 | 14.759 |
| 17.402 | 14.790 |
| 17.497 | 14.821 |
| 17.592 | 14.851 |
| 17.687 | 14.882 |
| 17.783 | 14.912 |
| 17.878 | 14.943 |
| 17.973 | 14.973 |
| 18.068 | 15.003 |
| 18.164 | 15.033 |
| 18.259 | 15.063 |
| 18.355 | 15.093 |
| 18.450 | 15.123 |
| 18.545 | 15.153 |
| 18.641 | 15.183 |
| 18.736 | 15.213 |
| 18.832 | 15.243 |
| 18.927 | 15.273 |
| 19.023 | 15.303 |
| 19.118 | 15.332 |
| 19.214 | 15.362 |
| 19.309 | 15.392 |
| 19.404 | 15.421 |
| 19.500 | 15.451 |
| 19.596 | 15.481 |
| 19.691 | 15.510 |
| 19.787 | 15.540 |
| 19.882 | 15.569 |
| 19.978 | 15.599 |
| 20.073 | 15.629 |

| x | y |
|---|---|
| 20.169 | 15.658 |
| 20.264 | 15.688 |
| 20.360 | 15.717 |
| 20.455 | 15.747 |
| 20.551 | 15.776 |
| 20.646 | 15.806 |
| 20.742 | 15.835 |
| 20.837 | 15.865 |
| 20.933 | 15.894 |
| 21.029 | 15.924 |
| 21.124 | 15.953 |
| 21.220 | 15.983 |
| 21.315 | 16.012 |
| 21.411 | 16.041 |
| 21.507 | 16.070 |
| 21.602 | 16.099 |
| 21.698 | 16.128 |
| 21.794 | 16.156 |
| 21.890 | 16.183 |
| 21.987 | 16.210 |
| 22.083 | 16.237 |
| 22.180 | 16.263 |
| 22.276 | 16.288 |
| 22.373 | 16.313 |
| 22.470 | 16.337 |
| 22.568 | 16.360 |
| 22.665 | 16.382 |
| 22.763 | 16.403 |
| 22.861 | 16.424 |
| 22.959 | 16.443 |
| 23.057 | 16.461 |
| 23.156 | 16.479 |
| 23.254 | 16.495 |
| 23.290 | 16.500 |

FIG. 30b

| X | Y |
|---|---|
| -10.897 | 0.000 |
| -10.897 | 0.100 |
| -10.897 | 0.200 |
| -10.897 | 0.300 |
| -10.897 | 0.400 |
| -10.897 | 0.500 |
| -10.897 | 0.600 |
| -10.897 | 0.700 |
| -10.897 | 0.800 |
| -10.897 | 0.900 |
| -10.897 | 1.000 |
| -10.897 | 1.100 |
| -10.897 | 1.106 |
| -10.897 | 1.106 |
| -10.960 | 1.123 |
| -11.057 | 1.149 |
| -11.153 | 1.175 |
| -11.249 | 1.203 |
| -11.344 | 1.233 |
| -11.438 | 1.269 |
| -11.531 | 1.305 |
| -11.626 | 1.338 |
| -11.720 | 1.371 |
| -11.814 | 1.404 |
| -11.909 | 1.437 |
| -12.003 | 1.469 |
| -12.098 | 1.501 |
| -12.193 | 1.532 |
| -12.288 | 1.565 |
| -12.382 | 1.599 |
| -12.475 | 1.634 |
| -12.569 | 1.669 |
| -12.663 | 1.703 |
| -12.757 | 1.736 |
| -12.852 | 1.768 |
| -12.947 | 1.798 |
| -13.043 | 1.828 |
| -13.055 | 1.831 |
| -12.794 | 3.411 |
| -12.748 | 3.449 |
| -12.671 | 3.513 |
| -12.594 | 3.576 |
| -12.515 | 3.638 |
| -12.436 | 3.699 |
| -12.357 | 3.760 |
| -12.277 | 3.820 |

| X | Y |
|---|---|
| -12.196 | 3.879 |
| -12.115 | 3.938 |
| -12.034 | 3.996 |
| -11.952 | 4.053 |
| -11.870 | 4.110 |
| -11.787 | 4.167 |
| -11.704 | 4.223 |
| -11.621 | 4.278 |
| -11.538 | 4.333 |
| -11.454 | 4.388 |
| -11.370 | 4.442 |
| -11.285 | 4.496 |
| -11.201 | 4.549 |
| -11.116 | 4.602 |
| -11.031 | 4.655 |
| -10.946 | 4.707 |
| -10.860 | 4.759 |
| -10.774 | 4.810 |
| -10.688 | 4.861 |
| -10.602 | 4.912 |
| -10.516 | 4.962 |
| -10.429 | 5.012 |
| -10.343 | 5.062 |
| -10.256 | 5.112 |
| -10.169 | 5.161 |
| -10.081 | 5.210 |
| -9.994 | 5.258 |
| -9.906 | 5.307 |
| -9.819 | 5.355 |
| -9.731 | 5.402 |
| -9.643 | 5.450 |
| -9.555 | 5.497 |
| -9.466 | 5.544 |
| -9.378 | 5.591 |
| -9.290 | 5.637 |
| -9.201 | 5.684 |
| -9.112 | 5.730 |
| -9.023 | 5.775 |
| -8.934 | 5.821 |
| -8.845 | 5.866 |
| -8.756 | 5.911 |
| -8.666 | 5.956 |
| -8.577 | 6.001 |
| -8.487 | 6.045 |
| -8.398 | 6.090 |
| -8.308 | 6.134 |

| X | Y |
|---|---|
| -8.218 | 6.178 |
| -8.128 | 6.221 |
| -8.038 | 6.265 |
| -7.948 | 6.308 |
| -7.857 | 6.351 |
| -7.767 | 6.394 |
| -7.677 | 6.436 |
| -7.586 | 6.479 |
| -7.496 | 6.521 |
| -7.405 | 6.564 |
| -7.314 | 6.606 |
| -7.224 | 6.648 |
| -7.133 | 6.690 |
| -7.042 | 6.731 |
| -6.951 | 6.773 |
| -6.860 | 6.814 |
| -6.769 | 6.856 |
| -6.678 | 6.897 |
| -6.587 | 6.938 |
| -6.495 | 6.979 |
| -6.404 | 7.020 |
| -6.313 | 7.061 |
| -6.221 | 7.101 |
| -6.130 | 7.142 |
| -6.039 | 7.182 |
| -5.947 | 7.223 |
| -5.855 | 7.263 |
| -5.764 | 7.303 |
| -5.672 | 7.342 |
| -5.580 | 7.382 |
| -5.488 | 7.421 |
| -5.396 | 7.460 |
| -5.304 | 7.499 |
| -5.212 | 7.538 |
| -5.119 | 7.576 |
| -5.027 | 7.614 |
| -4.934 | 7.652 |
| -4.842 | 7.690 |
| -4.749 | 7.727 |
| -4.656 | 7.764 |
| -4.563 | 7.801 |
| -4.470 | 7.838 |
| -4.377 | 7.875 |
| -4.284 | 7.911 |
| -4.191 | 7.947 |
| -4.098 | 7.984 |

FIG. 39a

| X | Y |
|---|---|
| -4.004 | 8.020 |
| -3.911 | 8.056 |
| -3.818 | 8.091 |
| -3.724 | 8.127 |
| -3.631 | 8.162 |
| -3.537 | 8.198 |
| -3.444 | 8.233 |
| -3.350 | 8.268 |
| -3.256 | 8.302 |
| -3.162 | 8.337 |
| -3.068 | 8.371 |
| -2.974 | 8.405 |
| -2.880 | 8.438 |
| -2.786 | 8.472 |
| -2.691 | 8.505 |
| -2.597 | 8.538 |
| -2.503 | 8.572 |
| -2.500 | 8.573 |
| 0.000 | 8.573 |
| 0.000 | 8.500 |
| 0.000 | 8.400 |
| 0.000 | 8.300 |
| 0.000 | 8.200 |
| 0.000 | 8.100 |
| 0.000 | 8.000 |
| 0.000 | 7.900 |
| 0.000 | 7.800 |
| 0.000 | 7.700 |
| 0.000 | 7.600 |
| 0.000 | 7.500 |
| 0.000 | 7.400 |
| 0.000 | 7.300 |
| 0.000 | 7.200 |
| 0.000 | 7.100 |
| 0.000 | 7.000 |
| 0.000 | 6.900 |
| 0.000 | 6.800 |
| 0.000 | 6.700 |
| 0.000 | 6.600 |
| 0.000 | 6.500 |
| 0.000 | 6.400 |
| 0.000 | 6.300 |
| 0.000 | 6.200 |
| 0.000 | 6.100 |
| 0.000 | 6.000 |
| 0.000 | 5.900 |

| X | Y |
|---|---|
| 0.000 | 5.800 |
| 0.000 | 5.700 |
| 0.000 | 5.600 |
| 0.000 | 5.500 |
| 0.000 | 5.400 |
| 0.000 | 5.300 |
| 0.000 | 5.200 |
| 0.000 | 5.100 |
| 0.000 | 5.000 |
| 0.000 | 4.900 |
| 0.000 | 4.800 |
| 0.000 | 4.700 |
| 0.000 | 4.600 |
| 0.000 | 4.500 |
| 0.000 | 4.400 |
| 0.000 | 4.300 |
| 0.000 | 4.200 |
| 0.000 | 4.100 |
| 0.000 | 4.000 |
| 0.000 | 3.900 |
| 0.000 | 3.800 |
| 0.000 | 3.700 |
| 0.000 | 3.600 |
| 0.000 | 3.500 |
| 0.000 | 3.400 |
| 0.000 | 3.300 |
| 0.000 | 3.200 |
| 0.000 | 3.100 |
| 0.000 | 3.000 |
| 0.000 | 2.900 |
| 0.000 | 2.800 |
| 0.000 | 2.700 |
| 0.000 | 2.600 |
| 0.000 | 2.500 |
| 0.000 | 2.400 |
| 0.000 | 2.300 |
| 0.000 | 2.200 |
| 0.000 | 2.100 |
| 0.000 | 2.000 |
| 0.000 | 1.900 |
| 0.000 | 1.800 |
| 0.000 | 1.700 |
| 0.000 | 1.600 |
| 0.000 | 1.500 |
| 0.000 | 1.400 |
| 0.000 | 1.300 |

| X | Y |
|---|---|
| 0.000 | 1.200 |
| 0.000 | 1.100 |
| 0.000 | 1.000 |
| 0.000 | 0.900 |
| 0.000 | 0.800 |
| 0.000 | 0.700 |
| 0.000 | 0.600 |
| 0.000 | 0.500 |
| 0.000 | 0.400 |
| 0.000 | 0.300 |
| 0.000 | 0.200 |
| 0.000 | 0.100 |
| 0.000 | 0.000 |

FIG. 39b

| X | Y |
|---|---|
| 0.000 | 0.000 |
| 0.000 | 0.100 |
| 0.000 | 0.200 |
| 0.000 | 0.300 |
| 0.000 | 0.400 |
| 0.000 | 0.500 |
| 0.000 | 0.600 |
| 0.000 | 0.700 |
| 0.000 | 0.800 |
| 0.000 | 0.900 |
| 0.000 | 1.000 |
| 0.000 | 1.100 |
| 0.000 | 1.106 |
| 0.000 | 1.106 |
| -0.063 | 1.123 |
| -0.160 | 1.149 |
| -0.256 | 1.175 |
| -0.352 | 1.203 |
| -0.447 | 1.233 |
| -0.541 | 1.269 |
| -0.634 | 1.305 |
| -0.729 | 1.338 |
| -0.823 | 1.371 |
| -0.917 | 1.404 |
| -1.012 | 1.437 |
| -1.106 | 1.469 |
| -1.201 | 1.501 |
| -1.296 | 1.532 |
| -1.391 | 1.565 |
| -1.485 | 1.599 |
| -1.578 | 1.634 |
| -1.672 | 1.669 |
| -1.766 | 1.703 |
| -1.860 | 1.736 |
| -1.955 | 1.768 |
| -2.050 | 1.798 |
| -2.146 | 1.828 |
| -2.158 | 1.831 |
| -1.897 | 3.411 |
| -1.851 | 3.449 |
| -1.774 | 3.513 |
| -1.697 | 3.576 |
| -1.618 | 3.638 |
| -1.539 | 3.699 |
| -1.460 | 3.760 |
| -1.380 | 3.820 |
| -1.299 | 3.879 |
| -1.218 | 3.938 |
| -1.137 | 3.996 |
| -1.055 | 4.053 |
| -0.973 | 4.110 |
| -0.890 | 4.167 |
| -0.807 | 4.223 |
| -0.724 | 4.278 |
| -0.641 | 4.333 |
| -0.557 | 4.388 |
| -0.473 | 4.442 |
| -0.388 | 4.496 |
| -0.304 | 4.549 |

| X | Y |
|---|---|
| -0.219 | 4.602 |
| -0.134 | 4.655 |
| -0.049 | 4.707 |
| 0.037 | 4.759 |
| 0.123 | 4.810 |
| 0.209 | 4.861 |
| 0.295 | 4.912 |
| 0.381 | 4.962 |
| 0.468 | 5.012 |
| 0.554 | 5.062 |
| 0.641 | 5.112 |
| 0.728 | 5.161 |
| 0.816 | 5.210 |
| 0.903 | 5.258 |
| 0.991 | 5.307 |
| 1.078 | 5.355 |
| 1.166 | 5.402 |
| 1.254 | 5.450 |
| 1.342 | 5.497 |
| 1.431 | 5.544 |
| 1.519 | 5.591 |
| 1.607 | 5.637 |
| 1.696 | 5.684 |
| 1.785 | 5.730 |
| 1.874 | 5.775 |
| 1.963 | 5.821 |
| 2.052 | 5.866 |
| 2.141 | 5.911 |
| 2.231 | 5.956 |
| 2.320 | 6.001 |
| 2.410 | 6.045 |
| 2.499 | 6.090 |
| 2.589 | 6.134 |
| 2.679 | 6.178 |
| 2.769 | 6.221 |
| 2.859 | 6.265 |
| 2.949 | 6.308 |
| 3.040 | 6.351 |
| 3.130 | 6.394 |
| 3.220 | 6.436 |
| 3.311 | 6.479 |
| 3.401 | 6.521 |
| 3.492 | 6.564 |
| 3.583 | 6.606 |
| 3.673 | 6.648 |
| 3.764 | 6.690 |
| 3.855 | 6.731 |
| 3.946 | 6.773 |
| 4.037 | 6.814 |
| 4.128 | 6.856 |
| 4.219 | 6.897 |
| 4.310 | 6.938 |
| 4.402 | 6.979 |
| 4.493 | 7.020 |
| 4.584 | 7.061 |
| 4.676 | 7.101 |
| 4.767 | 7.142 |
| 4.858 | 7.182 |
| 4.950 | 7.223 |

| X | Y |
|---|---|
| 5.042 | 7.263 |
| 5.133 | 7.303 |
| 5.225 | 7.342 |
| 5.317 | 7.382 |
| 5.409 | 7.421 |
| 5.501 | 7.460 |
| 5.593 | 7.499 |
| 5.685 | 7.538 |
| 5.778 | 7.576 |
| 5.870 | 7.614 |
| 5.963 | 7.652 |
| 6.055 | 7.690 |
| 6.148 | 7.727 |
| 6.241 | 7.764 |
| 6.334 | 7.801 |
| 6.427 | 7.838 |
| 6.520 | 7.875 |
| 6.613 | 7.911 |
| 6.706 | 7.947 |
| 6.799 | 7.984 |
| 6.893 | 8.020 |
| 6.986 | 8.056 |
| 7.079 | 8.091 |
| 7.173 | 8.127 |
| 7.266 | 8.162 |
| 7.360 | 8.198 |
| 7.453 | 8.233 |
| 7.547 | 8.268 |
| 7.641 | 8.302 |
| 7.735 | 8.337 |
| 7.829 | 8.371 |
| 7.923 | 8.405 |
| 8.017 | 8.438 |
| 8.111 | 8.472 |
| 8.206 | 8.505 |
| 8.300 | 8.538 |
| 8.394 | 8.572 |
| 8.397 | 8.573 |

FIG. 40

| X | Y |
|---|---|
| 0.000 | 1.106 |
| -0.063 | 1.123 |
| -0.160 | 1.149 |
| -0.256 | 1.175 |
| -0.352 | 1.203 |
| -0.447 | 1.233 |
| -0.541 | 1.269 |
| -0.634 | 1.305 |
| -0.729 | 1.338 |
| -0.823 | 1.371 |
| -0.917 | 1.404 |
| -1.012 | 1.437 |
| -1.106 | 1.469 |
| -1.201 | 1.501 |
| -1.296 | 1.532 |
| -1.391 | 1.565 |
| -1.485 | 1.599 |
| -1.578 | 1.634 |
| -1.672 | 1.669 |
| -1.766 | 1.703 |
| -1.860 | 1.736 |
| -1.955 | 1.768 |
| -2.050 | 1.798 |
| -2.146 | 1.828 |
| -2.158 | 1.831 |

FIG. 41

| X | Y |
|---|---|
| -1.897 | 3.411 |
| -1.851 | 3.449 |
| -1.774 | 3.513 |
| -1.697 | 3.576 |
| -1.618 | 3.638 |
| -1.539 | 3.699 |
| -1.460 | 3.760 |
| -1.380 | 3.820 |
| -1.299 | 3.879 |
| -1.218 | 3.938 |
| -1.137 | 3.996 |
| -1.055 | 4.053 |
| -0.973 | 4.110 |
| -0.890 | 4.167 |
| -0.807 | 4.223 |
| -0.724 | 4.278 |
| -0.641 | 4.333 |
| -0.557 | 4.388 |
| -0.473 | 4.442 |
| -0.388 | 4.496 |
| -0.304 | 4.549 |
| -0.219 | 4.602 |
| -0.134 | 4.655 |
| -0.049 | 4.707 |
| 0.037 | 4.759 |
| 0.123 | 4.810 |
| 0.209 | 4.861 |
| 0.295 | 4.912 |
| 0.381 | 4.962 |
| 0.468 | 5.012 |
| 0.554 | 5.062 |
| 0.641 | 5.112 |
| 0.728 | 5.161 |
| 0.816 | 5.210 |
| 0.903 | 5.258 |
| 0.991 | 5.307 |
| 1.078 | 5.355 |
| 1.166 | 5.402 |
| 1.254 | 5.450 |
| 1.342 | 5.497 |

| X | Y |
|---|---|
| 1.431 | 5.544 |
| 1.519 | 5.591 |
| 1.607 | 5.637 |
| 1.696 | 5.684 |
| 1.785 | 5.730 |
| 1.874 | 5.775 |
| 1.963 | 5.821 |
| 2.052 | 5.866 |
| 2.141 | 5.911 |
| 2.231 | 5.956 |
| 2.320 | 6.001 |
| 2.410 | 6.045 |
| 2.499 | 6.090 |
| 2.589 | 6.134 |
| 2.679 | 6.178 |
| 2.769 | 6.221 |
| 2.859 | 6.265 |
| 2.949 | 6.308 |
| 3.040 | 6.351 |
| 3.130 | 6.394 |
| 3.220 | 6.436 |
| 3.311 | 6.479 |
| 3.401 | 6.521 |
| 3.492 | 6.564 |
| 3.583 | 6.606 |
| 3.673 | 6.648 |
| 3.764 | 6.690 |
| 3.855 | 6.731 |
| 3.946 | 6.773 |
| 4.037 | 6.814 |
| 4.128 | 6.856 |
| 4.219 | 6.897 |
| 4.310 | 6.938 |
| 4.402 | 6.979 |
| 4.493 | 7.020 |
| 4.584 | 7.061 |
| 4.676 | 7.101 |
| 4.767 | 7.142 |
| 4.858 | 7.182 |
| 4.950 | 7.223 |

| X | Y |
|---|---|
| 5.042 | 7.263 |
| 5.133 | 7.303 |
| 5.225 | 7.342 |
| 5.317 | 7.382 |
| 5.409 | 7.421 |
| 5.501 | 7.460 |
| 5.593 | 7.499 |
| 5.685 | 7.538 |
| 5.778 | 7.576 |
| 5.870 | 7.614 |
| 5.963 | 7.652 |
| 6.055 | 7.690 |
| 6.148 | 7.727 |
| 6.241 | 7.764 |
| 6.334 | 7.801 |
| 6.427 | 7.838 |
| 6.520 | 7.875 |
| 6.613 | 7.911 |
| 6.706 | 7.947 |
| 6.799 | 7.984 |
| 6.893 | 8.020 |
| 6.986 | 8.056 |
| 7.079 | 8.091 |
| 7.173 | 8.127 |
| 7.266 | 8.162 |
| 7.360 | 8.198 |
| 7.453 | 8.233 |
| 7.547 | 8.268 |
| 7.641 | 8.302 |
| 7.735 | 8.337 |
| 7.829 | 8.371 |
| 7.923 | 8.405 |
| 8.017 | 8.438 |
| 8.111 | 8.472 |
| 8.206 | 8.505 |
| 8.300 | 8.538 |
| 8.394 | 8.572 |
| 8.397 | 8.573 |

FIG. 42

LIGHT ASSEMBLY FOR FLASHLIGHTS

CROSS-REFERENCE TO RELATED APPLICATIONS

This application is a continuation-in-part of co-pending U.S. patent application Ser. No. 13/373,320, filed Nov. 10, 2011, incorporated in full herein by reference, which is a continuation-in-part of co-pending U.S. patent application Ser. No. 13/135,508, filed Jul. 7, 2011, incorporated in full herein by reference, which is a continuation-in-part of U.S. patent application Ser. No. 12/004,664, filed Dec. 20, 2007, incorporated in full herein by reference, now U.S. Pat. No. 8,007,156, which claims the benefit of U.S. Provisional Patent Application No. 60/879,948, filed Jan. 9, 2007, incorporated in full herein by reference; the present application is also a continuation-in-part of co-pending U.S. patent application Ser. No. 13/135,508, filed Jul. 7, 2011, which is a continuation-in-part of U.S. patent application Ser. No. 12/004,664, filed Dec. 20, 2007, now U.S. Pat. No. 8,007,156, which claims the benefit of U.S. Provisional Patent Application No. 60/879,948, filed Jan. 9, 2007.

BACKGROUND OF THE INVENTION

This invention relates to nonimaging light assemblies, and more particularly to such light assemblies for use in flashlights, including flashlights that are hand-held in use or that are adapted for being secured to a weapon or other device or object.

Nonimaging light assemblies for flashlights are well known in the art, as are total-internal reflection lenses for collimating the light rays from a light source, such as a light emitting diode, to produce a concentrated light beam for illuminating objects and surroundings. Although such light assemblies of the prior art have been the subject of significant development in recent years, there nevertheless remains a need for light assemblies having improved beam characteristics for utilization in flashlights and compact flashlights in particular.

SUMMARY OF THE INVENTION

According to one aspect of the present invention, there is provided a nonimaging light assembly for flashlights, for generating a light beam having concentrated and divergent components resulting in a high intensity core beam surrounded by a smoothly transitioning lower intensity surround beam. According to another aspect of the present invention, the light source of the nonimaging light assembly may include a light emitting diode of approximately square configuration whereas the combined output light beam produced by the assembly has a substantially circular cross-section.

In its preferred embodiments, the nonimaging light assembly according to the present invention includes a light source and a lens symmetrical about an optical axis for receiving light from the light source and producing therefrom a light beam having a first light component diverging from the optical axis combined with a concentrated second light component. The preferred lens embodiments include a central refractive first rear surface intersecting the optical axis for receiving a first portion of the light emanating from the light source positioned along the optical axis, an aspheric refractive second rear surface extending about the first rear surface for receiving a second portion of the light emanating from the light source, an aspheric total-internal reflection (TIR) side surface for total-internally reflecting and concentrating light received by the second rear surface, and a refractive front surface for exiting light reflected from the TIR side surface and light received by the first rear surface. The diameter of the first rear surface (which is preferably configured as a flat circle orthogonal to the optical axis), the axisymmetric profile of the second rear surface, and the axisymmetric profile of the TIR side surface are related for exiting at the front surface (which is preferably configured as a flat circle orthogonal to the optical axis) the light beam comprising the concentrated light component combined with the divergent light component.

The light source preferably includes a light emitting diode, typically of approximately square configuration substantially perpendicular to the optical axis, and the combined light beam produced by the lens of the preferred embodiment has a substantially circular cross-section.

BRIEF DESCRIPTION OF THE DRAWINGS

The novel features believed to be characteristic of the present invention, together with further advantages thereof, will be better understood from the following description considered in connection with the accompanying drawings (including plots and tables) in which preferred embodiments of the invention are illustrated by way of example.

FIGS. 8*a* and 8*b* comprise a list of sample points on the lens profile shown in FIG. 2;

FIG. 9 comprises a list of sample points describing the aspheric refractive rear surface about the light source, for the lens shown in FIG. 2;

FIG. 10 comprises a list of sample points describing the aspheric total-internal reflective (TIR) side surface of the lens shown in FIG. 2;

FIGS. 17*a* and 17*b* comprise a list of sample points on the lens profile shown in FIG. 12;

FIG. 18 comprises a list of sample points describing the aspheric refractive rear surface about the light source, for the lens shown in FIG. 12;

FIG. 19 comprises a list of sample points describing the aspheric total-internal reflective side surface of the lens shown in FIG. 12;

FIGS. 27*a*, 27*b*, 27*c* and 27*d* comprise a list of sample points on the lens profile shown in FIG. 21;

FIGS. 28*a*, 28*b* and 28*c* comprise a list of sample points on the first rear surface, the second rear surface and the TIR side surface of the lens profile shown in FIG. 26;

FIG. 29 comprises a list of sample points describing the aspheric refractive rear surface (second rear surface) about the light source, for the lens shown in FIG. 26;

FIGS. 30*a* and 30*b* comprise a list of sample points describing the aspheric TIR side surface of the lens shown in FIG. 26;

FIGS. 39*a* and 39*b* comprise a list of sample points on the lens profile shown in FIG. 32;

FIG. 40 comprises a list of sample points on the first rear surface, the second rear surface and the TIR side surface of the lens profile shown in FIG. 38;

FIG. 41 comprises a list of sample points describing the aspheric refractive rear surface (second rear surface) about the light source, for the lens shown in FIG. 38; and FIG. 42 comprises a list of sample points describing the aspheric TIR side surface of the lens shown in FIG. 38.

DETAILED DESCRIPTION OF THE PREFERRED EMBODIMENTS

Figure 1:
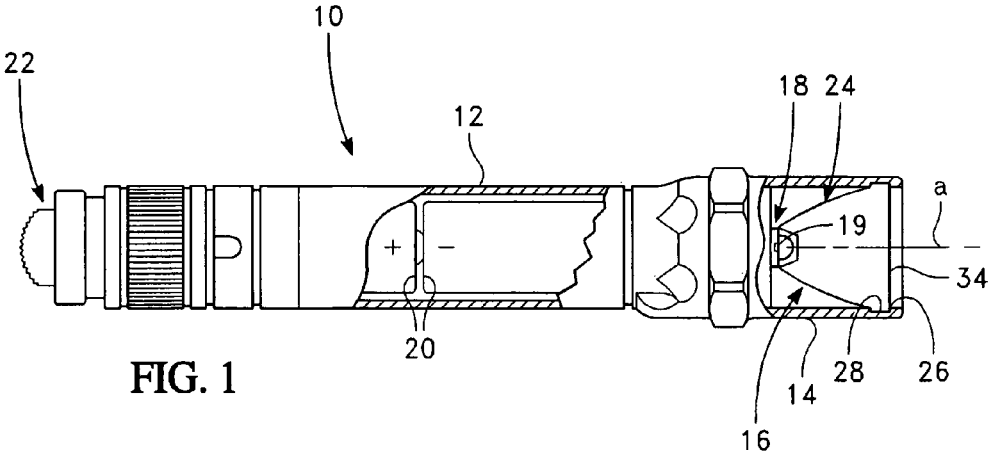
FIG. 1 is a partially cut-away side elevation view of a flashlight including a preferred embodiment of a nonimaging light assembly according to the aforementioned application Ser. No. 12/004,664.

Turning to FIG. 1, there is shown an example of a flashlight 10 including a generally cylindrical battery housing 12, a head 14 at the flashlight's front end including a light assembly 16 with a light source 18 in electrical circuit with a battery comprising at least one battery cell 20, and a switch 22 in circuit and actuable by a user for causing the battery 20 to energize the light source 18.

The light assembly 16 includes a total-internal reflection (TIR) lens 24 according to a preferred embodiment of the invention as disclosed in the aforementioned application Ser. No. 12/004,664. The lens 24 is rotationally symmetrical about its optical axis a, and is combined with the light source 18 including a light emitting diode (LED) 19, protected by a light-transmitting encapsulant dome 21, situated at the rear of the lens 24 along the optical axis a. The shape and material properties of the lens 24 are such that the lens 24 collects light from the LED source 18 and produces therefrom a light beam comprising an axisymmetrical first light component diverging from the optical axis combined with an axisymmetrical concentrated second light component. In the preferred lens configuration, the light of the combined beam smoothly transitions from the concentrated component to the divergent component as the divergent component surrounds the concentrated component.

The lens 24 is secured in a fixed position to the flashlight head 14, for example by means of an annular flange mount 26 about the front edge of the lens 24 affixed within a groove arrangement 28 of the head 14. The flange mount 26 radially extends from a flange section 27 (FIG. 2) immediately rearwardly of the lens front surface 34.

The LED 19 of the light source 18 is secured in a fixed position with respect to the lens 24. For example, a circuit board containing the LED chip 19 may be secured to a further circuit board fixed to the flashlight head 14 (or to the housing 12), the further circuit board containing flashlight circuitry which may include a controller for controlling operation of the LED 19 in combination with the switch 22 and battery 20.

Figure 2:
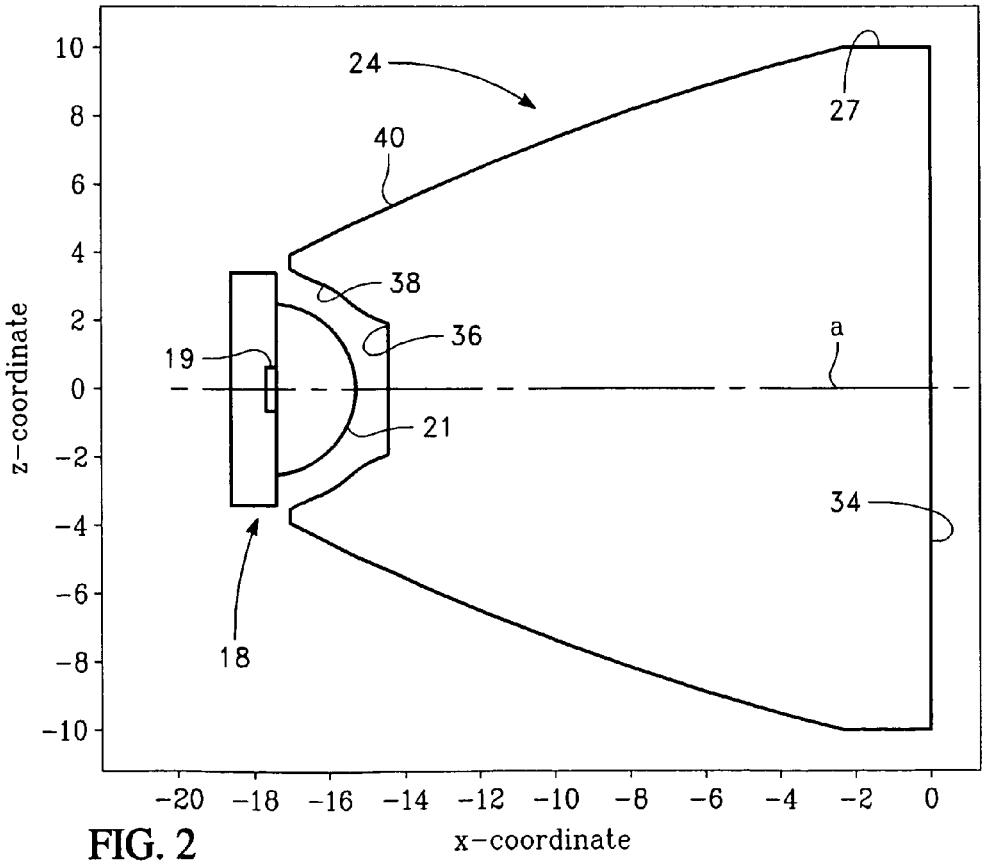
FIG. 2 shows the profile (in the x,z-plane) of a preferred lens embodiment included in the light assembly of FIG. 1, shown in operational relation to the light emitting diode (LED) light source of the light assembly.

The axisymmetric profile of the preferred embodiment of the lens 24, in the x,z-plane, is shown in FIG. 2 in greatly increased scale, with the x-coordinate corresponding to the symmetry axis of the lens 24 along its optical axis a and originating at the lens front surface 34, and with the z-axis representing radial distance from the optical axis. In the preferred lens embodiment, the x-coordinate and the z-coordinate are dimensioned in millimeters.

In addition to the front surface 34, the lens 24 includes a refractive first rear surface 36, preferably flat and orthogonally intersecting and symmetrical about the optical axis a, for receiving a first portion of the light emanating from the LED source 18 positioned along the optical axis a. An axisymmetric aspheric refractive second rear surface 38 of the lens 24 symmetrically extends about the first rear surface 36 for receiving a second portion of the light emanating from the LED light source 18. A total-internal reflection (TIR) side surface 40 of the lens 24 extends symmetrically about the optical axis a for total-internally reflecting and concentrating light received by the second rear surface. The diameter of the first rear surface 36, the axisymmetric profile of the second rear surface 38, and the axisymmetric profile of the TIR side surface 40 are related to one another for exiting at the front surface 34 the light beam comprising the first light component diverging from the optical axis combined with the concentrated second light component.

The preferred lens embodiment 24 was designed using the inverse engineering approach described by the present inventors John Bortz and Narkis Shatz in their published article *An inverse engineering perspective on nonimaging optical design*, Proc. SPIE, v. 2538, pp. 136-156 (1995), which article is incorporated herein by reference. This approach has been implemented in the NonImaging Concentrator Synthesis (NICOS) code, a software tool developed at Science Applications International Corporation (SAIC). The NICOS software is a high-fidelity, high-speed ray tracing code that computes radiometric and/or photometric quantities of interest for optical systems consisting of extended sources and combinations of reflective and/or refractive optical components. In its global-optimization mode, NICOS performs a search in which the shapes and relative orientations of one or more optical components are systematically varied within some multidimensional space of parameters until optimality of a user-specified radiometric or photometric performance measure is achieved.

The NICOS software was set up to maximize the flux within a 6° acceptance angle for producing the desired light beam having concentrated and divergent components within the combined beam resulting in a high intensity core beam surrounded by a smoothly transitioning lower intensity surround beam. Such computer maximization was conducted using the Dynamic Synthesis global optimization software subject to various constraints imposed upon the lens design, including flux distribution of the LED source, physical properties of the lens material, the diameter of the lens exit aperture or front surface 34, and the diameter of the lens entrance aperture or first rear surface 36.

Figure 3:
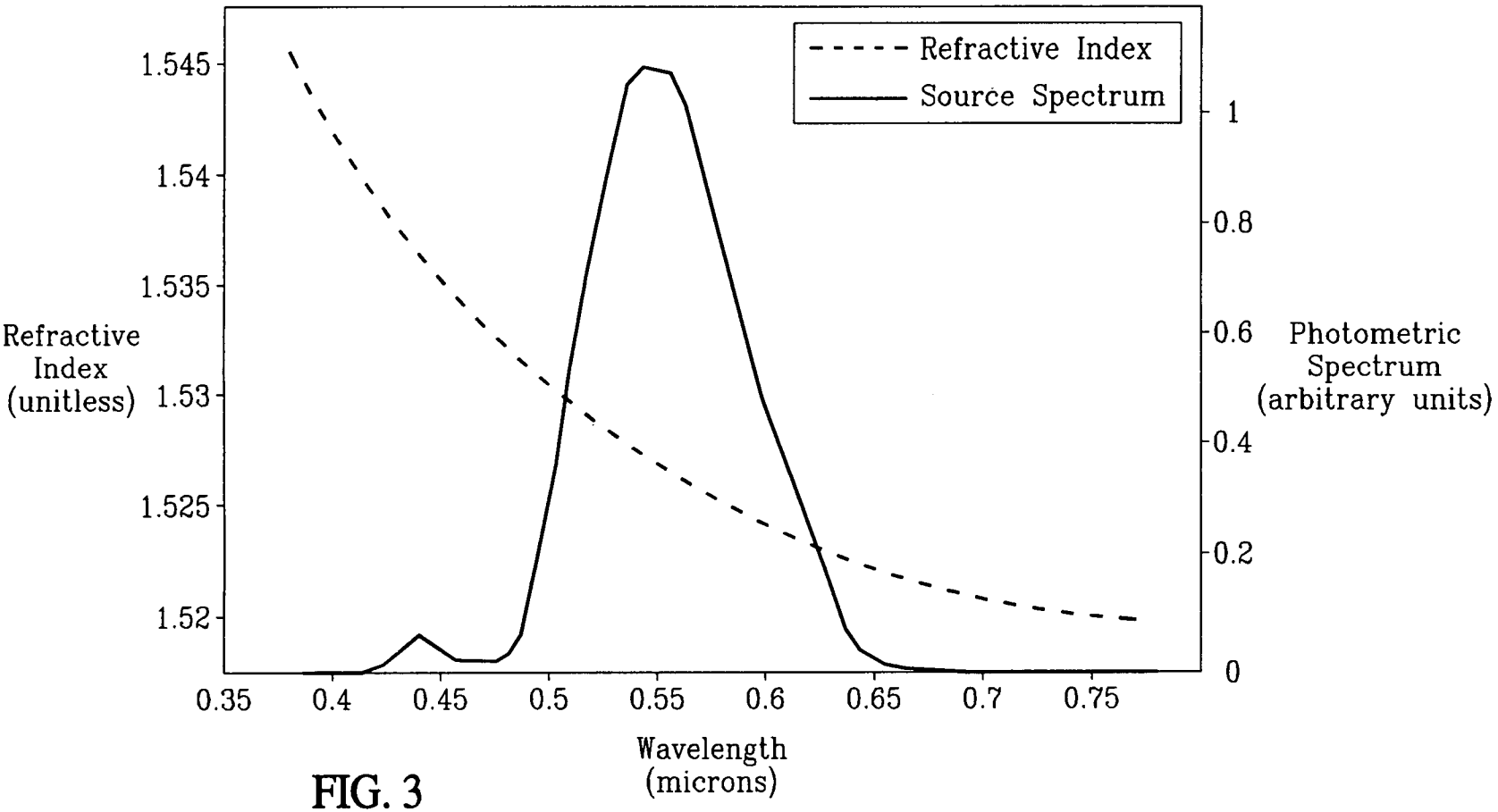
FIG. 3 is a graph depicting the assumed photometric source spectrum of the LED light source used in optimizing and analyzing the lens design of FIGS. 2, 12 and 21, together with the refractive index of the lens material as a function of wavelength.

The LED light source 18 employed was a Cree XR-E 7090 white LED marketed by Cree, Inc. (of Durham, N.C.). The photometric source spectrum of the LED used in optimizing and analyzing the lens design is depicted in FIG. 3. The assumed total lumen output of the LED source was 120 lumens. The LED 19 was of typical square configuration.

The material utilized for the lens 24 was a transparent optical plastic manufactured by ZEON Corporation (of Tokyo, Japan) and marketed under the ZEONEX registered trademark. The refractive index of the ZEONEX plastic lens material as a function of wavelength is shown in FIG. 3.

The diameter of the lens 24 exit aperture (the flat front surface 34) was selected as 20.0000 millimeters in the preferred example. The diameter of the lens entrance aperture (the flat first rear surface 36) was selected as 3.9342 millimeters, for allocating light from the LED light source such that approximately one-third of the light is received by the first rear surface 36 and approximately two-thirds of the light is received by the second rear surface 38.

The iterative search of the global-optimization process modifies the variable parameters for maximizing the flux within the specified acceptance angle. In particular, modifications were made to the distance along the optical axis a of the lens exit aperture (the flat front surface 34) to the lens entrance aperture (the flat first rear surface 36), the distance of the light source 18 (measured, for example, from the front plane of the LED chip 19) to the lens first rear surface 36, and the axisymmetric shapes of the lens second rear surface 38 and the lens TIR side surface 40, while light ray traces were generated for simulating the light beams that would result from the various combinations searched.

Figure 4:
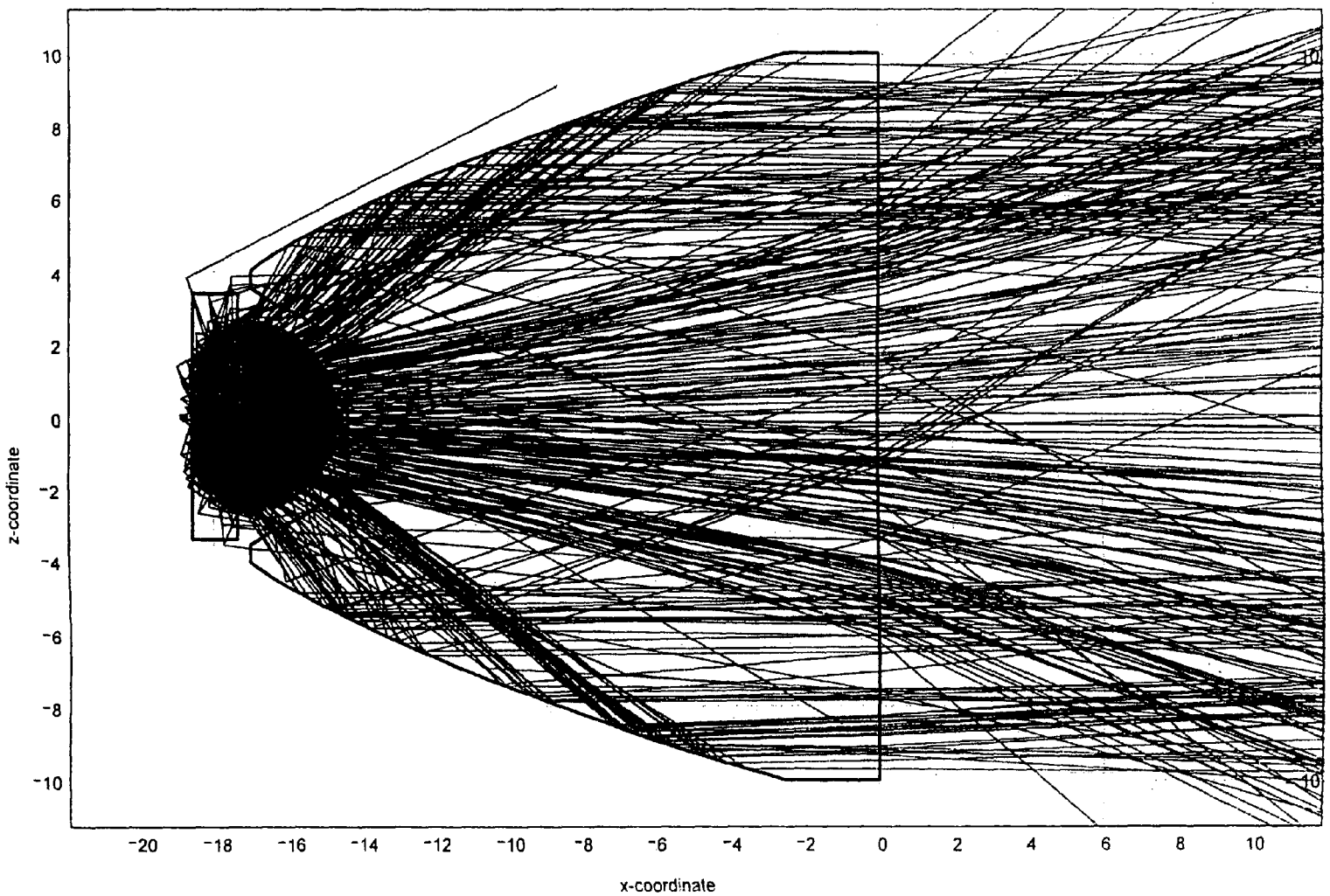
FIG. 4 depicts a computer simulated ray trace describing the light beam for the optimized lens shape and light source of FIG. 2.

The light ray trace for the resulting optimized lens shape is shown in FIG. 4. It is noted that the diameter of the entrance aperture (flat first rear surface 36) and its distance from the light source 18 determine the percentage of the light emitted from the source for producing the divergent light component (as shown in FIG. 4) and which is responsible for the surround beam, while the light rays which pass through the second rear surface 38 are total-internally reflected and substantially collimated (as shown in FIG. 4) by the TIR side surface 40 for producing the concentrated substantially collimated light component of the beam exiting from the lens front surface 34.

Figure 5:
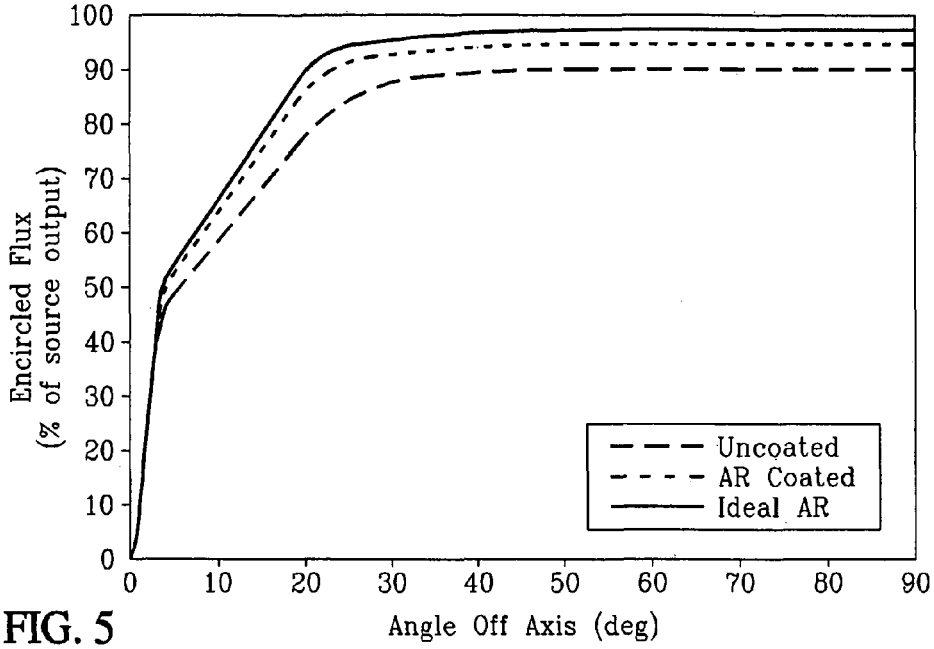
FIG. 5 shows a computer simulated analysis of normalized encircled flux versus angle for the light beam of FIG. 4.

FIG. 5 is a plot of the encircled flux (as a percentage of source output) versus beam half angle, for the optimized lens uncoated and adjusted for an antireflective (AR) coating and with ideal antireflection.

Figure 6:
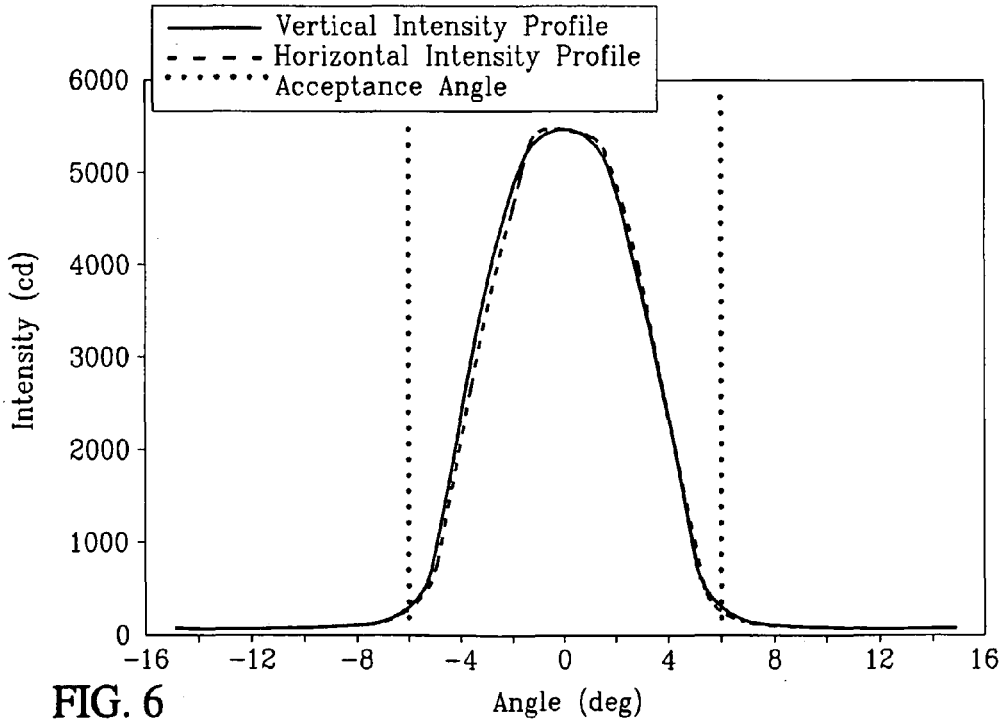
FIG. 6 shows a computer simulated analysis of the vertical and horizontal intensity profiles of the light beam of FIG. 4.
Figure 7:
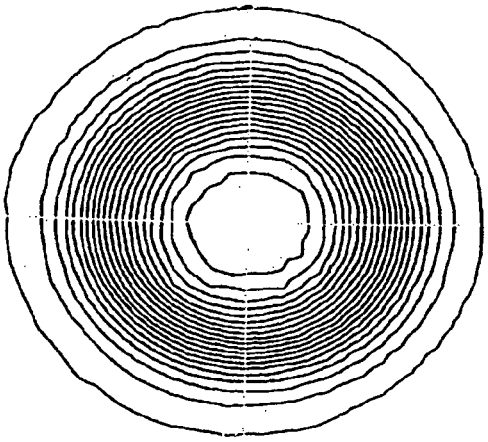
FIG. 7 is a computer simulated contour map showing the angular intensity distribution of the light beam of FIG. 4.

FIG. 6 is a computer simulated plot of intensity (in candelas) of the composite light beam produced by the optimized lens 24 with the indicated light source 18, as a function of angle (in degrees). The related angular intensity distribution contour map of FIG. 7 is representative of an important feature of the optimized lens shape of the invention, specifically the substantially circular spatial cross-section of the composite beam produced by the optimized lens from the substantially square LED source 19. The lens 24 effectively modifies the source light pattern so that the output beam is of substantially circular cross-section.

The axisymmetric profile of the lens 24 is described by sample points defined by the list of x, y-coordinate pairs set forth in FIGS. 8*a* and 8*b*. The x-coordinate represents position along the optical axis in the global coordinate system of the lens surface referenced from the front surface 34, and the y-coordinate (as does the z-coordinate noted in FIG. 2) represents radial position referenced from (i.e. distance away from) the optical axis. The global x-axis corresponds to the symmetry axis of the lens, and the sample points on the profile of the lens preferred embodiment is in millimeters with a sampling interval of 0.10 millimeters. The lens profile of the preferred embodiment provides for a 2.5 millimeter flange section 27 immediately rearwardly of the front surface 34 (located at x=0.0000), although a flange section 27 substantially greater or less than the noted 2.5 millimeters is possible; for example, a flange section of approximately 4.0 millimeters may be used with negligible effect on performance. The optimum placement of the LED 19 is at x=−17.3995 millimeters, or 2.9952 millimeters (i.e., approximately 3.0 millimeters) rearwardly of the first rear surface 36. With respect to the lens profile, intermediate points between any two sample points listed may be determined using a cubic spline.

As may be appreciated from FIGS. 8*a* and 8*b*, the first rear surface 36 of the lens 24 comprises a circular planar surface of (in the preferred lens embodiment where the x-coordinate and the y-coordinate are dimensioned in millimeters) radius 1.9671 millimeters rotationally symmetric about the x axis, and situated at x=−14.4043 millimeters. The lens front surface 34 comprises a circular planar surface of radius 10.0000 millimeters (in the preferred embodiment) rotationally symmetric about the x axis, and situated at x=0.0000. The lens second rear surface 38 and TIR side surface 40 are each rotationally symmetric about the x-axis.

The list of the x,y-coordinate pairs of sample points in FIG. 9 is specific to the profile of the aspheric refractive second rear surface 38 of the optimized lens 24, in millimeters for the preferred embodiment, and further lists the slope angles (in degrees) representing the angle of the tangent to the surface at each point, measured counterclockwise with respect to the x-axis in the global coordinate system.

The list of x,y-coordinate pairs of sample points in FIG. 10 is specific to the aspheric TIR side surface 40 of the lens 24, in millimeters in the preferred embodiment, further listing the slope angles (in degrees) at each point.

Figure 11:
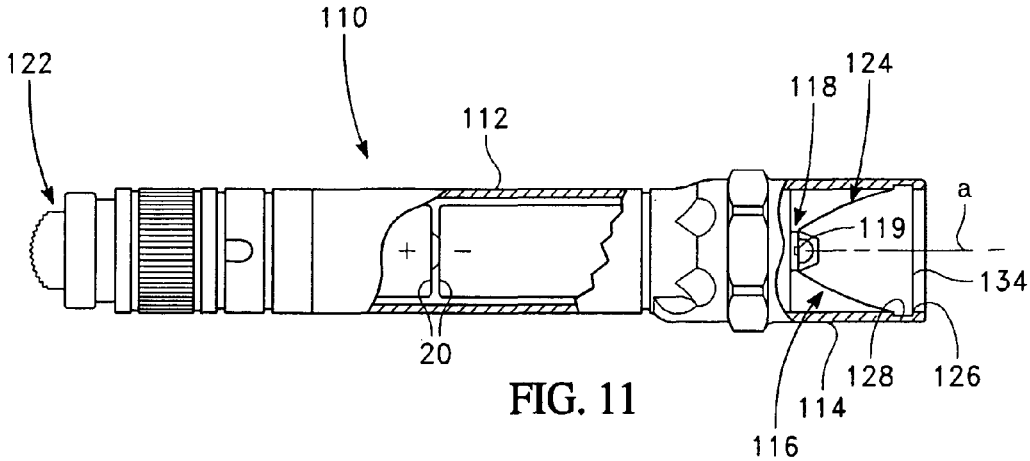
FIG. 11 is a partially cut-away side elevation view of a flashlight including a preferred embodiment of a nonimaging light assembly according to the aforementioned application Ser. No. 13/135,508.

Turning to FIG. 11, there is shown another example of a flashlight 110 including a generally cylindrical battery housing 112, a head 114 at the flashlight's front end including a light assembly 116 with a light source 118 in electrical circuit with a battery comprising at least one battery cell 120, and a switch 122 in circuit and actuable by a user for causing the battery 120 to energize the light source 118.

The light assembly 116 includes a total-internal reflection (TIR) lens 124 according to a preferred embodiment of the invention as disclosed in the aforementioned application Ser. No. 13/135,508. The lens 124 is rotationally symmetrical about its optical axis a, and is combined with the light source 118 including a light emitting diode (LED) 119, protected by a light-transmitting encapsulant dome 121, situated at the rear of the lens 124 along the optical axis a. The shape and material properties of the lens 124 are such that the lens 124 collects light from the LED source 118 and produces therefrom a light beam comprising an axisymmetrical first light component diverging from the optical axis combined with an axisymmetrical concentrated second light component. In the preferred lens configuration, the light of the combined beam smoothly transitions from the concentrated component to the divergent component as the divergent component surrounds the concentrated component.

The lens 124 is secured in a fixed position to the flashlight head 114, for example by means of an annular flange mount 126 about the front edge of the lens 124 affixed within a groove arrangement 128 of the head 114. The flange mount 126 radially extends from a flange section 127 (FIG. 12) immediately rearwardly of the lens front surface 134.

The LED 119 of the light source 118 is secured in a fixed position with respect to the lens 124. For example, a circuit board containing the LED chip 119 may be secured to a further circuit board fixed to the flashlight head 114 (or to the housing 112), the further circuit board containing flashlight circuitry which may include a controller for controlling operation of the LED 119 in combination with the switch 122 and battery 120.

Figure 12:
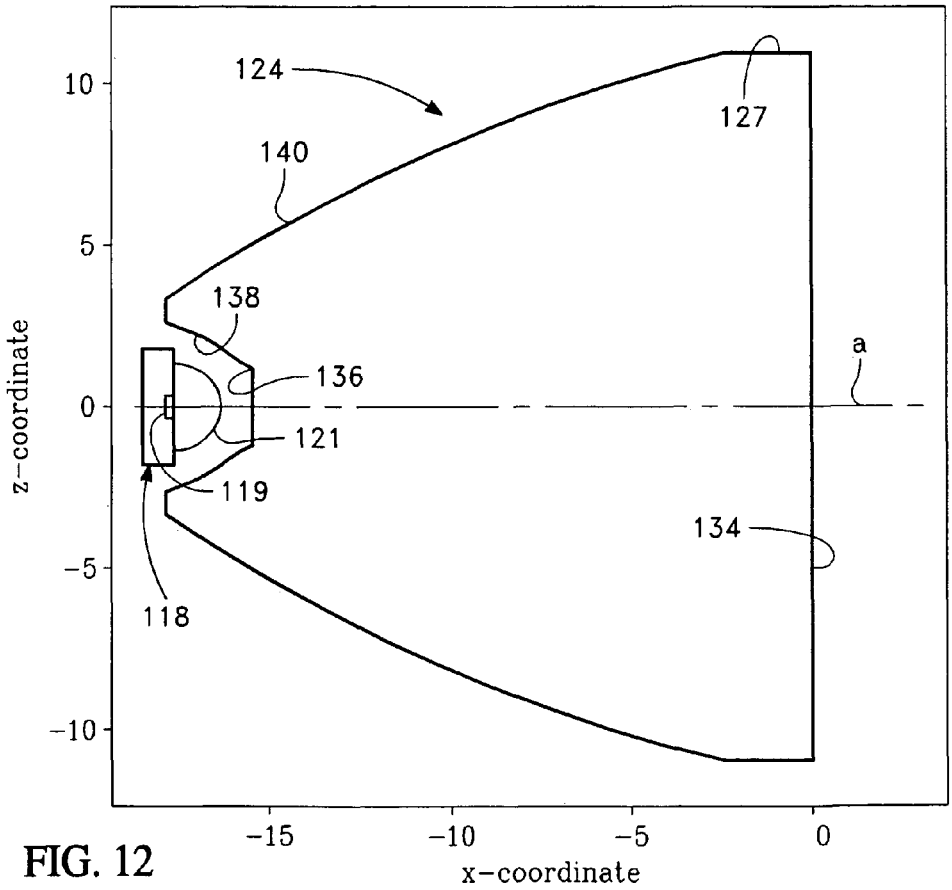
FIG. 12 shows the profile (in the x,z-plane) of a preferred lens embodiment included in the light assembly of FIG. 11, shown in operational relation to the light emitting diode (LED) light source of the light assembly.

The axisymmetric profile of the preferred embodiment of the lens 124, in the x,z-plane, is shown in FIG. 12 in greatly increased scale, with the x-coordinate corresponding to the symmetry axis of the lens 124 along its optical axis a and originating at the lens front surface 134, and with the z-axis representing radial distance from the optical axis. In the preferred lens embodiment, the x-coordinate and the z-coordinate are dimensioned in millimeters.

In addition to the front surface 134, the lens 124 includes a refractive first rear surface 136, preferably flat and orthogonally intersecting and symmetrical about the optical axis a, for receiving a first portion of the light emanating from the LED source 118 positioned along the optical axis a. An axisymmetric aspheric refractive second rear surface 138 of the lens 124 symmetrically extends about the first rear surface 136 for receiving a second portion of the light emanating from the LED light source 118. A total-internal reflection (TIR) side surface 140 of the lens 124 extends symmetrically about the optical axis a for total-internally reflecting and concentrating light received by the second rear surface. The diameter of the first rear surface 136, the axisymmetric profile of the second rear surface 138, and the axisymmetric profile of the TIR side surface 140 are related to one another for exiting at the front surface 134 the light beam comprising the first light component diverging from the optical axis combined with the concentrated second light component.

The preferred lens embodiment 124 was designed using the inverse engineering approach implemented in the NICOS software, as discussed above with respect to the designing of the preferred embodiment of the lens 24.

For designing the preferred lens embodiment 124, the NICOS software was set up to maximize the flux within a 4° acceptance angle for producing the desired light beam having concentrated and divergent components within the combined beam resulting in a high intensity core beam surrounded by a smoothly transitioning lower intensity surround beam. Such computer maximization was conducted using the Dynamic Synthesis global optimization software subject to various constraints imposed upon the lens design, including flux distribution of the LED source, physical properties of the lens material, the diameter of the lens exit aperture or front surface 134, and the diameter of the lens entrance aperture or first rear surface 136.

The LED light source 118 employed was a Cree XP-E white LED marketed by Cree, Inc. (of Durham, N.C.). The photometric source spectrum of the LED used in optimizing and analyzing the lens design is depicted in FIG. 3. The assumed total lumen output of the LED source was 120 lumens. The LED 119 was of typical square configuration.

The material utilized for the lens 124 was a transparent optical plastic manufactured by ZEON Corporation (of Tokyo, Japan) and marketed under the ZEONEX registered trademark. The refractive index of the ZEONEX plastic lens material as a function of wavelength is shown in FIG. 3.

The diameter of the lens exit aperture (the flat front surface 134) was selected as 22.000 millimeters in the preferred example. The diameter of the lens entrance aperture (the flat first rear surface 136) was selected as 2.431 millimeters, for allocating light from the LED light source such that approximately one-third of the light is received by the first rear surface 136 and approximately two-thirds of the light is received by the second rear surface 138.

The iterative search of the global-optimization process modifies the variable parameters for maximizing the flux within the specified acceptance angle. In particular, modifications were made to the distance along the optical axis a of the lens exit aperture (the flat front surface 134) to the lens entrance aperture (the flat first rear surface 136), the distance of the light source 118 (measured, for example, from the front plane of the LED chip 119) to the lens first rear surface 136, and the axisymmetric shapes of the lens second rear surface 138 and the lens TIR side surface 140, while light ray traces were generated for simulating the light beams that would result from the various combinations searched.

Figure 13:
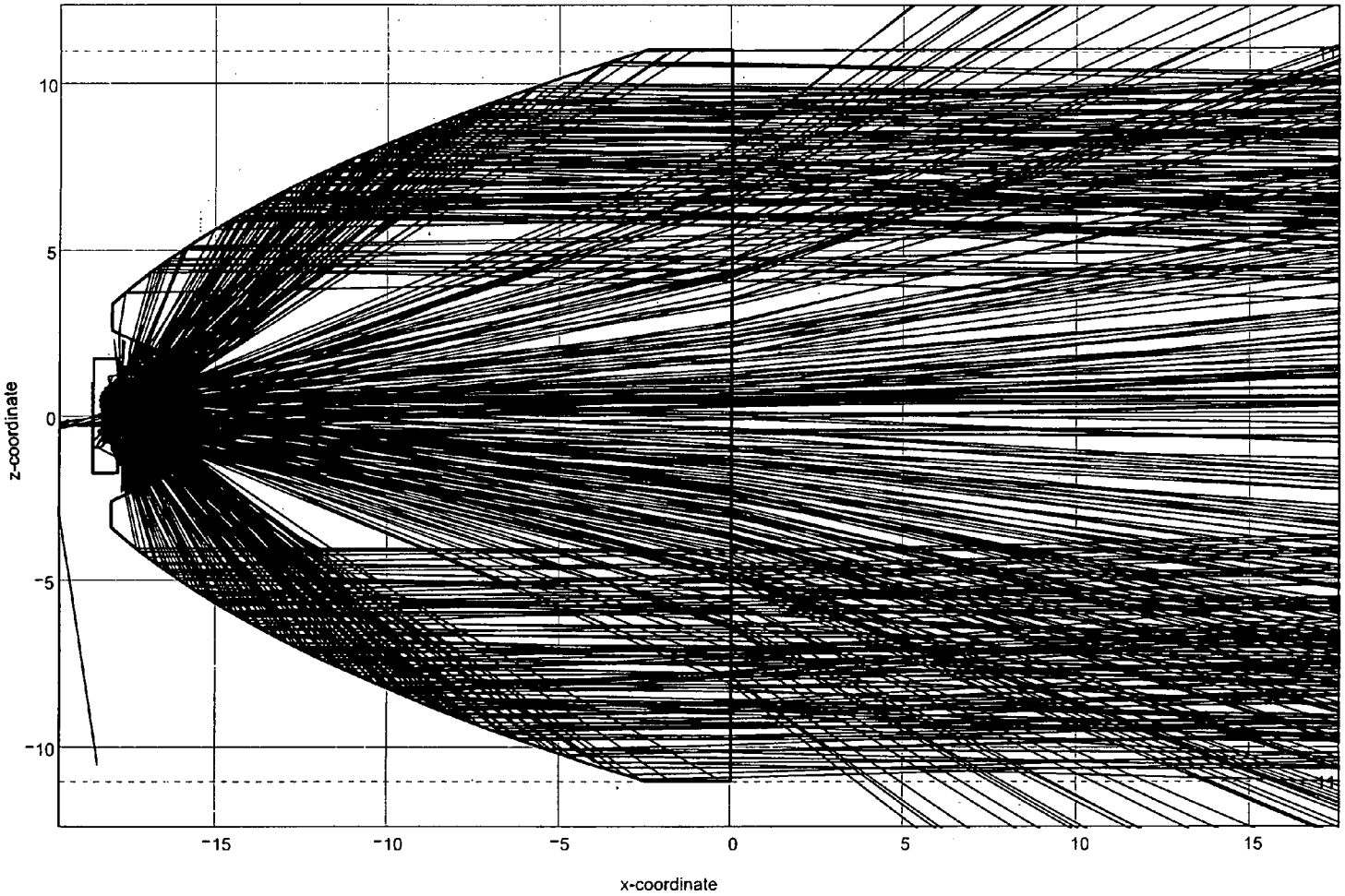
FIG. 13 depicts a computer simulated ray trace describing the light beam for the optimized lens shape and light source of FIG. 12.

The light ray trace for the resulting optimized lens shape is shown in FIG. 13. It is noted that the diameter of the entrance aperture (flat first rear surface 136) and its distance from the light source 118 determine the percentage of the light emitted from the source for producing the divergent light component (as shown in FIG. 13) and which is responsible for the surround beam, while the light rays which pass through the second rear surface 138 are total-internally reflected and substantially collimated (as shown in FIG. 13) by the TIR side surface 140 for producing the concentrated substantially collimated light component of the beam exiting from the lens front surface 134.

Figure 14:
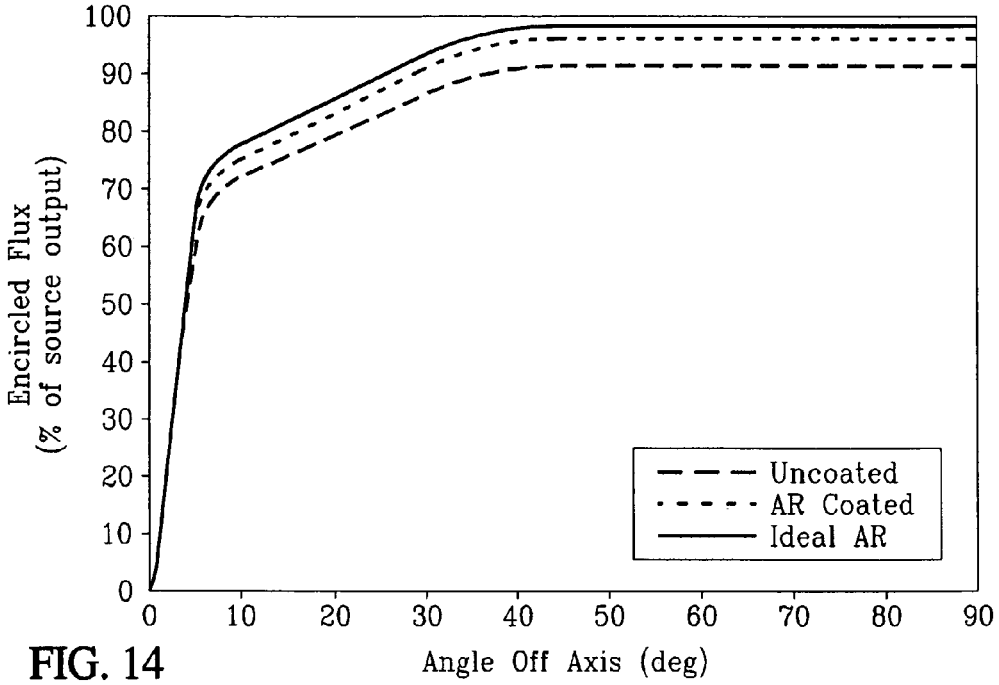
FIG. 14 shows a computer simulated analysis of normalized encircled flux versus angle for the light beam of FIG. 13.

FIG. 14 is a plot of the encircled flux (as a percentage of source output) versus beam half angle, for the optimized lens uncoated and adjusted for an antireflective (AR) coating and with ideal antireflection.

Figure 16:
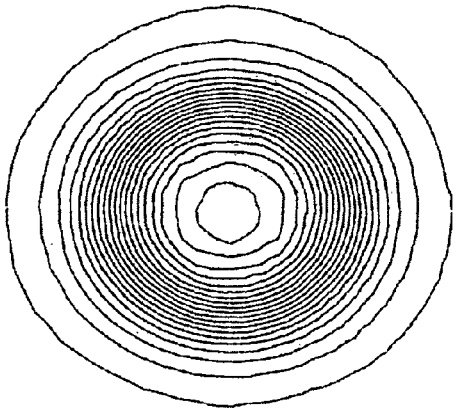
FIG. 16 is a computer simulated contour map showing the angular intensity distribution of the light beam of FIG. 13.
Figure 15:
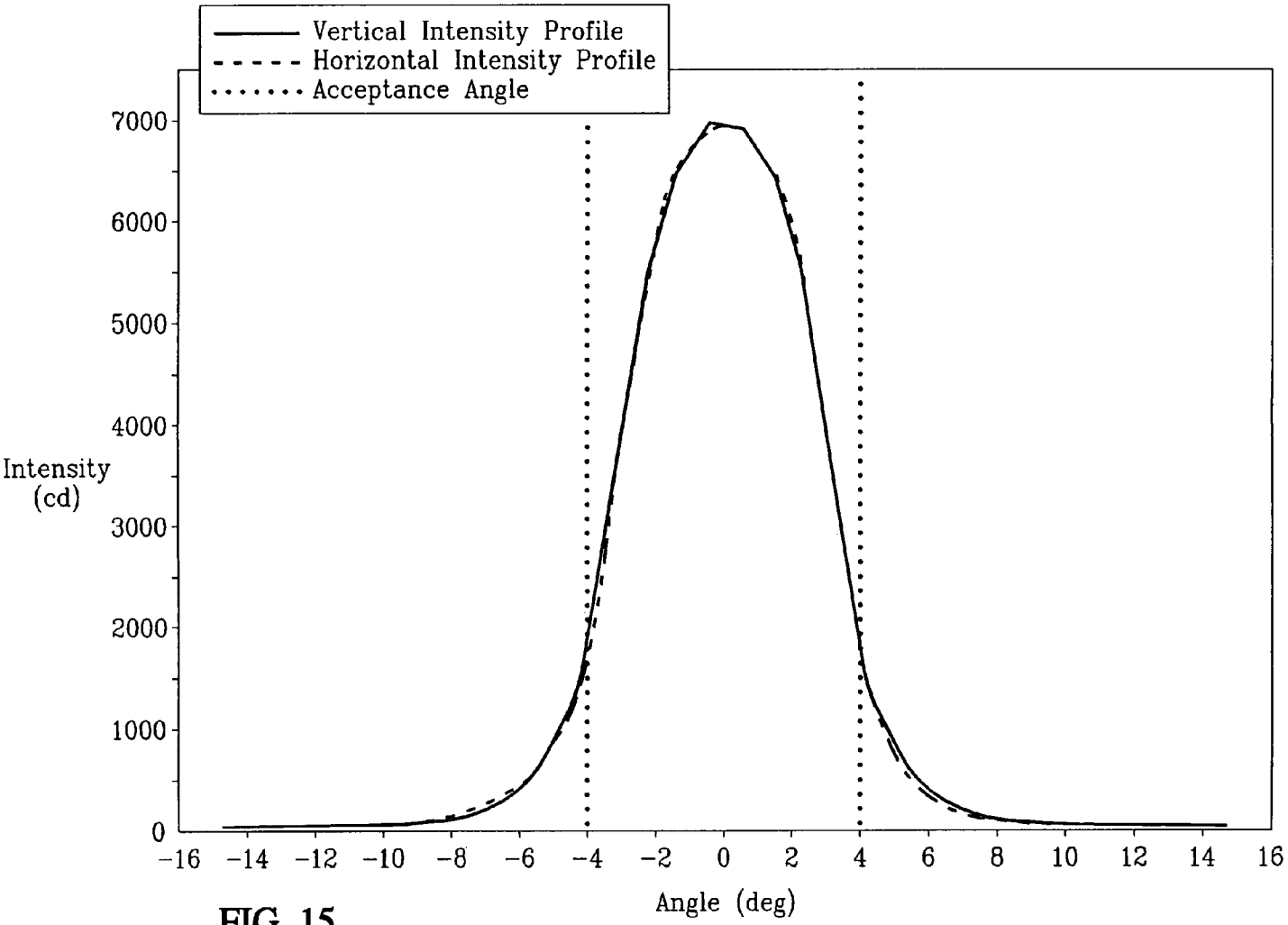
FIG. 15 shows a computer simulated analysis of the vertical and horizontal intensity profiles of the light beam of FIG. 13.

FIG. 15 is a computer simulated plot of intensity (in candelas) of the composite light beam produced by the optimized lens 124 with the indicated light source 118, as a function of angle (in degrees). The related angular intensity distribution contour map of FIG. 16 is representative of an important feature of the optimized lens shape of the present invention, specifically the substantially circular spatial cross-section of the composite beam produced by the optimized lens from the substantially square LED source 119. The lens 124 effectively modifies the source light pattern so that the output beam is of substantially circular cross-section.

The axisymmetric profile of the lens 124 is substantially described by sample points defined by the list of x,y-coordinate pairs set forth in FIGS. 17*a* and 17*b*. The x-coordinate represents position along the optical axis in the global coordinate system of the lens surface referenced from the front surface 134, and the y-coordinate (as does the z-coordinate noted in FIG. 12) represents radial position referenced from (i.e. distance away from) the optical axis. The global x-axis corresponds to the symmetry axis of the lens, and the sample points on the profile of the lens preferred embodiment is in millimeters with a sampling interval of 0.10 millimeters. The lens profile of the preferred embodiment provides for a 2.5 millimeter flange section 127 immediately rearwardly of the front surface 134 (located at x=0.000), although a flange section 127 substantially greater or less than the noted 2.5 millimeters is possible; for example, a flange section of approximately 4.0 millimeters may be used with negligible effect on performance. The optimum placement of the LED 119 is at x=−17.853 millimeters, or 2.268 millimeters (i.e. approximately 2.3 millimeters) rearwardly of the first rear surface 136. With respect to the lens profile, intermediate points between any two sample points listed may be determined using a cubic spline.

As may be appreciated from FIGS. 17*a* and 17*b*, the first rear surface 136 of the lens 124 comprises a circular planar surface of (in the preferred lens embodiment where the x-coordinate and the y-coordinate are dimensioned in millimeters) radius 1.215 millimeters rotationally symmetric about the x axis, and situated at x=−15.585 millimeters. The lens front surface 134 comprises a circular planar surface of radius 11.000 millimeters (in the preferred embodiment) rotationally symmetric about the x axis, and situated at x=0.000. The lens second rear surface 138 and TIR side surface 140 are each rotationally symmetric about the x-axis.

The list of the x,y-coordinate pairs of sample points in FIG. 18 is specific to the profile of the aspheric refractive second rear surface 138 of the optimized lens 124, in millimeters for the preferred embodiment.

The list of x,y-coordinate pairs of sample points in FIG. 19 is specific to the aspheric TIR side surface 140 of the lens 124, in millimeters for the preferred embodiment.

Figure 20:
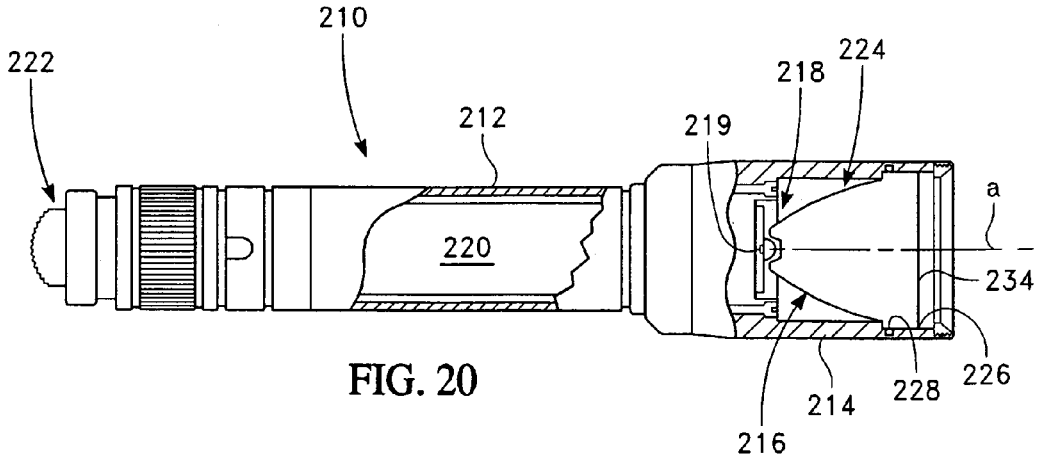
FIG. 20 is a partially cut-away side elevation view of a flashlight including a preferred embodiment of a nonimaging light assembly according to the aforementioned application Ser. No. 13/373,320.

Turning to FIG. 20, there is shown another example of a flashlight 210 including a generally cylindrical battery housing 212, a head 214 at the flashlight's front end including a light assembly 216 with a light source 218 in electrical circuit with a battery 220, and a switch 222 in circuit and actuable by a user for causing the battery 220 to energize the light source 218.

The light assembly 216 includes a total-internal reflection (TIR) lens 224 according to a preferred embodiment of the invention as disclosed in the aforementioned application Ser. No. 13/373,320. The lens 224 is rotationally symmetrical about its optical axis a, and is combined with the light source 218 including a light emitting diode (LED) 219, protected by a light-transmitting encapsulant dome 221, situated at the rear of the lens 224 along the optical axis a. The shape and material properties of the lens 224 are such that the lens 224 collects light from the LED source 218 and produces therefrom a light beam comprising an axisymmetrical first light component diverging from the optical axis combined with an axisymmetrical concentrated second light component. In the preferred lens configuration, the light of the combined beam smoothly transitions from the concentrated component to the divergent component as the divergent component surrounds the concentrated component.

The lens 224 is secured in a fixed position to the flashlight head 214, for example by means of an annular flange mount 226 about the front edge of the lens 224 affixed within a groove arrangement 228 of the head 214. The flange mount 226 radially extends from a flange section 227 (FIG. 21) forwardly of the lens TIR side surface 240 and rearwardly of the lens front surface 234, preferably immediately rearwardly of the lens front surface 234.

The LED 219 of the light source 218 is secured in a fixed position with respect to the lens 224. For example, a circuit board containing the LED chip 219 may be secured to a further circuit board fixed to the flashlight head 214 (or to the housing 212), the further circuit board containing flashlight circuitry which may include a controller for controlling operation of the LED 219 in combination with the switch 222 and battery 220.

Figure 21:
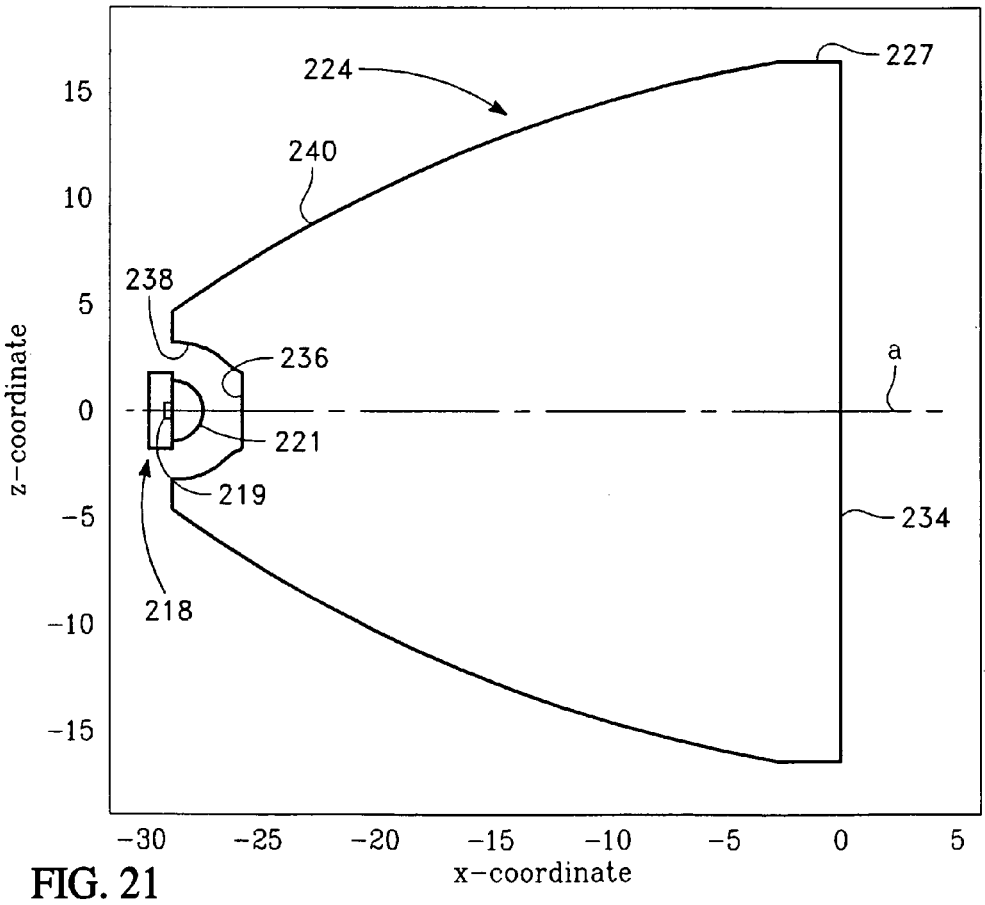
FIG. 21 shows the profile (in the x,z-plane) of a preferred lens embodiment included in the light assembly of FIG. 20, shown in operational relation to the light emitting diode (LED) light source of the light assembly.

The axisymmetric profile of the preferred embodiment of the lens 224, in the x,z-plane, is shown in FIG. 21 in greatly increased scale, with the x-coordinate corresponding to the symmetry axis of the lens 224 along its optical axis a and originating (in the example shown in FIG. 21) at the lens front surface 234, and with the z-axis representing radial distance from the optical axis. In the preferred lens embodiment, the x-coordinate and the z-coordinate are dimensioned in millimeters.

In addition to the front surface 234, the lens 224 includes a refractive first rear surface 236, preferably flat and orthogonally intersecting and symmetrical about the optical axis a, for receiving a first portion of the light emanating from the LED source 218 positioned along the optical axis a. An axisymmetric aspheric refractive second rear surface 238 of the lens 224 symmetrically extends about the first rear surface 236 for receiving a second portion of the light emanating from the LED light source 218. A total-internal reflection (TIR) side surface 240 of the lens 224 extends symmetrically about the optical axis a for total-internally reflecting and concentrating light received by the second rear surface. The diameter of the first rear surface 236, the axisymmetric profile of the second rear surface 238, and the axisymmetric profile of the TIR side surface 240 are related to one another for exiting at the front surface 234 the light beam comprising the first light component diverging from the optical axis combined with the concentrated second light component.

The preferred lens embodiment 224 was designed using the inverse engineering approach implemented in the NICOS software, as discussed above with respect to the designing of the preferred embodiment of the lens 24.

For designing the preferred lens embodiment 224, the NICOS software was set up to maximize the flux within a 4° acceptance angle for producing the desired light beam having concentrated and divergent components within the combined beam resulting in a high intensity core beam surrounded by a smoothly transitioning lower intensity surround beam. Such computer maximization was conducted using the Dynamic Synthesis global optimization software subject to various constraints imposed upon the lens design, including flux distribution of the LED source, physical properties of the lens material, the diameter of the lens exit aperture or front surface 234, and the diameter of the lens entrance aperture or first rear surface 236.

The LED light source 218 employed was a Cree XP-G white LED marketed by Cree, Inc. (of Durham, N.C.). The photometric source spectrum of the LED used in optimizing and analyzing the lens design is depicted in FIG. 3. The assumed total lumen output of the LED source was 345 lumens. The LED 219 was of typical square configuration.

The material utilized for the lens 224 was a transparent optical plastic manufactured by ZEON Corporation (of Tokyo, Japan) and marketed under the ZEONEX registered trademark. The refractive index of the ZEONEX plastic lens material as a function of wavelength is shown in FIG. 3.

The diameter of the lens exit aperture (the flat front surface 234) was selected as 33.0 millimeters in the preferred example. The diameter of the lens entrance aperture (the flat first rear surface 236) was selected as 3.326 millimeters, for allocating light from the LED light source such that approximately one-third of the light is received by the first rear surface 236 and approximately two-thirds of the light is received by the second rear surface 238.

The iterative search of the global-optimization process modifies the variable parameters for maximizing the flux within the specified acceptance angle. In particular, modifications were made to the distance along the optical axis a of the lens exit aperture (the flat front surface 234) to the lens entrance aperture (the flat first rear surface 236), the distance of the light source 218 (measured, for example, from the front plane of the LED chip 219) to the lens first rear surface 236, and the axisymmetric shapes of the lens second rear surface 238 and the lens TIR side surface 240, while light ray traces were generated for simulating the light beams that would result from the various combinations searched.

Figure 22:
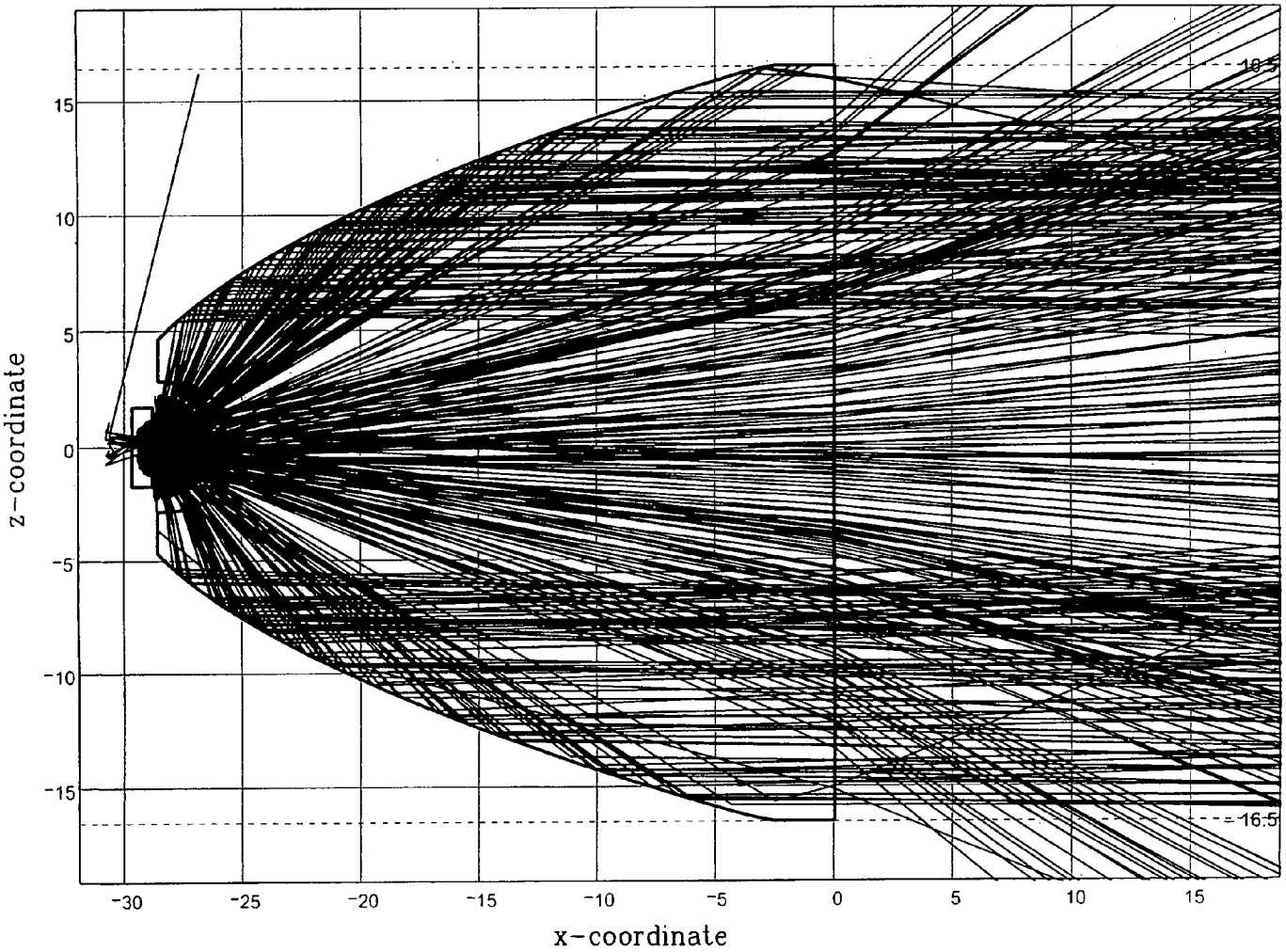
FIG. 22 depicts a computer simulated ray trace describing the light beam for the optimized lens shape and light source of FIG. 21.

The light ray trace for the resulting optimized lens shape is shown in FIG. 22. It is noted that the diameter of the entrance aperture (flat first rear surface 236) and its distance from the light source 218 determine the percentage of the light emitted from the source for producing the divergent light component (as shown in FIG. 22) and which is responsible for the surround beam, while the light rays which pass through the second rear surface 238 are total-internally reflected and substantially collimated (as shown in FIG. 22) by the TIR side surface 240 for producing the concentrated substantially collimated light component of the beam exiting from the lens front surface 234.

Figure 23:
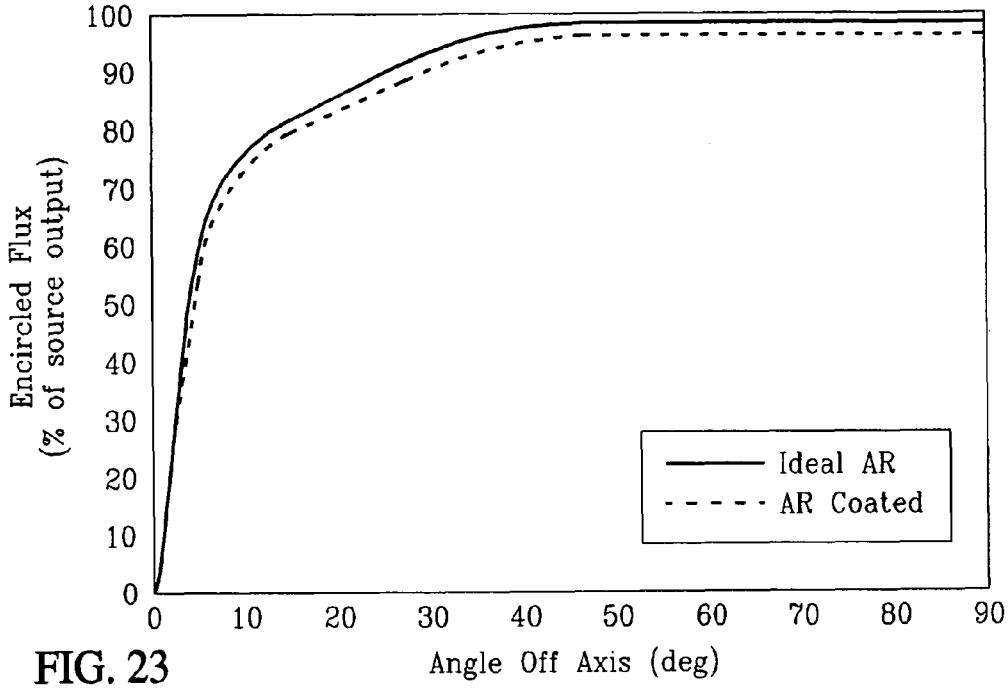
FIG. 23 shows a computer simulated analysis of normalized encircled flux versus angle for the light beam of FIG. 22.

FIG. 23 is a plot of the encircled flux (as a percentage of source output) versus beam half angle, for the optimized lens adjusted for an antireflective (AR) coating and with ideal antireflection.

Figure 25:
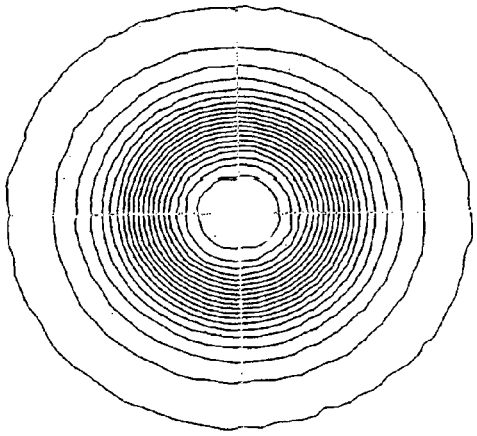
FIG. 25 is a computer simulated contour map showing the angular intensity distribution of the light beam of FIG. 22.
Figure 24:
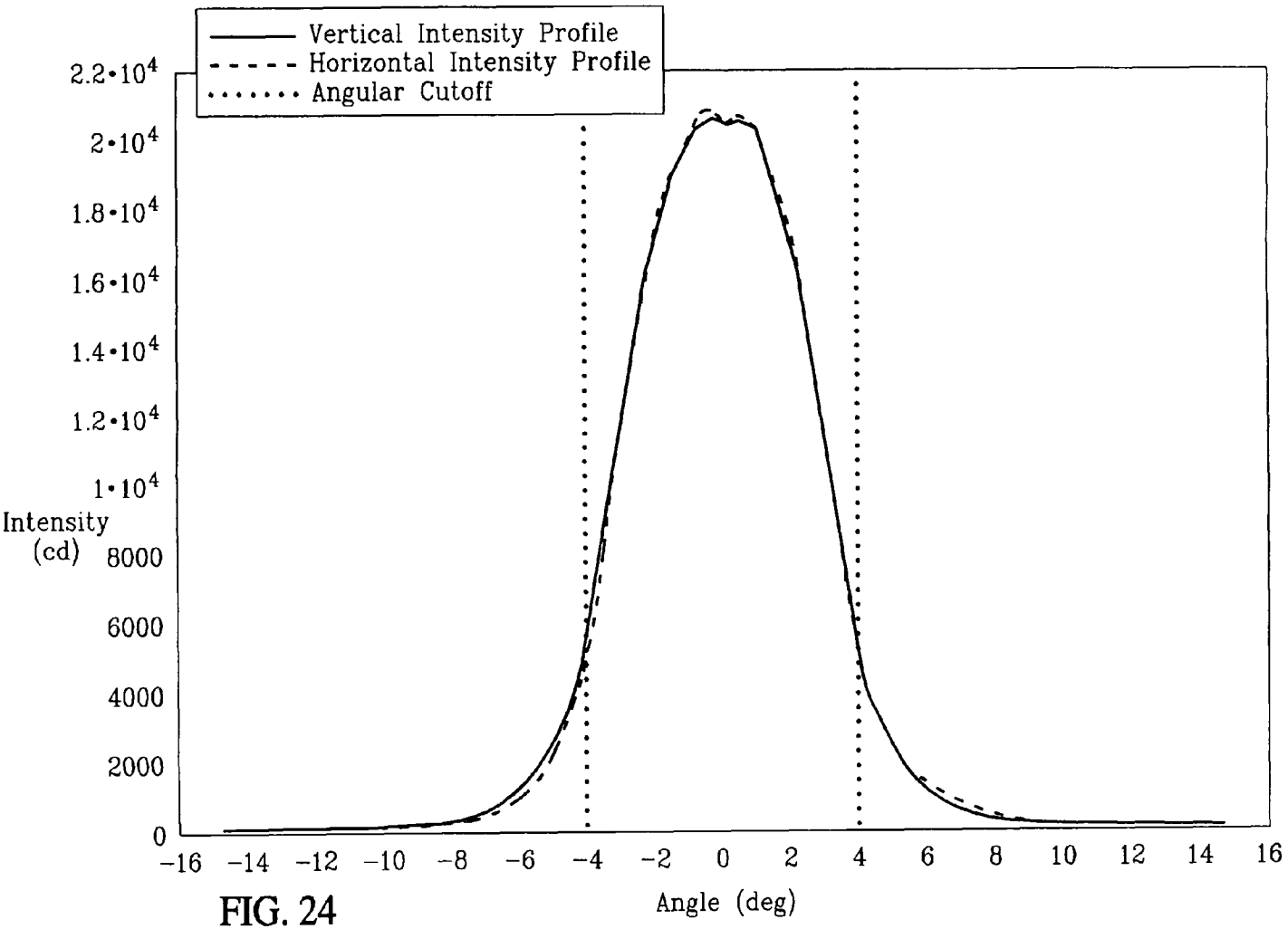
FIG. 24 shows a computer simulated analysis of the vertical and horizontal intensity profiles of the light beam of FIG. 22.

FIG. 24 is a computer simulated plot of intensity (in candelas) of the composite light beam produced by the optimized lens 224 with the indicated light source 218, as a function of angle (in degrees). The related angular intensity distribution contour map of FIG. 25 is representative of an important feature of the optimized lens shape of the present invention, specifically the substantially circular spatial cross-section of the composite beam produced by the optimized lens from the substantially square LED source 219. The lens 224 effectively modifies the source light pattern so that the output beam is of substantially circular cross-section.

The axisymmetric profile of the lens 224 is substantially described by sample points defined by the list of x,y-coordinate pairs set forth in FIGS. 27*a*, 27*b*, 27*c* and 27*d*. The x-coordinate represents position along the optical axis in the global coordinate system of the lens surface referenced from the front surface 234 (located at x=0.000), and the y-coordinate (as does the z-coordinate noted in FIG. 21) represents radial position referenced from (i.e. distance away from) the optical axis. The global x-axis corresponds to the symmetry axis of the lens, and the sample points on the profile of the lens preferred embodiment is in millimeters with a sampling interval of 0.10 millimeters. The lens profile of the preferred embodiment provides for a 2.5 millimeter flange section 227 immediately rearwardly of the front surface 234. The optimum placement of the LED 219 is at x=−28.832 millimeters, or 3.024 millimeters (i.e. approximately 3.0 millimeters) rearwardly of the first rear surface 236. With respect to the lens profile, intermediate points between any two sample points listed may be determined using a cubic spline.

As may be appreciated from FIGS. 27*a*-27*d*, the first rear surface 236 of the lens 224 comprises a circular planar surface of (in the preferred lens embodiment where the x-coordinate and the y-coordinate are dimensioned in millimeters) radius 1.663 millimeters rotationally symmetric about the x axis, and situated at x=−25.808 millimeters. The lens front surface 234 comprises a circular planar surface of radius 16.500 millimeters (in the preferred embodiment) rotationally symmetric about the x axis, and situated at x=0.000. The lens second rear surface 238 and TIR side surface 240 are each rotationally symmetric about the x-axis.

In designing the preferred embodiment of the lens 224 shown in FIG. 21, the thickness of the flange section 227 forwardly of the TIR side surface 240 (i.e., along the x-coordinate) was assumed to be 2.5 millimeters. However, a flange section 227 significantly greater or less than the noted 2.5 millimeters may be provided with negligible effect on performance.

Figure 26:
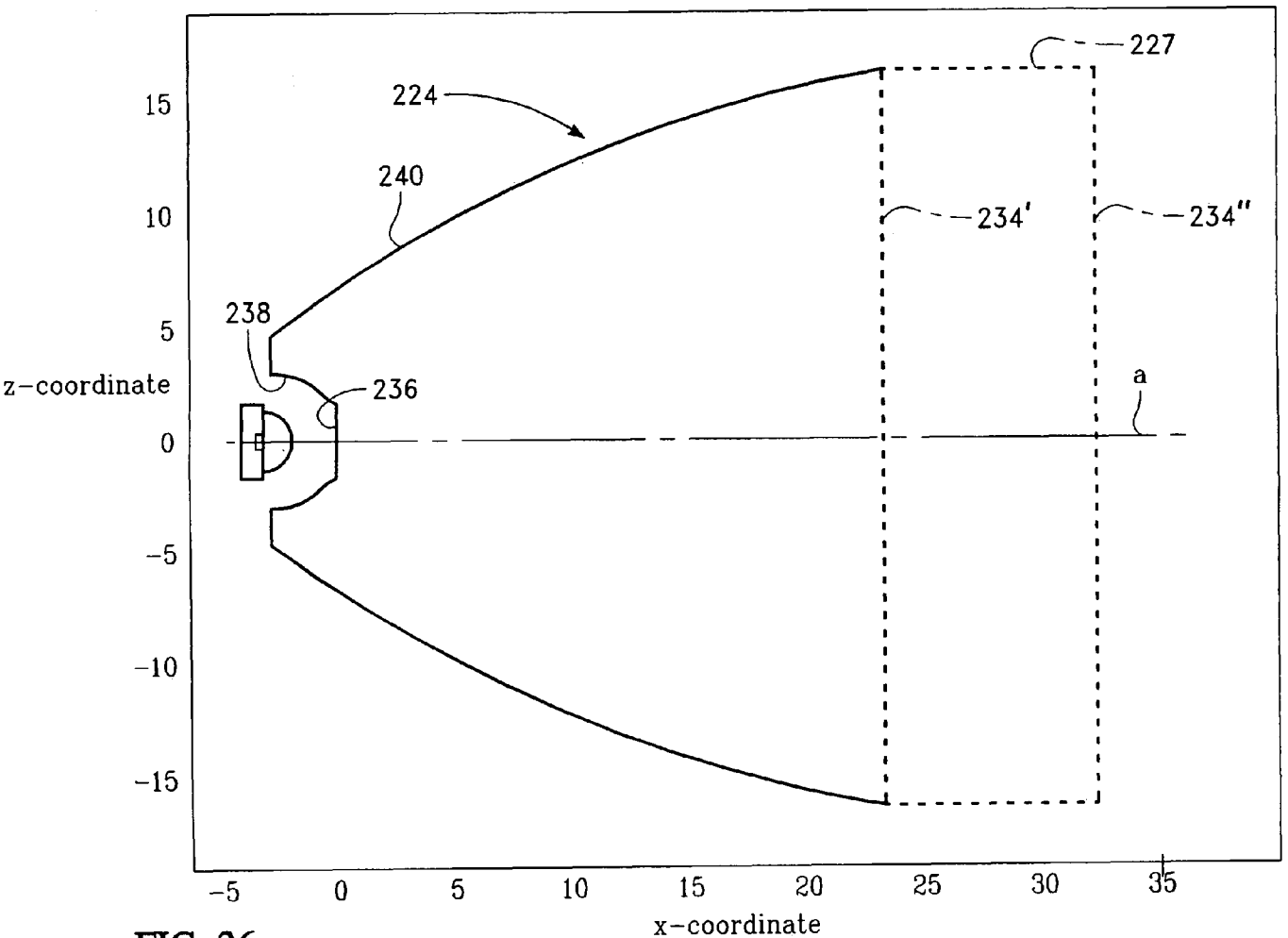
FIG. 26 shows the profile (in the x,z-plane) of the lens of FIG. 21, indicating thickness variance of the flange section.

FIG. 26 shows the lens 224 of FIG. 21, with the same profiles of the first rear surface 236, second rear surface 238 and TIR side surface 240. FIG. 26 is representative of a lens 224 in which the front surface 234' is located at the front end of the TIR side surface 240, or at a selected distance (indicated by the front surface 234") along the x-coordinate forwardly of the TIR side surface 240 to provide a flange section 227 of selected thickness. For a lens 224 having a flange section 227, such flange section 227 would be forwardly of the TIR side surface 240 and rearwardly of the front surface 234". For example, a flange section 227 of 9.0 millimeters thickness (in a preferred lens embodiment 224 with the x-coordinate dimensioned in millimeters) may be used in the present light assembly with negligible effect on performance.

The axisymmetric profile of the first rear surface 236, the second rear surface 238 and the TIR side surface 240 of the lens 224, as shown in FIG. 26, is substantially described by sample points defined by the list of x,y-coordinate pairs set forth in FIGS. 28*a*, 28*b* and 28*c*. The x-coordinate represents position along the optical axis in the global coordinate system of the lens surface referenced from the first rear surface (located at x=0.000), and the y-coordinate (as does the z-coordinate noted in FIG. 26) represents radial position referenced from (i.e. distance away from) the optical axis. The global x-axis corresponds to the symmetry axis of the lens, and the sample points on the profile of the lens preferred embodiment is in millimeters with a sampling interval of 0.10 millimeters. The optimum placement of the LED 219 is at x=−3.024 millimeters, or 3.024 millimeters (i.e. approximately 3.0 millimeters) rearwardly of the first rear surface 236. With respect to the lens profile, intermediate points between any two sample points listed may be determined using a cubic spline.

As may be appreciated from FIGS. 28*a*-28*c*, the first rear surface 236 of the lens 224 comprises a circular planar surface of (in the preferred lens embodiment where the x-coordinate and the y-coordinate are dimensioned in millimeters) radius 1.663 millimeters rotationally symmetric about the x axis, and situated at x=0.000. The lens front surface 234, as previously described in FIGS. 27*a*-27*d*, comprises a circular planar surface of radius 16.500 millimeters (in the preferred embodiment) rotationally symmetric about the x axis. The lens second rear surface 238 and TIR side surface 240 are each rotationally symmetric about the x-axis.

The list of the x,y-coordinate pairs of sample points in FIG. 29 is specific to the axisymmetric profile of the aspheric refractive second rear surface 238 of the optimized lens 224 shown in FIG. 26, in millimeters for the preferred embodiment.

The list of x,y-coordinate pairs of sample points in FIGS. 30*a* and 30*b* is specific to the aspheric axisymmetric profile of the TIR side surface 240 of the lens 224 shown in FIG. 26, in millimeters for the preferred embodiment.

Figure 31:
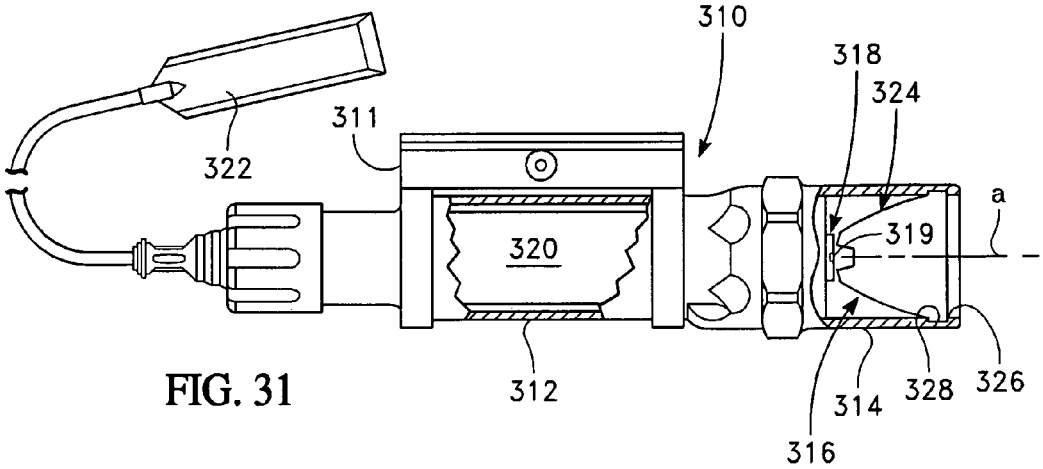
FIG. 31 is a partially cut-away side elevation view of a flashlight including a preferred embodiment of a nonimaging light assembly according to the present invention.

Turning to FIG. 31, there is shown another example of a flashlight 310 including a housing 312, a head 314 at the flashlight's front end including a light assembly 316 with a light source 318 in electrical circuit with a battery 320, and a switch 322 (shown as a remote tape switch) in circuit and actuable by a user for causing the battery 320 to energize the light source 318.

Although the light assembly 316 may be utilized with a flashlight of the normally hand-held type exemplified in FIGS. 1, 11 and 20, the flashlight 310 is illustrated in FIG. 31 as a type that may be secured to a weapon or other device or object. Such securement may be accomplished, for example, by means of a mounting device 311 secured to the housing 312 for releasably securing the flashlight 310 to a rail mount structure secured to a weapon, as described in U.S. Pat. No. 7,273,292. Examples of other types of flashlights securable to a weapon or other device or object, in which the light sources described herein may be utilized, are shown in U.S. Pat. Nos. 7,722,205; 7,117,624; 6,994,449; and 6,712,485.

The light assembly 316 includes a total-internal reflection (TIR) lens 324 according to a preferred embodiment of the present invention. The lens 324 is rotationally symmetrical about its optical axis a, and is combined with the light source 318 including a light emitting diode (LED) 319 situated at the rear of the lens 324 along the optical axis a. The shape and material properties of the lens 324 are such that the lens 324 collects light from the LED source 318 and produces therefrom a light beam comprising an axisymmetrical first light component diverging from the optical axis combined with an axisymmetrical concentrated second light component. In the preferred lens configuration, the light of the combined beam smoothly transitions from the concentrated component to the divergent component as the divergent component surrounds the concentrated component.

The lens 324 is secured in a fixed position to the flashlight head 314, for example by means of an annular flange mount 326 about the front edge of the lens 324 affixed within a groove arrangement 328 of the head 314. The flange mount 326 radially extends from a flange section 327 (FIG. 32) forwardly of the lens TIR side surface 340 and rearwardly of the lens front surface 334, preferably immediately rearwardly of the lens front surface 334.

The LED 319 of the light source 318 is secured in a fixed position with respect to the lens 324. For example, a circuit board containing the LED chip 319 may be secured to a further circuit board fixed to the flashlight head 314 (or to the housing 312), the further circuit board containing flashlight circuitry which may include a controller for controlling operation of the LED 319 in combination with the switch 322 and battery 320.

Figure 32:
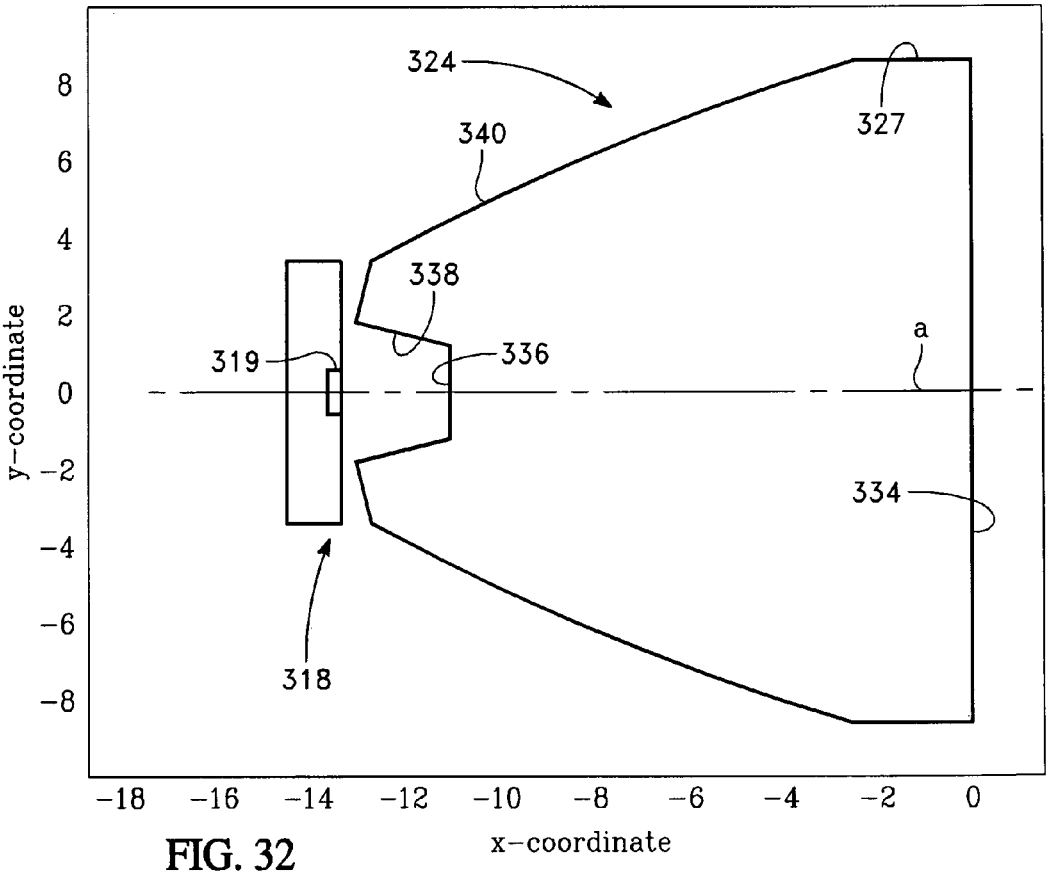
FIG. 32 shows the profile (in the x,y-plane) of a preferred lens embodiment included in the light assembly of FIG. 31, shown in operational relation to the light emitting diode (LED) light source of the light assembly.

The axisymmetric profile of the preferred embodiment of the lens 324, in the x,y-plane, is shown in FIG. 32 in greatly increased scale, with the x-coordinate corresponding to the symmetry axis of the lens 324 along its optical axis a and originating (in the example shown in FIG. 32) at the lens front surface 334, and with the y-axis representing radial distance from the optical axis. In the preferred lens embodiment, the x-coordinate and the y-coordinate are dimensioned in millimeters.

In addition to the front surface 334, the lens 324 includes a refractive first rear surface 336, preferably flat and orthogonally intersecting and symmetrical about the optical axis a, for receiving a first portion of the light emanating from the LED source 318 positioned along the optical axis a. An axisymmetric aspheric refractive second rear surface 338 of the lens 324 symmetrically extends about the first rear surface 336 for receiving a second portion of the light emanating from the LED light source 318. A total-internal reflection (TIR) side surface 340 of the lens 324 extends symmetrically about the optical axis a for total-internally reflecting and concentrating light received by the second rear surface. The diameter of the first rear surface 336, the axisymmetric profile of the second rear surface 338, and the axisymmetric profile of the TIR side surface 340 are related to one another for exiting at the front surface 334 the light beam comprising the first light component diverging from the optical axis combined with the concentrated second light component.

The preferred lens embodiment 324 was designed using the inverse engineering approach implemented in the NICOS software, as discussed above with respect to the designing of the preferred embodiment of the lens 24.

For designing the preferred lens embodiment 324, the NICOS software was set up to maximize the flux within a 4° acceptance angle for producing the desired light beam having concentrated and divergent components within the combined beam resulting in a high intensity core beam surrounded by a smoothly transitioning lower intensity surround beam. Such computer maximization was conducted using the Dynamic Synthesis global optimization software subject to various constraints imposed upon the lens design, including flux distribution of the LED source, physical properties of the lens material, the diameter of the lens exit aperture or front surface 334, and the diameter of the lens entrance aperture or first rear surface 336.

Figure 33:
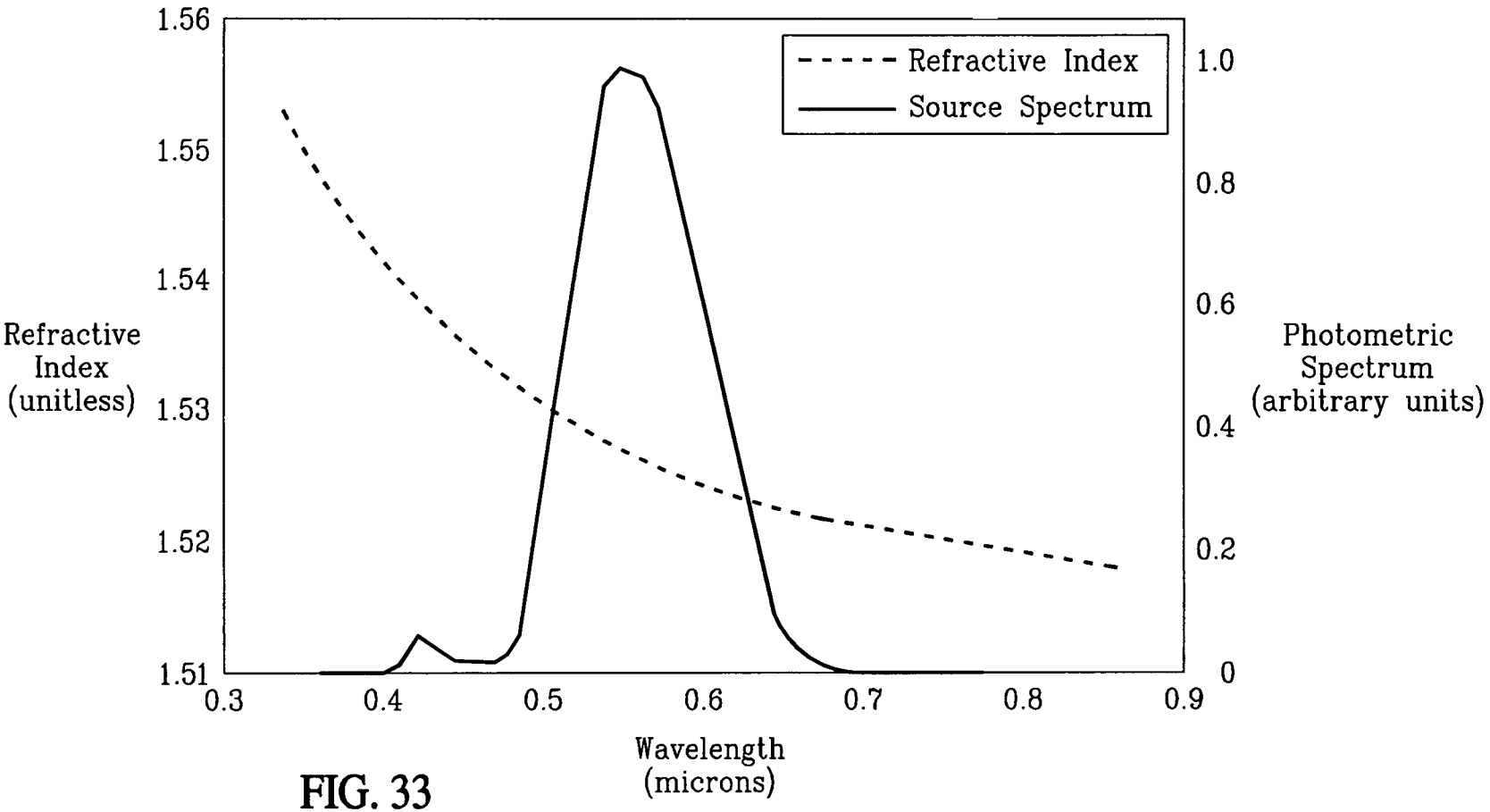
FIG. 33 is a graph depicting the assumed photometric source spectrum of the LED light source used in optimizing and analyzing the lens design of FIG. 32, together with the refractive index of the lens material as a function of wavelength.

The LED light source 318 employed was a model F50280-SF hybrid LED source marketed by Seoul Semiconductor Co. Ltd. (of Seoul, Korea) including a white-light die and an infrared (IR) die that were separately operable. The white-light die was used in optimizing and analyzing the lens design, with the white-light die centered on the lens optical axis a. The photometric source spectrum of the white-light die used in optimizing and analyzing the lens design is depicted in FIG. 33. The assumed total lumen output of the white-light LED source was 127.54 lumens, which is the value of the measured flux output for this source. Each of the dies of the LED 319 was of typical square configuration.

The material utilized for the lens 324 was a transparent optical plastic manufactured by ZEON Corporation (of Tokyo, Japan) and marketed under the ZEONEX registered trademark. The refractive index of the ZEONEX plastic lens material as a function of wavelength is shown in FIG. 33.

The diameter of the lens exit aperture (the flat front surface 334) was selected as 17.145 millimeters in the preferred example. The diameter of the lens entrance aperture (the flat first rear surface 336) was selected as 2.212 millimeters, for allocating light from the LED light source such that approximately one-third of the light is received by the first rear surface 336 and approximately two-thirds of the light is received by the second rear surface 338.

The iterative search of the global-optimization process modifies the variable parameters for maximizing the flux within the specified acceptance angle. In particular, modifications were made to the distance along the optical axis a of the lens exit aperture (the flat front surface 334) to the lens entrance aperture (the flat first rear surface 336), the distance of the light source 318 (measured, for example, from the front plane of the LED chip 319) to the lens first rear surface 336, and the axisymmetric shapes of the lens second rear surface 338 and the lens TIR side surface 340, while light ray traces were generated for simulating the light beams that would result from the various combinations searched.

Figure 34:
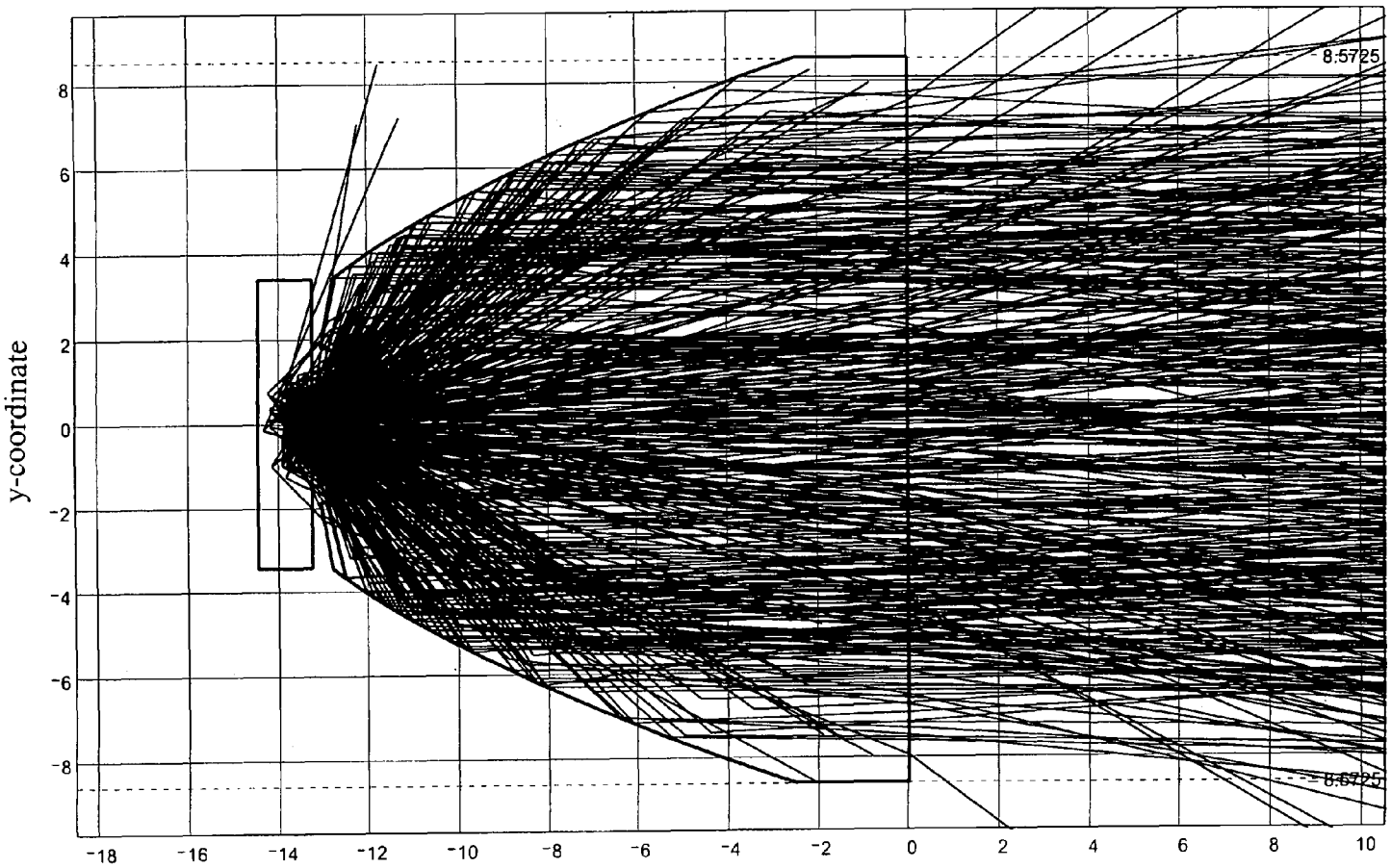
FIG. 34 depicts a computer simulated ray trace describing the light beam for the optimized lens shape and light source of FIG. 32.

The computer simulated light ray trace for the resulting optimized lens shape is shown in FIG. 34. It is noted that the diameter of the entrance aperture (flat first rear surface 336) and its distance from the light source 318 determine the percentage of the light emitted from the source for producing the divergent light component (as shown in FIG. 34) and which is responsible for the surround beam, while the light rays which pass through the second rear surface 338 are total-internally reflected and substantially collimated (as shown in FIG. 34) by the TIR side surface 340 for producing the concentrated substantially collimated light component of the beam exiting from the lens front surface 334.

Figure 35:
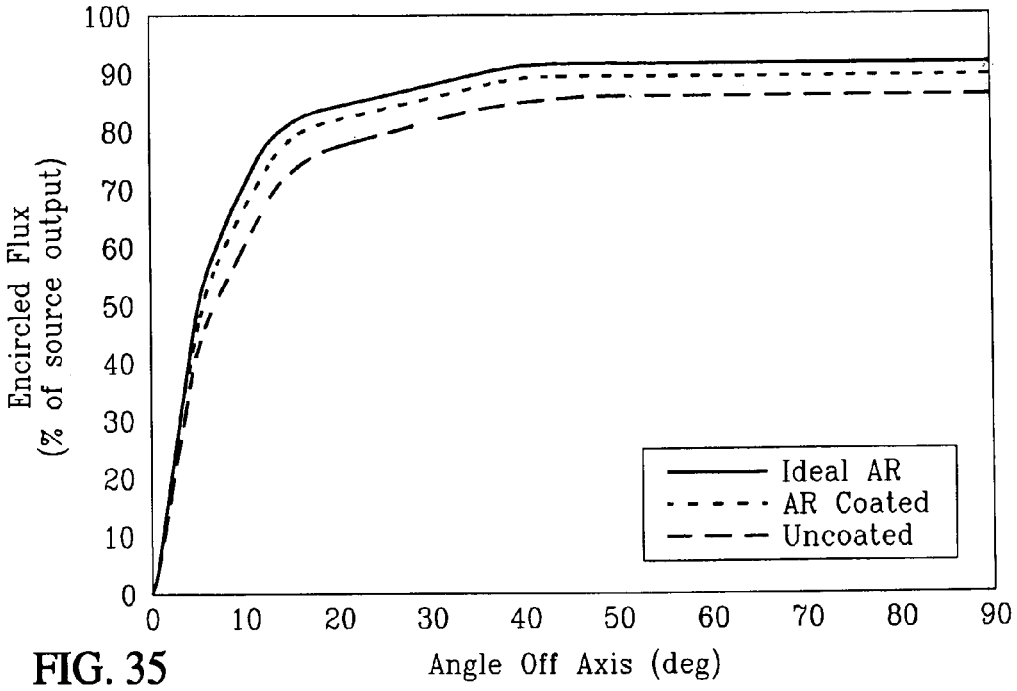
FIG. 35 shows a computer simulated analysis of normalized encircled flux versus angle for the light beam of FIG. 34.

FIG. 35 is a computer simulated plot of the encircled flux (as a percentage of source output using the white-light die) versus beam half angle, for the optimized lens uncoated and adjusted for an antireflective (AR) coating and with ideal antireflection.

Figure 37:
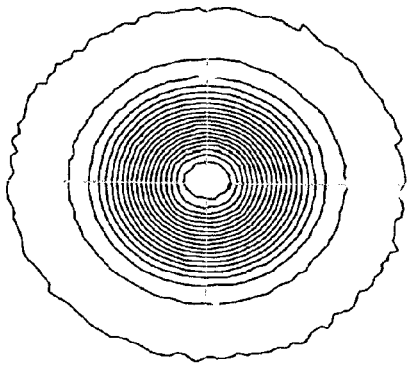
FIG. 37 is a computer simulated contour map showing the angular intensity distribution of the light beam of FIG. 34.
Figure 36:
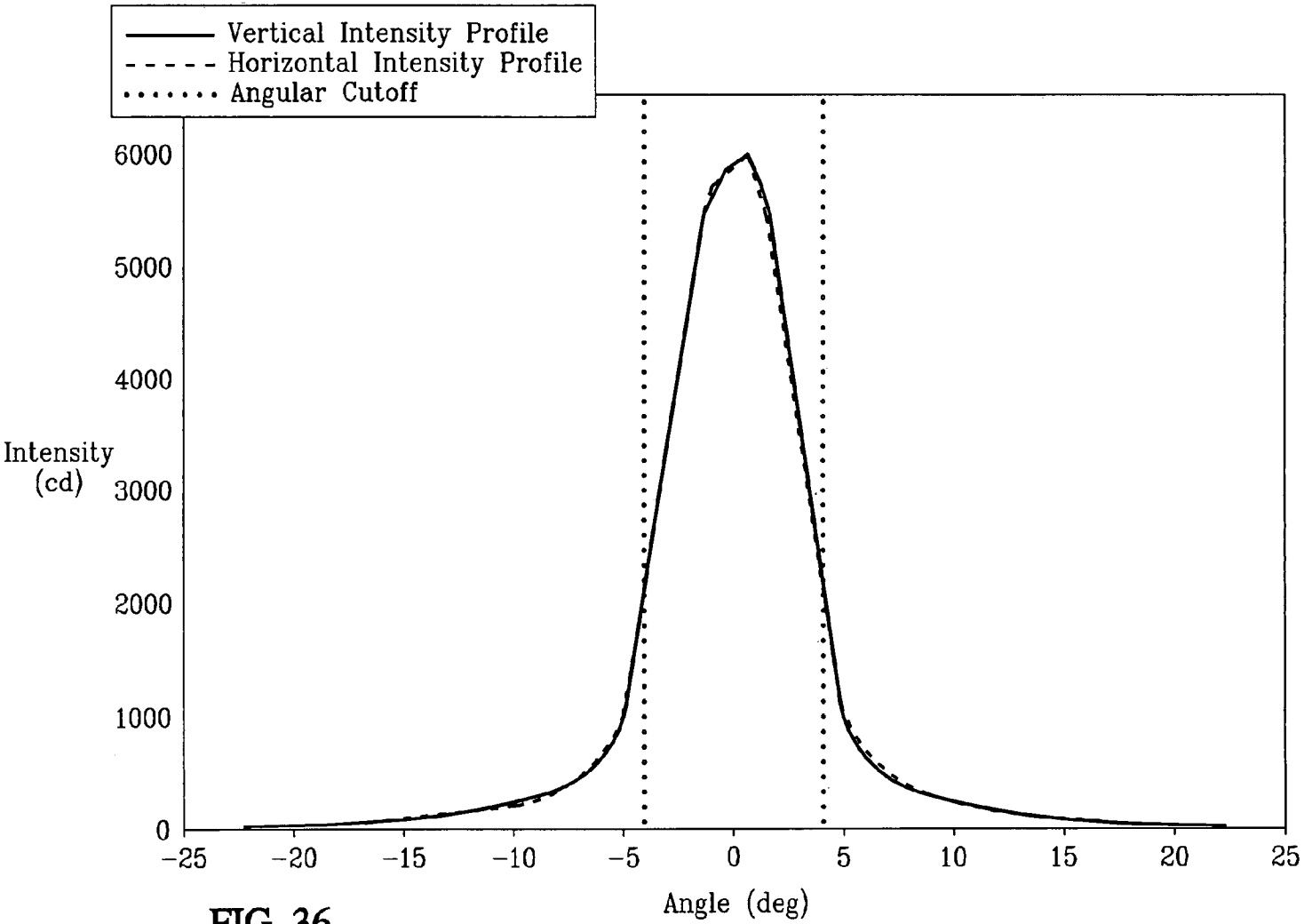
FIG. 36 shows a computer simulated analysis of the vertical and horizontal intensity profiles of the light beam of FIG. 34.

FIG. 36 is a computer simulated plot of intensity (in candelas) of the composite light beam produced by the optimized lens 324 with the white-light die of the indicated light source 318, as a function of angle (in degrees). The related angular intensity distribution contour map of FIG. 37 is representative of an important feature of the optimized lens shape of the present invention, specifically the substantially circular spatial cross-section of the composite beam produced by the optimized lens from the substantially square LED die. The lens 324 effectively modifies the source light pattern so that the output beam is of substantially circular cross-section.

The axisymmetric profile of the lens 324 is substantially described by sample points defined by the list of x,y-coordinate pairs set forth in FIGS. 39*a* and 39*b*. The x-coordinate represents position along the optical axis in the global coordinate system of the lens surface referenced from the front surface 334 (located at x=0.000), and the y-coordinate represents radial position referenced from (i.e. distance away from) the optical axis. The global x-axis corresponds to the symmetry axis of the lens, and the sample points on the profile of the lens preferred embodiment is in millimeters with a sampling interval of 0.10 millimeters. The lens profile of the preferred embodiment provides for a 2.5 millimeter flange section 327 immediately rearwardly of the front surface 334. The optimum placement of the LED 319 is at x=13.255 millimeters, or 2.358 millimeters (i.e. approximately 2.4 millimeters) rearwardly of the first rear surface 336. With respect to the lens profile, intermediate points between any two sample points listed may be determined using a cubic spline.

As may be appreciated from FIGS. 39*a* and 39*b*, the first rear surface 336 of the lens 324 comprises a circular planar surface of (in the preferred lens embodiment where the x-coordinate and the y-coordinate are dimensioned in millimeters) radius 1.106 millimeters rotationally symmetric about the x axis, and situated at x=−10.897 millimeters. The lens front surface 334 comprises a circular planar surface of radius 8.573 millimeters (in the preferred embodiment) rotationally symmetric about the x axis, and situated at x=0.000. The lens second rear surface 338 and TIR side surface 340 are each rotationally symmetric about the x-axis.

In designing the preferred embodiment of the lens 324 shown in FIG. 32, the thickness of the flange section 327 forwardly of the TIR side surface 340 (i.e., along the x-coordinate) was assumed to be 2.5 millimeters. However, a flange section 327 significantly greater or less than the noted 2.5 millimeters may be provided with negligible effect on performance.

Figure 38:
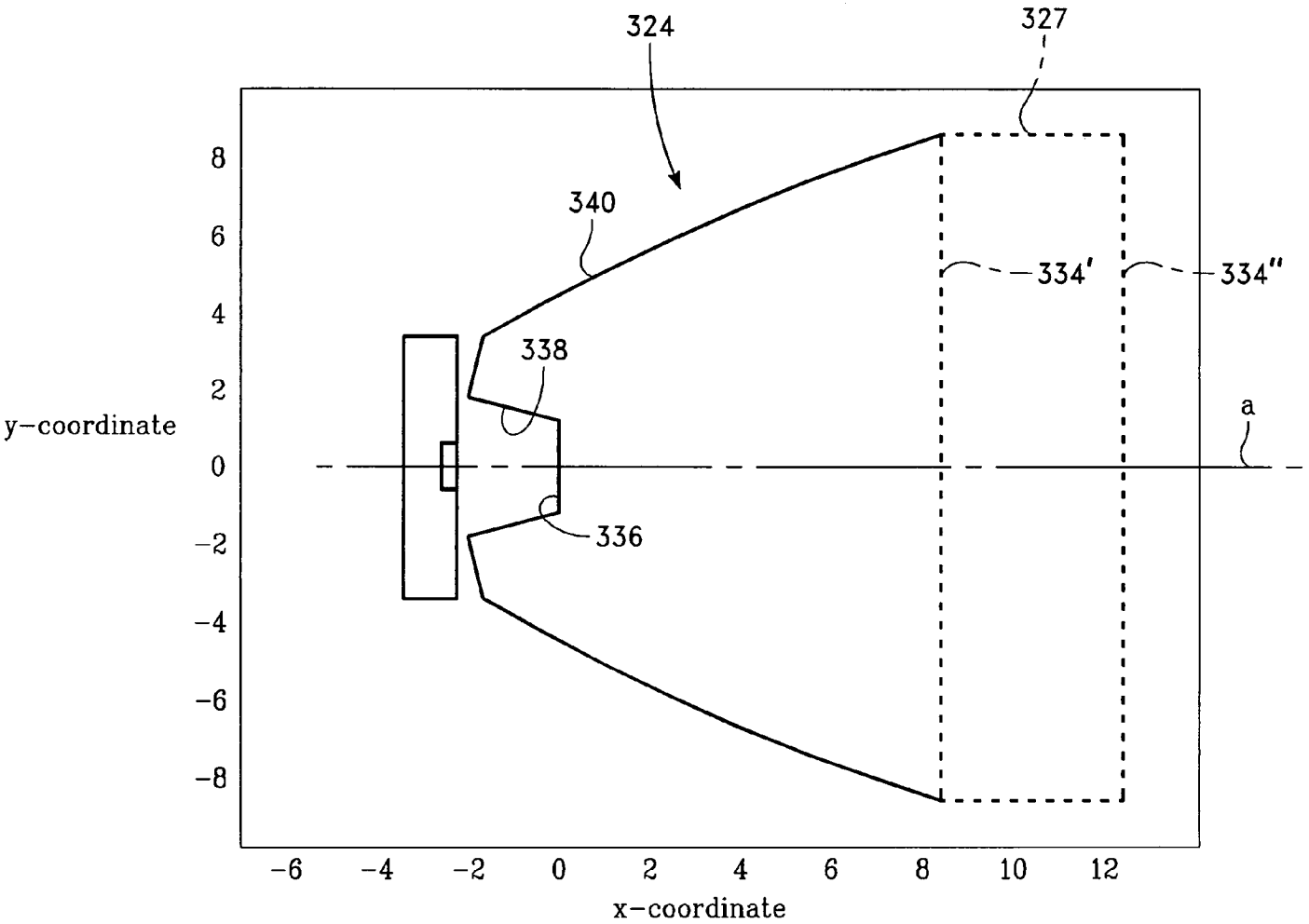
FIG. 38 shows the profile (in the x,y-plane) of the lens of FIG. 32, indicating thickness variance of the flange section.

FIG. 38 shows the lens 324 of FIG. 32, with the same profiles of the first rear surface 336, second rear surface 338 and TIR side surface 340. FIG. 38 is representative of a lens 324 in which the front surface 334' is located at the front end of the TIR side surface 340, or at a selected distance (indicated by the front surface 334") along the x-coordinate forwardly of the TIR side surface 340 to provide a flange section 327 of selected thickness. For a lens 324 having a flange section 327, such flange section 327 would be forwardly of the TIR side surface 340 and rearwardly of the front surface 334". For example, a flange section 327 of up to at least approximately 4.0 millimeters thickness (in a preferred lens embodiment 324 with the x-coordinate dimensioned in millimeters) may be used in the present light assembly with negligible effect on performance.

The axisymmetric profile of the first rear surface 336, the second rear surface 338 and the TIR side surface 340 of the lens 324, as shown in FIG. 38, is substantially described by sample points defined by the list of x,y-coordinate pairs set forth in FIG. 40. The x-coordinate represents position along the optical axis in the global coordinate system of the lens surface referenced from the first rear surface 336 (located at x=0.000), and the y-coordinate represents radial position referenced from (i.e. distance away from) the optical axis. The global x-axis corresponds to the symmetry axis of the lens, and the sample points on the profile of the lens preferred embodiment is in millimeters with a sampling interval of 0.10 millimeters. The optimum placement of the LED 319 is at x=−2.358 millimeters, or 2.358 millimeters (i.e. approximately 2.4 millimeters) rearwardly of the first rear surface 336. With respect to the lens profile, intermediate points between any two sample points listed may be determined using a cubic spline.

As may be appreciated from FIG. 40, the first rear surface 336 of the lens 324 comprises a circular planar surface of (in the preferred lens embodiment where the x-coordinate and the y-coordinate are dimensioned in millimeters) radius 1.106 millimeters rotationally symmetric about the x axis, and situated at x=0.000. The lens front surface 334, as previously described in FIGS. 39*a* and 39*b*, comprises a circular planar surface of radius 8.573 millimeters (in the preferred embodiment) rotationally symmetric about the x axis. The lens second rear surface 338 and TIR side surface 340 are each rotationally symmetric about the x-axis.

The list of the x,y-coordinate pairs of sample points in FIG. 41 is specific to the axisymmetric profile of the aspheric refractive second rear surface 338 of the optimized lens 324 shown in FIG. 38, in millimeters for the preferred embodiment.

The list of x,y-coordinate pairs of sample points in FIG. 42 is specific to the aspheric axisymmetric profile of the TIR side surface 340 of the lens 324 shown in FIG. 38, in millimeters for the preferred embodiment.

As discussed above, the shape of the lens 324 was optimized for use with the white-light die 319 of the identified LED light source 318. In addition to the analysis of the resulting lens design using the white-light die described above, the resulting lens design was analyzed in a manner similar to that described in U.S. Pat. No. 8,033,690 of the present inventors (which patent is incorporated herein by reference), using the IR die of the identified light source 318 with the IR die replacing the white-light die and centered on the lens optical axis a. Such analysis indicated that the IR die of the light source 318 may be used with the lens 324 (which was optimized for the white-light die) for producing a satisfactory—although not optimal—IR beam having concentrated and divergent components.

In manufacturing lenses according to the inventions described herein, the x and y positions of the sample points on the axisymmetric profiles represented by the x,y-coordinate pairs may be subject to reasonable tolerances. Such reasonable tolerances should have negligible effect on performance of the light assembly, i.e. the implementation of such tolerances does not noticeably degrade the composite light beam exiting from the lens front surface. Further, the lens front surface may be shifted along the x-coordinate to adjust the thickness of the flange section as previously described.

Thus, there has been described preferred embodiments of nonimaging light assemblies each having a light source and a lens symmetrical about an optical axis for receiving light from the light source and producing therefrom a light beam having a concentrated component and a divergent component resulting in a high intensity core beam surrounded by a smoothly transitioning lower intensity surround beam. In preferred embodiments wherein the light source comprises an approximately square light emitting diode, the resulting combined light beam is of substantially circular cross-section. Other embodiments of the present invention, and variations of the embodiments described herein, may be developed without departing from the essential characteristics thereof. Accordingly, the present invention should be limited only by the scope of the claims listed below.

We claim:

1. A nonimaging light assembly, comprising:

a light source; and a lens symmetrical about an optical axis, including a first rear surface intersecting said optical axis for receiving a first portion of light emanating from said light source positioned along said optical axis, a second rear surface extending about said first rear surface for receiving a second portion of light emanating from said light source, a side surface for total-internally reflecting and substantially collimating light received by said second rear surface, and a front surface for exiting light reflected from said side surface and light received by said first rear surface;

said lens having an axisymmetric profile substantially described by sample points thereon defined by x,y-coordinate pairs set forth in FIGS. 39*a* and 39*b*, incorporated herein by reference, where x represents position along an x-coordinate along said optical axis and y represents position along a y-coordinate radially from said optical axis, the x and y positions of said sample points subject however to reasonable tolerances, for exiting at said front surface a composite light beam comprising a first light component diverging from said optical axis produced from light received by said first rear surface combined with a concentrated substantially collimated second light component resulting in a core beam surrounded by a smoothly transitioning lower intensity surround beam.

2. The light assembly according to claim 1, wherein:

the distance between said light source and said first rear surface is selected for allocating to said first rear surface approximately one-third of the light received by said lens from said light source.

3. The light assembly according to claim 1, wherein:

said light source comprises a light emitting diode; and said composite light beam exiting said front surface has a substantially circular cross-section.

4. The light assembly according to claim 1, wherein:

said light source has an approximately square configuration substantially perpendicular to said optical axis; and said composite light beam exiting said front surface has a substantially circular cross-section.

5. The light assembly according to claim 1, wherein:

said tolerances have negligible effect on performance of said light assembly.

6. The light assembly according to claim 1, wherein:

implementation of said tolerances does not noticeably degrade said composite light beam exiting from said front surface.

7. The light assembly according to claim 1, wherein:

said x-coordinate and said y-coordinate are dimensioned in millimeters.

8. The light assembly according to claim 7, wherein:

said tolerances have negligible effect on performance of said light assembly.

9. The light assembly according to claim 7, wherein:

implementation of said tolerances does not noticeably degrade said composite light beam exiting from said front surface.

10. A nonimaging light assembly, comprising:

a light source; and a lens symmetrical about an optical axis, including a first rear surface intersecting said optical axis for receiving a first portion of light emanating from said light source positioned along said optical axis, a second rear surface extending about said first rear surface for receiving a second portion of light emanating from said light source, a side surface for total-internally reflecting and substantially collimating light received by said second rear surface, and a substantially flat front surface for exiting light reflected from said side surface and light received by said first rear surface;

said first rear surface, said second rear surface and said side surface of said lens having an axisymmetric profile substantially described by sample points thereon defined by x,y-coordinate pairs set forth in FIG. 40, incorporated herein by reference, where x represents position along an x-coordinate along said optical axis and y represents position along a y-coordinate radially from said optical axis, the x and y positions of said sample points subject however to reasonable tolerances, for exiting at said front surface a composite light beam comprising a first light component diverging from said optical axis produced from light received by said first rear surface combined with a concentrated substantially collimated second light component resulting in a core beam surrounded by a smoothly transitioning lower intensity surround beam.

11. The light assembly according to claim 10, wherein:
said lens includes a flange section forwardly of said side surface and rearwardly of said front surface.

12. The light assembly according to claim 10, wherein:
said tolerances have negligible effect on performance of said light assembly.

13. The light assembly according to claim 10, wherein:
implementation of said tolerances does not noticeably degrade said composite light beam exiting from said front surface.

14. The light assembly according to claim 10, wherein:
said x-coordinate and said y-coordinate are dimensioned in millimeters.

15. The light assembly according to claim 14, wherein:
said lens includes a flange section forwardly of said side surface and rearwardly of said front surface.

16. The light assembly according to claim 14, wherein:
said tolerances have negligible effect on performance of said light assembly.

17. The light assembly according to claim 14, wherein:
implementation of said tolerances does not noticeable degrade said composite light beam exiting from said front surface.

18. The light assembly according to claim 10, wherein:
the distance between said light source and said first rear surface is selected for allocating to said first rear surface approximately one-third of the light received by said lens from said light source.

19. The light assembly according to claim 10, wherein:
said light source comprises a light emitting diode; and
said composite light beam exiting said front surface has a substantially circular cross-section.

20. The light assembly according to claim 10, wherein:
said light source has approximately square configuration substantially perpendicular to said optical axis; and
said composite light beam exiting said front surface has a substantially circular cross-section.

21. The light assembly according to claim 10, wherein:
said light source comprises a hybrid light emitting diode source including a first die and a second die, said lens optimized for use with said first die positioned on said optical axis, said light source adapted for replacing said first die with said second die on said optical axis.

22. The light assembly according to claim 10, wherein:
said first die is a white-light die.

23. The light assembly according to claim 22, wherein:
said second die is an infrared die.

24. A nonimaging light assembly, comprising:
a light source; and
a lens symmetrical about an optical axis, including
a substantially circular first rear surface intersecting said optical axis for receiving a first portion of light emanating from said light source positioned along said optical axis,
a second rear surface extending about said first rear surface for receiving a second portion of light emanating from said light source, said second rear surface having an axisymmetric profile substantially described by sample points thereon defined by x,y-coordinate pairs set forth in FIG. 41, incorporated herein by reference, where x represents position along an x-coordinate along said optical axis and y represents position along a y-coordinate radially from said optical axis, the x and y positions of said sample points subject however to reasonable tolerances,
a side surface having an axisymmetric profile for total-internally reflecting and substantially collimating light received by said second rear surface, and
a substantially flat front surface for exiting light reflected from said side surface and light received by said first rear surface;
the diameter of said first rear surface, said axisymmetric profile of said second rear surface, and said axisymmetric profile of said side surface being related for exiting at said front surface a composite light beam comprising a first light component diverging from said optical axis produced from light received by said first rear surface combined with a concentrated substantially collimated second light component resulting in a core beam surrounded by a smoothly transitioning lower intensity surround beam.

25. The light assembly according to claim 24, wherein:
said lens includes a flange section forwardly of said side surface and rearwardly of said front surface.

26. The light assembly according to claim 24, wherein:
said tolerances have negligible effect on performance of said light assembly.

27. The light assembly according to claim 24, wherein:
implementation of said tolerances does not noticeable degrade said composite light beam exiting from said front surface.

28. The light assembly according to claim 24, wherein:
said x-coordinate and said y-coordinate are dimensioned in millimeters.

29. The light assembly according to claim 28, wherein
said lens includes a flange section forwardly of said side surface and rearwardly of said front surface.

30. The light assembly according to claim 28, wherein:
said tolerances have negligible effect on performance of said light assembly.

31. The light assembly according to claim 28, wherein:
implementation of said tolerances does not noticeable degrade said composite light beam exiting from said front surface.

32. The light assembly according to claim 24, wherein:
said first rear surface comprises a refractive surface substantially perpendicular to said optical axis;
said front surface comprises a refractive surface substantially perpendicular to said optical axis;
said second rear surface comprises an aspheric refractive surface; and
said side surface comprises an aspheric total-internal reflective surface, said axisymmetric profile of said side surface substantially described by sample points thereon defined by x,y-coordinate pairs set forth in FIG. 42, incorporated herein by reference, where x represents position along an x-coordinate along said optical axis and y represents position along a y-coordinate radially from said optical axis, the x and y positions noted in FIG. 42 subject however to reasonable tolerances.

33. The light assembly according to claim 32, wherein:
said first rear surface is substantially flat.

34. The light assembly according to claim 32, wherein:
said lens includes a flange section forwardly of said side surface and rearwardly of said front surface.

35. The light assembly according to claim 32, wherein:
said tolerances have negligible effect on performance of said light assembly.

36. The light assembly according to claim 32, wherein:
implementation of said tolerances does not noticeably degrade said composite light beam exiting from said front surface.

37. The light assembly according to claim 32, wherein:
said x-coordinate and said y-coordinate are dimensioned in millimeters.

38. The light assembly according to claim 37, wherein:
said lens includes a flange section forwardly of said side surface and rearwardly of said front surface.

39. The light assembly according to claim 37, wherein:
said tolerances have negligible effect on performance of said light assembly.

40. The light assembly according to claim 37, wherein:
implementation of said tolerances does not noticeably degrade said composite light beam exiting from said front surface.

41. A nonimaging light assembly, comprising:
a light source; and
a lens symmetrical about an optical axis, including
a substantially circular first rear surface intersecting said optical axis for receiving a first portion of light emanating from said light source positioned along said optical axis,
a second rear surface extending about said first rear surface and having an axisymmetric profile for receiving a second portion of light emanating from said light source,
a side surface for total-internally reflecting and substantially collimating light received by said second rear surface, said side surface having an axisymmetric profile substantially described by sample points thereon defined by x,y-coordinate pairs set forth in FIG. 42, incorporated herein by reference, where x represents position along an x-coordinate along said optical axis and y represents position along a y-coordinate radially from said optical axis, the x and y positions of said sample points subject however to reasonable tolerances, and
a substantially flat front surface for exiting light reflected from said side surface and light received by said first rear surface;
the diameter of said first rear surface, said axisymmetric profile of said second rear surface, and said axisymmetric profile of said side surface being related for exiting at said front surface a composite light beam comprising a first light component diverging from said optical axis produced from light received by said first rear surface combined with a concentrated substantially collimated second light component resulting in a core beam surrounded by a smoothly transitioning lower intensity surround beam.

42. The light assembly according to claim 41, wherein:
said lens includes a flange section forwardly of said side surface and rearwardly of said front surface.

43. The light assembly according to claim 41, wherein:
said tolerances have negligible effect on performance of said light assembly.

44. The light assembly according to claim 41, wherein:
implementation of said tolerances does not noticeably degrade said composite light beam exiting from said front surface.

45. The light assembly according to claim 41, wherein:
said x-coordinate and said y-coordinate are dimensioned in millimeters.

46. The light assembly according to claim 45, wherein:
said lens includes a flange section forwardly of said side surface and rearwardly of said front surface.

47. The light assembly according to claim 45, wherein:
said tolerances have negligible effect on performance of said assembly.

48. The light assembly according to claim 45, wherein:
implementation of said tolerances does not noticeably degrade said composite light beam exiting from said front surface.

* * * * *